US008662337B2

(12) United States Patent
Lacy et al.

(10) Patent No.: US 8,662,337 B2
(45) Date of Patent: Mar. 4, 2014

(54) WASTE STORAGE DEVICE

(75) Inventors: Graham Keith Lacy, London (GB); Nicholas Gerald Fitton, Swindon (GB); Benjamin Douglas Vinal Cramp, London (GB); Julian Swan, London (GB)

(73) Assignee: Sangenic International Limited, Cramlington, Northumberland (GB)

( * ) Notice: Subject to any disclaimer, the term of this patent is extended or adjusted under 35 U.S.C. 154(b) by 110 days.

(21) Appl. No.: 12/578,856

(22) Filed: Oct. 14, 2009

(65) Prior Publication Data

US 2010/0089926 A1 Apr. 15, 2010

Related U.S. Application Data

(63) Continuation of application No. 12/514,957, filed as application No. PCT/GB2007/004410 on Nov. 16, 2007.

(30) Foreign Application Priority Data

Nov. 16, 2006 (GB) ..... 0622909.0

(51) Int. Cl.
*B65D 43/26* (2006.01)

(52) U.S. Cl.
USPC ..... 220/264; 220/908; 220/262; 220/908.1

(58) Field of Classification Search
USPC ..... 220/521, 908, 262, 263, 264
See application file for complete search history.

(56) References Cited

U.S. PATENT DOCUMENTS

| | | | |
|---|---|---|---|
| 182,173 | A | 9/1876 | Cussen |
| 435,638 | A | 9/1890 | Barnes |
| 617,961 | A | 1/1899 | Johnson |
| 918,355 | A | 4/1909 | McGowan |
| 3,452,368 | A | 7/1969 | Couper |
| 3,536,192 | A | 10/1970 | Couper |
| 3,682,371 | A | 8/1972 | Saika |
| 3,732,662 | A | 5/1973 | Paxton |
| 3,746,159 | A | 7/1973 | May |
| 3,908,336 | A | 9/1975 | Forslund |

(Continued)

FOREIGN PATENT DOCUMENTS

| | | |
|---|---|---|
| AU | 720614 | 6/2000 |
| CA | 2218628 | 4/1998 |

(Continued)

OTHER PUBLICATIONS

English translation of Hungarian Search Report for Hungarian App. No. P 040 0172.

(Continued)

*Primary Examiner* — Anthony Stashick
*Assistant Examiner* — Christopher McKinley
(74) *Attorney, Agent, or Firm* — Ungaretti & Harris LLP

(57) ABSTRACT

A waste storage device is provided including a waste storage cassette receiving chamber for receiving a cassette rotatable within the chamber and containing tubing for enveloping waste. The device further includes a waste inlet and a throat area therebetween, wherein a releasable gripping assembly is provided in the throat area and arranged for actuation between a released configuration defining an aperture for passage of waste therethrough and a gripping configuration defining a restriction in the throat area.

19 Claims, 47 Drawing Sheets

(56) References Cited

U.S. PATENT DOCUMENTS

| | | | | |
|---|---|---|---|---|
| 3,938,300 | A | 2/1976 | Lovquist | |
| 4,132,047 | A | 1/1979 | Gerigk et al. | |
| 4,133,356 | A | 1/1979 | Dillingham | |
| 4,191,226 | A | 3/1980 | Kyte | |
| 4,202,075 | A | 5/1980 | Michel et al. | |
| 4,422,215 | A | 12/1983 | Liekens et al. | |
| 4,488,697 | A | 12/1984 | Garvey | |
| 4,505,003 | A | 3/1985 | Becker et al. | |
| 4,519,104 | A * | 5/1985 | Nilsson | 4/484 |
| 4,869,049 | A | 9/1989 | Richards et al. | |
| 4,934,529 | A | 6/1990 | Richards et al. | |
| 4,947,618 | A * | 8/1990 | Schneider et al. | 53/374.6 |
| 4,993,210 | A | 2/1991 | Kollross | |
| 5,045,020 | A | 9/1991 | Neeff et al. | |
| 5,056,293 | A | 10/1991 | Richards et al. | |
| 5,353,716 | A | 10/1994 | Wilbert | |
| 5,535,913 | A | 7/1996 | Asbach et al. | |
| 5,590,512 | A | 1/1997 | Richards et al. | |
| 5,655,680 | A | 8/1997 | Asbach et al. | |
| 5,782,061 | A | 7/1998 | Clazie et al. | |
| 5,813,200 | A | 9/1998 | Jacoby et al. | |
| 5,871,037 | A | 2/1999 | Feldt | |
| 5,884,346 | A | 3/1999 | Hengl | |
| 5,899,049 | A | 5/1999 | Fuss et al. | |
| 6,065,272 | A | 5/2000 | Lecomte | |
| 6,128,890 | A | 10/2000 | Firth | |
| 6,170,240 | B1 | 1/2001 | Jacoby et al. | |
| 6,212,701 | B1 | 4/2001 | He | |
| 6,370,847 | B1 * | 4/2002 | Jensen et al. | 53/459 |
| 6,516,588 | B2 | 2/2003 | Jensen et al. | |
| 6,612,099 | B2 | 9/2003 | Stravitz | |
| 6,672,472 | B1 | 1/2004 | Rockwood et al. | |
| 6,719,194 | B2 * | 4/2004 | Richards | 232/43.1 |
| 6,722,107 | B2 | 4/2004 | Morand | |
| 6,804,930 | B2 | 10/2004 | Stravitz | |
| 6,817,164 | B2 | 11/2004 | Mauffette et al. | |
| 6,851,251 | B2 | 2/2005 | Stravitz | |
| 6,901,974 | B2 | 6/2005 | Chomik et al. | |
| 6,925,781 | B1 | 8/2005 | Knuth et al. | |
| 6,931,684 | B1 | 8/2005 | Henegar | |
| 6,941,733 | B2 | 9/2005 | Chomik et al. | |
| 6,974,029 | B2 | 12/2005 | Morand et al. | |
| 6,993,891 | B2 | 2/2006 | Richardson et al. | |
| 6,994,247 | B2 | 2/2006 | Richards | |
| 7,073,311 | B2 | 7/2006 | Chomik et al. | |
| 7,100,767 | B2 | 9/2006 | Chomik et al. | |
| 7,114,314 | B2 | 10/2006 | Stravitz | |
| 7,114,534 | B2 | 10/2006 | Chomik et al. | |
| 7,146,785 | B2 | 12/2006 | Stravitz | |
| 7,178,314 | B2 * | 2/2007 | Chomik et al. | 53/459 |
| 7,316,100 | B2 | 1/2008 | Stravitz et al. | |
| 7,406,814 | B2 | 8/2008 | Morand | |
| 7,434,377 | B2 | 10/2008 | Stravitz et al. | |
| 2002/0078665 | A1 | 6/2002 | Salman et al. | |
| 2002/0162304 | A1 | 11/2002 | Stravitz | |
| 2002/0170275 | A1 | 11/2002 | Salman et al. | |
| 2003/0121923 | A1 | 7/2003 | Morand et al. | |
| 2003/0131569 | A1 | 7/2003 | Chomik et al. | |
| 2003/0213804 | A1 * | 11/2003 | Chomik et al. | 220/495.07 |
| 2004/0020175 | A1 | 2/2004 | Stravitz | |
| 2004/0083681 | A1 | 5/2004 | Stravitz | |
| 2005/0016890 | A1 | 1/2005 | Tannock | |
| 2005/0044819 | A1 | 3/2005 | Chomik | |
| 2005/0106706 | A1 | 5/2005 | Chomik et al. | |
| 2005/0115207 | A1 | 6/2005 | Chomik | |
| 2005/0183400 | A1 | 8/2005 | Stravitz et al. | |
| 2005/0183401 | A1 | 8/2005 | Stravitz et al. | |
| 2005/0188661 | A1 | 9/2005 | Stravitz et al. | |
| 2005/0193691 | A1 | 9/2005 | Stravitz et al. | |
| 2005/0193692 | A1 | 9/2005 | Stravitz et al. | |
| 2005/0217214 | A1 | 10/2005 | Richardson et al. | |
| 2005/0274093 | A1 | 12/2005 | Stravitz et al. | |
| 2006/0010837 | A1 | 1/2006 | Jurus | |
| 2006/0021301 | A1 * | 2/2006 | Stravitz et al. | 53/576 |
| 2006/0032190 | A1 | 2/2006 | Knuth et al. | |
| 2006/0130438 | A1 | 6/2006 | Stravitz et al. | |
| 2006/0130439 | A1 | 6/2006 | Stravitz et al. | |
| 2006/0237461 | A1 * | 10/2006 | Chomik et al. | 220/495.06 |
| 2006/0248862 | A1 * | 11/2006 | Morand | 53/567 |
| 2006/0249418 | A1 | 11/2006 | Chomik et al. | |
| 2006/0251842 | A1 | 11/2006 | Chomik et al. | |
| 2007/0125792 | A1 * | 6/2007 | Pollack et al. | 220/908.2 |
| 2007/0157581 | A1 * | 7/2007 | Webb et al. | 53/576 |
| 2007/0157582 | A1 | 7/2007 | Chomik | |
| 2007/0175182 | A1 | 8/2007 | Stravitz et al. | |
| 2007/0180798 | A1 | 8/2007 | Stravitz et al. | |
| 2007/0246465 | A1 | 10/2007 | Stravitz et al. | |
| 2009/0100806 | A1 | 4/2009 | Morand | |
| 2009/0126320 | A1 | 5/2009 | Rousso et al. | |

FOREIGN PATENT DOCUMENTS

| | | | |
|---|---|---|---|
| CA | 2366384 | | 6/2003 |
| CA | 2383799 | | 10/2003 |
| CA | 2640384 | | 4/2009 |
| CN | 2417149 | | 1/2001 |
| CN | 2543475 | | 4/2003 |
| CN | 2714475 | | 8/2005 |
| CN | 2861082 | | 1/2007 |
| CN | 2882503 | | 3/2007 |
| DE | 19646165 | | 5/1998 |
| DE | 9319683 | U | 9/2000 |
| DE | 202005015117 | | 2/2007 |
| DE | 202006004159 | | 8/2007 |
| EP | 0005660 | | 11/1979 |
| EP | 0281355 | A2 | 9/1988 |
| EP | 0303517 | | 2/1989 |
| EP | 0303517 | A | 2/1989 |
| EP | 0353922 | A1 | 2/1990 |
| EP | 0356051 | A | 2/1990 |
| EP | 0356051 | A1 | 2/1990 |
| EP | 0 404 484 | A1 | 12/1990 |
| EP | 0 699 584 | A2 | 3/1996 |
| EP | 0 738 657 | A2 | 10/1996 |
| EP | 0963924 | | 12/1999 |
| EP | 1062167 | | 12/2000 |
| EP | 1136357 | | 9/2001 |
| EP | 1324919 | | 7/2003 |
| EP | 1364879 | | 11/2003 |
| EP | 1925570 | | 5/2008 |
| EP | 2045197 | | 4/2009 |
| GB | 1422594 | | 1/1976 |
| GB | 1506428 | | 4/1978 |
| GB | 2206094 | A | 12/1988 |
| GB | 2 221 445 | A | 2/1990 |
| GB | 2 232 951 | A | 1/1991 |
| GB | 2292725 | A | 3/1996 |
| HU | P9203105 | | 9/1992 |
| HU | P0104980 | | 11/2001 |
| JP | 50-152890 | | 12/1975 |
| JP | 54-029272 | | 5/1979 |
| JP | 63-123701 | | 5/1988 |
| JP | 7025402 | | 1/1995 |
| JP | 7009804 | | 2/1995 |
| JP | 07/28104 | | 5/1995 |
| JP | 7125802 | | 5/1995 |
| JP | 8217204 | | 8/1996 |
| JP | 2000247401 | A | 9/2000 |
| JP | 2002-541040 | | 10/2000 |
| JP | 2002-226003 | | 8/2002 |
| JP | 2003118806 | | 4/2003 |
| JP | 2004175508 | | 6/2004 |
| JP | 1-158404 | | 9/2004 |
| WO | WO-9612663 | A1 | 5/1996 |
| WO | WO-98/17536 | | 4/1998 |
| WO | WO-99/39995 | | 8/1999 |
| WO | WO-0061465 | A | 10/2000 |
| WO | WO-02/20354 | | 3/2002 |
| WO | WO-02/083525 | A1 | 10/2002 |
| WO | WO-02/087795 | | 11/2002 |
| WO | WO-02100723 | A1 | 12/2002 |
| WO | WO-03/059748 | A2 | 7/2003 |
| WO | WO-2004/011164 | | 2/2004 |
| WO | WO-2004/089753 | | 10/2004 |

(56) References Cited

FOREIGN PATENT DOCUMENTS

| | | | |
|---|---|---|---|
| WO | WO-2005042381 | A2 | 5/2005 |
| WO | WO-2006/028988 | | 3/2006 |
| WO | WO-2006/028989 | | 3/2006 |
| WO | WO-2006/029038 | | 3/2006 |
| WO | WO-2006/029039 | | 3/2006 |
| WO | WO-2007/028230 | | 3/2007 |
| WO | WO-2007/071054 | | 6/2007 |
| WO | WO-2008/059282 | A1 | 5/2008 |

OTHER PUBLICATIONS

International Preliminary Examination Report for PCT/GB02/02627 mailed Apr. 29, 2003.
International Search Report for PCT/GB02/02627 mailed Sep. 2, 2002.
International Search Report for PCT/GB2004/004456 mailed May 17, 2005.
International Search Report for PCT/GB2007/004410 mailed Feb. 25, 2008.
Manual for InkoBaby Refill.
Manual Placed in the Packaging Material for InkoBaby nappy bin.
Maskinstabi, 6th volume, 2nd edition, 1981 p. 51.
Photographs of InkoBaby Refill and Cassette.
Search Report for GB 01/14312.2 mailed Aug. 4, 2002 dated Aug. 4, 2002.
Search Report for Hungarian App. No. P 040 0172 dated Oct. 20, 2004.
Statement by Kirsten Behrensdorff from Onskeborn dated Jun. 4, 2003.
Statement from Peter Behrensdorff from Layette dated Feb. 28, 2005.
Statement by childminder Kirsten Walter Larsen dated Feb. 27, 2005.
Statement by wholesale trader Kurt Pedersen dated Feb. 28, 2005.
Letter of Nov. 24, 2000 to Fimck in connection with film dispenser dated Nov. 24, 2000.
Letter of Nov. 29, 2000 to municipality of Rosenholm dated Nov. 29, 2000.
Statement by Managing Director Karl-Erik Wessmann of Lamico ApS dated Aug. 8, 2005.
Statement by G W Wood, Managing Director of Bradley Carter dated Feb. 26, 2005.

* cited by examiner

WASTE STORAGE DEVICE

CROSS-REFERENCE TO RELATED APPLICATIONS

The present application is a continuation of U.S. patent application Ser. No. 12/514,957, which is a U.S. National Stage filing under §371 of International Application No. PCT/GB2007/004410 filed Nov. 16, 2007, claiming priority from Great Britain Application No. GB 0622909.0 filed Nov. 16, 2006, all of which are herein incorporated by reference.

FEDERALLY SPONSORED RESEARCH OR DEVELOPMENT

N/A

TECHNICAL FIELD

The invention relates to a waste storage device for storing waste products such as nappies.

BACKGROUND OF THE INVENTION

The problem of how to effectively seal and store nappy waste is well recognised. It is possible to store nappy waste in ordinary household bins; however these are not sufficiently smell proof to enable nappy waste to be hygienically stored except on a very temporary basis. Plastic bags may be used to wrap soiled nappies and other waste in an attempt to block smell leakage, however these bags have limited effect and often comprise more plastic than is needed to wrap a single nappy, therefore creating unnecessary waste.

Several known devices exist which provide means for sealing and storing nappy waste. These devices include containers for housing waste cassettes from which plastic tubing can be dispensed. In use, the user accesses plastic tubing from a cassette and places a nappy or other waste item in the tubing, in order to create a waste package. The tubing may be twisted or knotted in order to seal the waste package. A series of waste packages can then be stored in a waste storage compartment of the device. However, there are several problems associated with the waste devices which are currently available to the public.

One known device which is designed for the storage of nappy waste is described in WO2005/042381 (Sangenic International Limited). According to WO2005/042381 a waste container is provided for housing a waste storage cassette as described above. The container includes gripping means to hold a waste package in place whilst the cassette is rotated with respect to the waste package. This forms a twisted seal in the top of the waste package, wherein the twisted seal also acts as the base of a length of tubing for packaging the next waste item to be disposed of. In order to direct the formed waste packages into the waste storage compartment of the device of WO2005/042381 it is necessary for the user to manually push the waste packages through the gripping means to guide them into the waste storage compartment for storage, which raises hygiene concerns. In addition, for each waste package to be formed the user must manually control how much flexible tubing is dispensed from the waste cassette, both when rotating the cassette and when pushing film through the hollow in the cassette, in order to seal a waste item therein.

A further problem arises because some known waste storage devices comprise heavy components, making the device difficult to transport. Other known devices raise safety concerns because they are not sufficiently child-proofed, such that it may be possible for a young child to open the device and access its components and/or waste items stored therein.

SUMMARY OF THE INVENTION

The invention is set out in the claims. A waste storage device is provided including a releasable gripping assembly in the throat area arranged for actuation between a released configuration and a gripping configuration. As a result, a user can simply and easily actuate the device so that either an opening or a restriction is formed in the throat area, depending on which is required at a given point in time during operation of the device. In the released configuration, the releasable gripping assembly defines an aperture in the throat area which enables easy passage of waste therethough. Conversely, in the gripping configuration the releasable gripping assembly forms a restriction, enabling a twist to be formed in flexible tubing from a waste storage cassette which is present in the throat area, hence creating a sealed waste package including a waste item enveloped by the flexible tubing.

By providing a waste storage device including a plunger which is moveable to extend at least partially into a throat of the device, improved operation is achieved. In particular, when extending into the throat area the plunger acts to urge the passage of any previously-formed waste packages in the throat area towards a waste storage chamber. Hence a user does not have to push or otherwise manually direct waste packages into the waste storage chamber. In addition, in operation of the waste storage device with a waste storage cassette the extension of the plunger into the throat area is operable to dispense a measured amount of flexible tubing from the waste storage cassette. This prepares a well or hollow in the flexible tubing for a waste item to be placed into, hence making the device ready for subsequent use in the sealing of waste items using the flexible tubing.

As a result of the embodiments of the invention there is provided a waste storage device which provides a hygienic and easy to use means for disposal of nappy waste. Furthermore, a waste storage solution is provided which uses the minimum possible amount of plastic or other film for individually sealing waste items, in order to cut down on the environmental problems caused by nappy waste. By allowing for individual sealing of waste items whilst at the same time using a reduced amount of plastic film the invention provides an optimal balance between hygiene and environmentally friendliness.

BRIEF DESCRIPTION OF THE DRAWINGS

Embodiments of the invention will now be described, by way of example, with reference to the drawings of which.

DETAILED DESCRIPTION OF THE INVENTION

In overview a waste storage device is provided for receiving a waste storage cassette including flexible tubing for enveloping waste. The device includes a releasable gripping assembly for creating a restriction in the flexible tubing for formation of a twist in the tubing above a waste item to provide a sealed waste package. The waste storage device further includes a plunger for creation of hollows of tubing in a waste passage area of the device, into which waste items can be placed, and for urging previously-formed waste packages into a waste storage chamber below.

Also provided is a waste storage cassette for use in conjunction with a waste storage device for enveloping waste items. The cassette includes at least one formation which engages with a corresponding feature on a waste storage device for actuation of a releasable gripping assembly in the device. Optionally, the cassette includes a further formation for inter-engagement with a corresponding feature on a waste cassette rotator in a waste storage device.

Waste Storage Device

Figure 1:
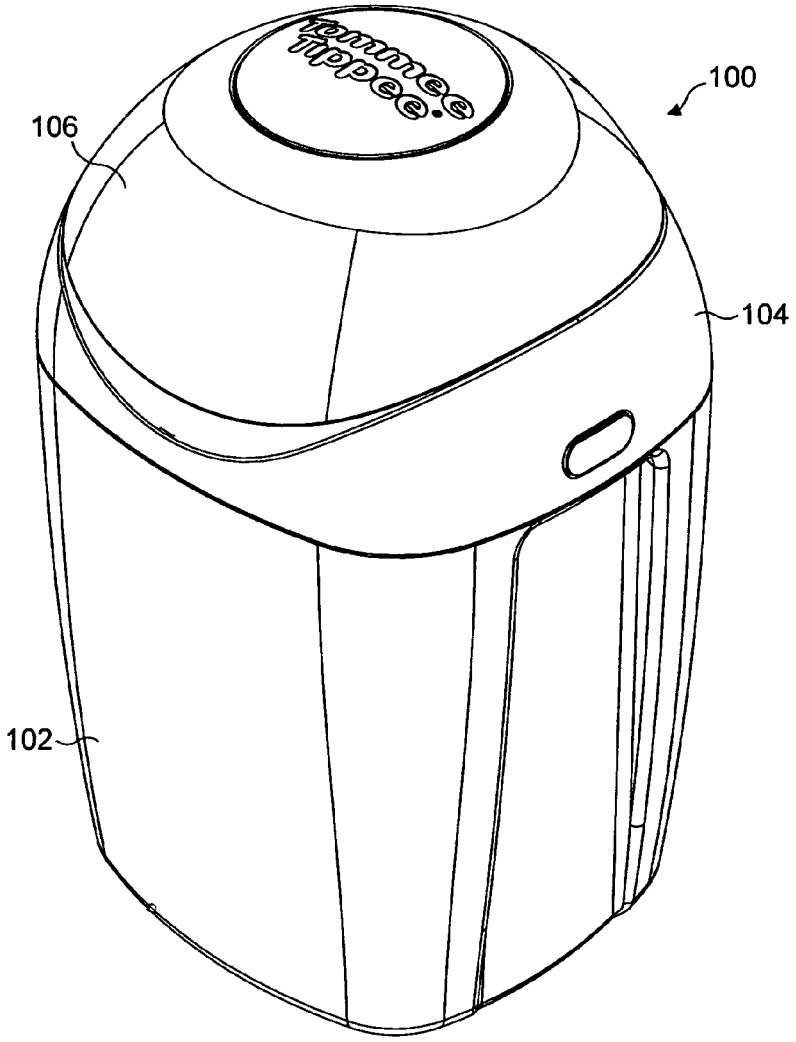
FIG. 1 is a perspective view of a waste storage device according to an embodiment of the invention.

Referring to FIG. 1 a waste storage device embodiment can be seen in more detail. The waste storage device 100 includes a waste storage chamber 102 having a removable cover 104. As described in more detail below, the removable cover 104 includes a waste cassette receiving chamber for receiving a waste storage cassette having flexible tubing for enveloping waste items and further includes means for rotating a waste storage cassette with respect to the waste cassette receiving chamber in order to create sealed waste packages in the flexible tubing. The waste storage chamber 102 and removable cover 104 may fit together by any suitable means such as a tab and cooperating recess.

Cover and Lid

The removable cover 104 includes a lid 106. The lid 106 is preferably hingedly attached to the cover 104 such that it can be actuated in order to provide user access to the inside of the cover 104.

Figure 2:
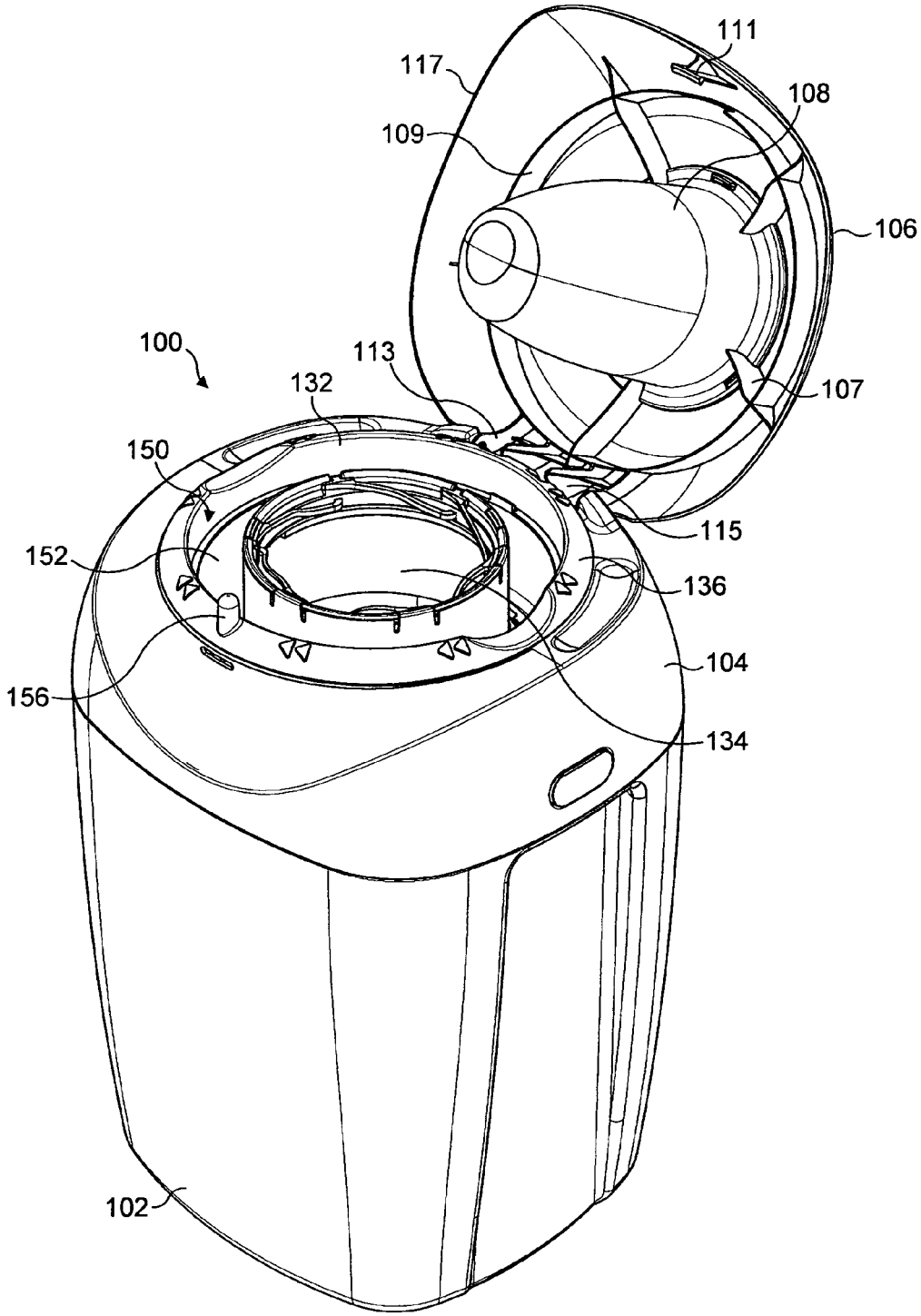
FIG. 2 is a perspective view of the waste storage device of FIG. 1, with the lid in an open configuration.

FIG. 2 shows an embodiment of the waste storage device 100 with the lid 106 in an open position. As further shown in FIGS. 3*a* to 3*e*, a plunger 108 extends downwardly from an under surface of the lid 106. The plunger is fixed relative to the lid so that movement of the lid provides movement of the plunger. Preferably the plunger 108 and lid 106 share a common central axis along the extension direction of the plunger 108. The plunger 108 may be hollow, with an open upper end covered by the lid 106 and a closed lower end. According to an embodiment of the invention, the plunger 108 is substantially circular in cross section and tapers radially inwards towards its lower end. This tapering provides clearance for insertion of the plunger 108 into a throat or other waste aperture defined within the removable cover 104 when the lid 106 is closed, as described in more detail below. The plunger 108 may be formed integral to the lid 108 or may attach to the lid 106 by any appropriate inter-engagement means such as a screw fit or snap fit. Optionally, the portion of the lid 106 which covers the upper end of the plunger 108 may be removable.

In order to support the plunger 108 and prevent the lid 106 from deforming under its weight, a plurality of support ribs 107 are provided on the under surface of the lid 106. Preferably the support ribs 107 are spaced apart from one another around the circumference of the upper end of the plunger 108 and each rib 107 extends radially outwards therefrom. Optionally, the lid 106 may include an annular flange 109 extending downwardly from the under surface of the lid 106, wherein the annular flange 109 intersects the support ribs 107 towards their distal ends in order to provide additional support.

Figure 3A:
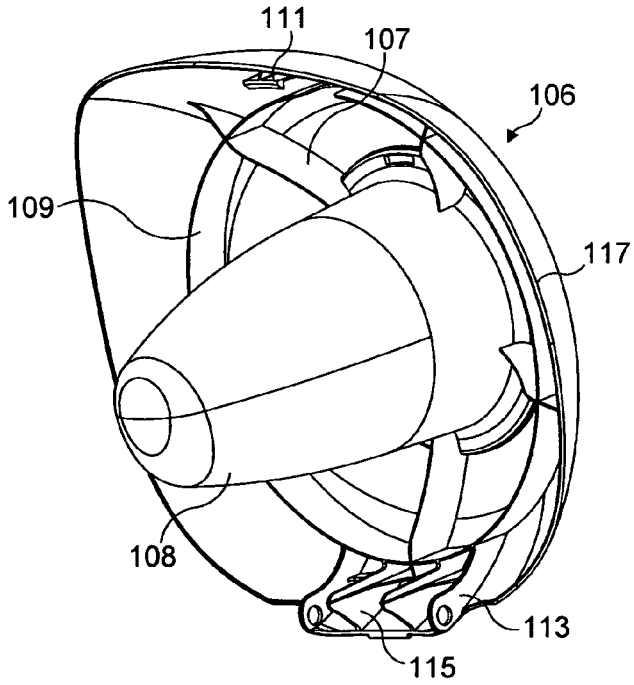
FIG. 3*a* is a perspective view from below of a waste storage device lid including a plunger according to an embodiment of the invention.
Figure 3B:
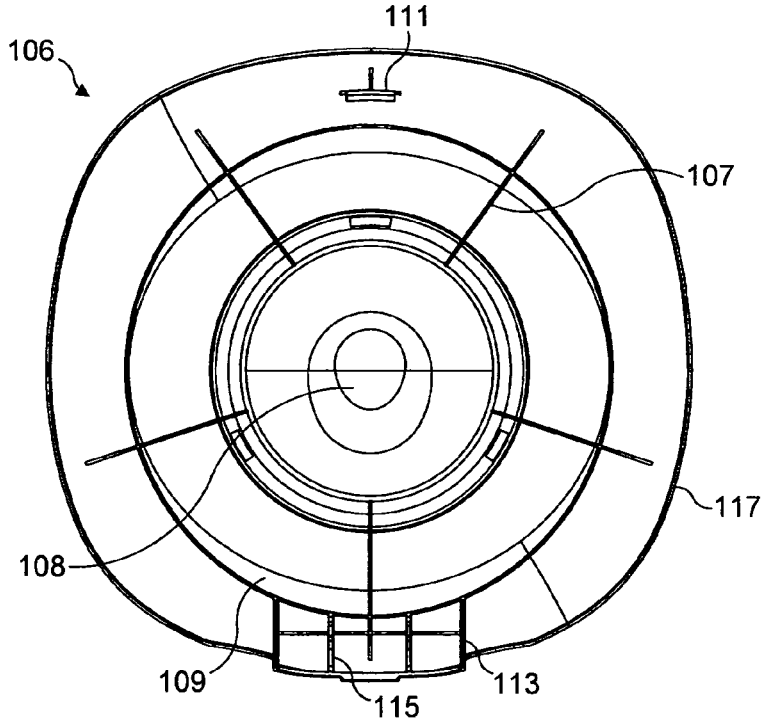
FIG. 3*b* is a bottom view of the lid in FIG. 3*a;*
Figure 3C:
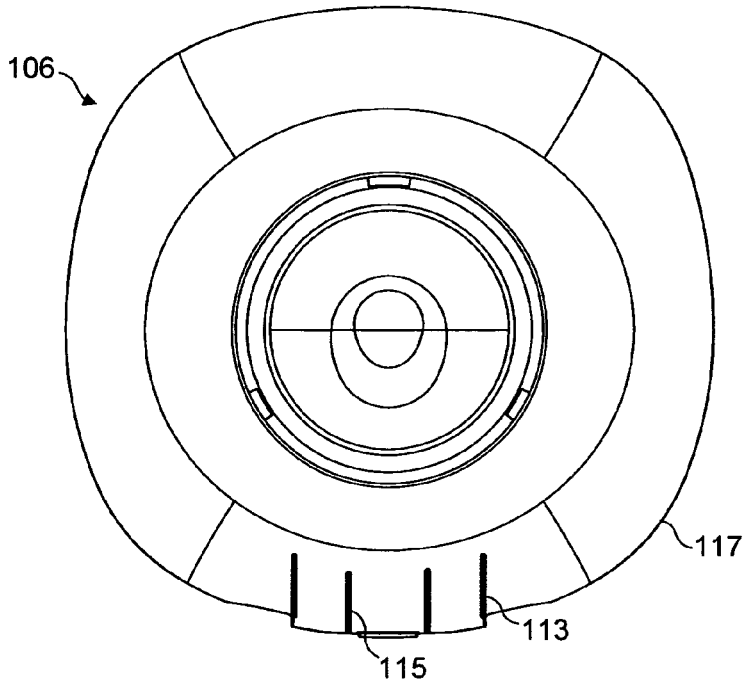
FIG. 3*c* is a top view of the lid of FIGS. 3*a* and 3*b;*
Figure 3D:
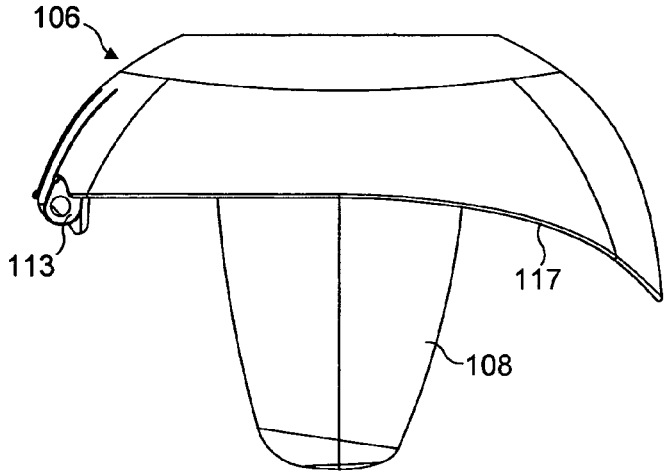
FIG. 3*d* is a side view of the lid of FIGS. 3*a* to 3*c;*
Figure 3E:
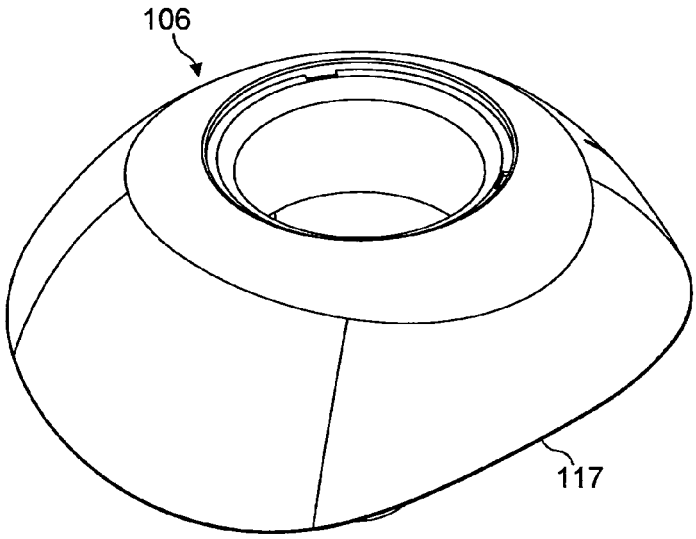
FIG. 3*e* is a top perspective view of a lid according to an embodiment of the invention, not including a plunger.
Figure 3F:
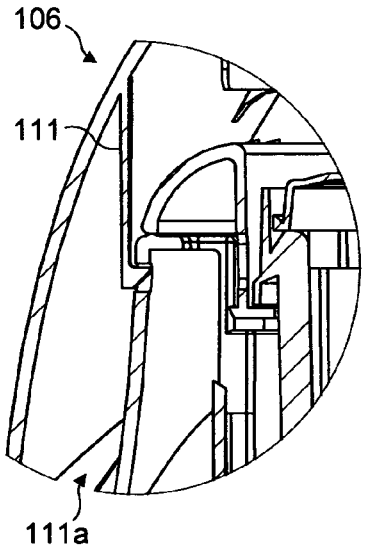
FIG. 3*f* is a cross sectional view of a front portion of the lid of FIGS. 3*a* to 3*d* when attached to a waste storage device.

A clip 111 is provided at the front of the lid 106, extending from its under surface. The clip 111 inter-engages with a cooperating slot or recess on an outer surface of the removable cover 104, in order to secure the lid 106 in a closed configuration to the cover 104. As shown most clearly in FIG. 3*f*, the clip 111 is preferably an adjustably deformable hook which hooks into a corresponding recess in the cover 104. In use, when the lid 106 is closed and the cover 104 is attached to a waste storage chamber 102, there is an area of clearance 111*a* between an inner surface of a lower front portion of the lid 106 and an outer surface of the main body of the cover 104. This area of clearance 111*a* enables access for a user to manually take hold of the lower front portion of the lid 106. Preferably, the lower front portion of the lid 106 is formed from a sufficiently rigid material so that manual user actuation of the lower front portion in order to rotate the lid 106 about its hinged attachment to the cover 104 will be sufficient to deform the clip 111 to release it from its locked position. Similarly, rotating the lid 106 to a closed position via its rigid lower front portion should be sufficient to click the clip 111 back into a locked position.

In an alternative embodiment the lid 106 can lock to the main body of the cover 104 via any appropriate means. For example, the lid 106 and cover 104 may feature cooperating tab and recess means for engaging with one another, whereby the lid 106 can be unlocked by pressing a button or lever which releases the tab. Because the waste storage device will be used by busy parents of young children, it is advantageous that the lid 106 locks to the cover 104 in a manner which is straightforward to release for the user, but is also sufficiently difficult for young children to open the lid. Preferably the lid 106 opens away from the user, in order to fully present the components inside the cover 104 for use. The lid 106 may be arranged to rotate up to 270 degrees about its hinged attachment to the cover 104. Alternatively, the lid 106 may be arranged to open only partially, for example stopping when the upper surface of the lid is at a 45 degree angle with the outer wall of the waste storage device 100.

At its back end the lid 106 has a further plurality of ribs on its under surface, preferably extending parallel to one another and outwardly from an outer surface of the annular flange 109. According to an embodiment, the further plurality of ribs includes two hinge ribs 113 which flank two engagement ribs 115. The hinge ribs 113 each include a hole, recess or protrusion towards its distal end, close to the outer edge 117 of the lid 106, for cooperation with a corresponding protrusion, hole or recess on the cover 104, to form a hinged attachment between the lid 106 and cover 104. The engagement ribs 115 taper into a rounded point or otherwise protrude so as, in use, to cooperate with a corresponding recess on a waste cassette rotator 136 housed within the cover 104, as described in more detail below.

Waste Cassette Receiving Chamber

Figure 4A:
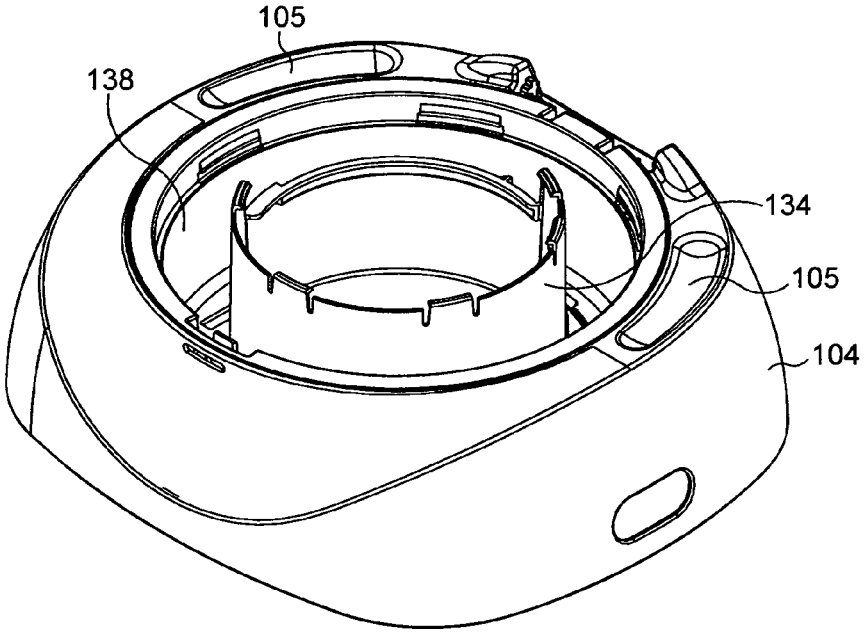
FIG. 4*a* is a top perspective view of a waste storage device cover according to an embodiment of the invention.
Figure 4B:
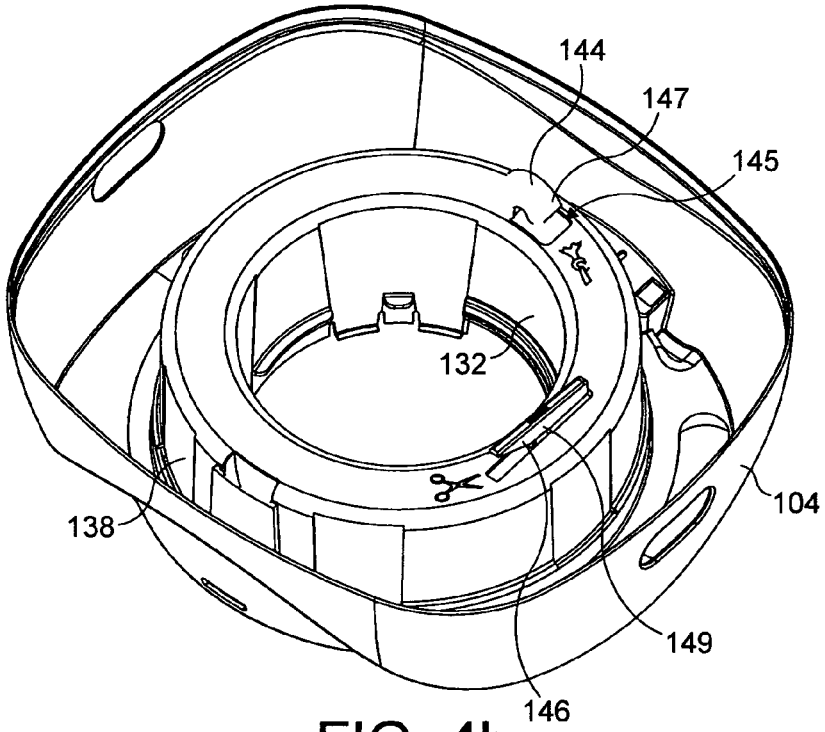
FIG. 4*b* is a bottom perspective view of the waste storage device cover of FIG. 4*a;*
Figure 4C:
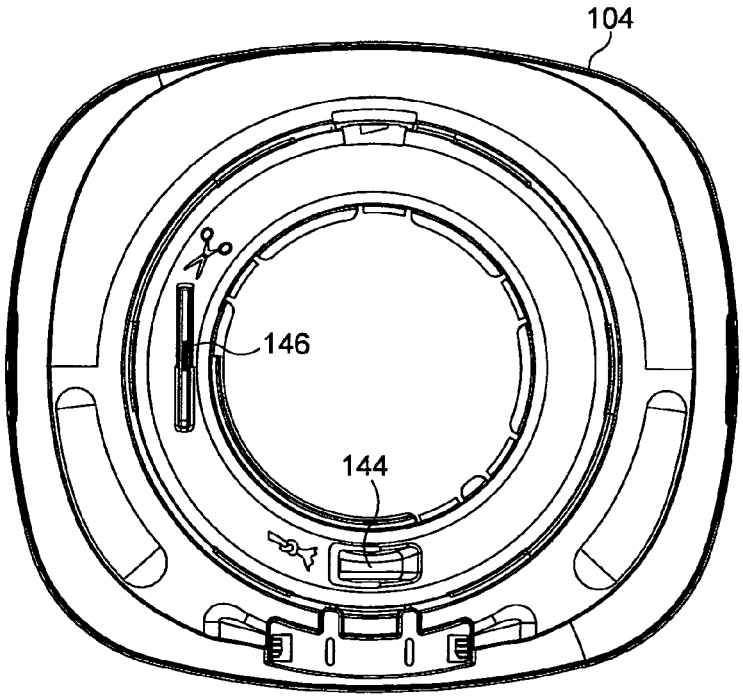
FIG. 4*c* is a bottom view of the waste storage device cover of FIGS. 4*a* and 4*b;*
Figure 4D:
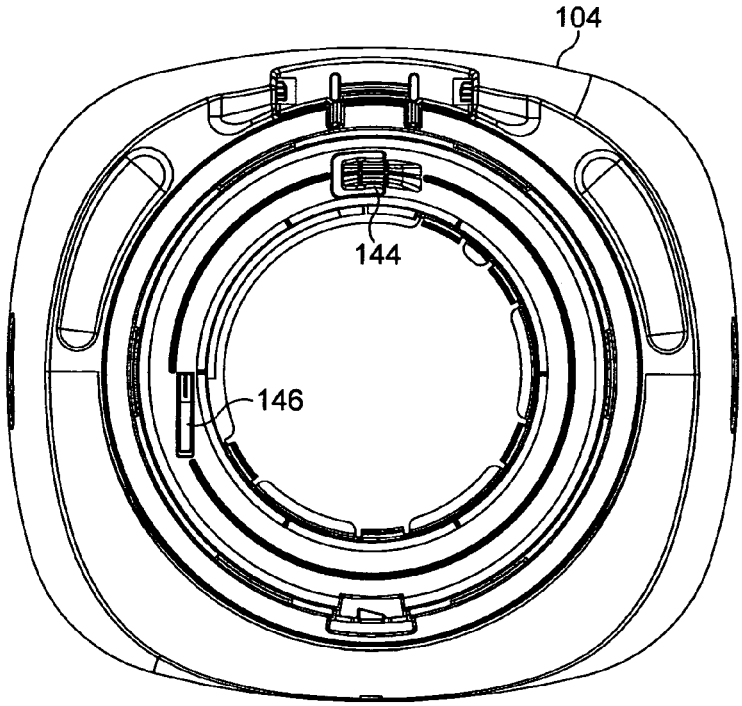
FIG. 4*d* is a top view of the waste storage device cover of FIGS. 4*a* to 4*c;*
Figure 5:
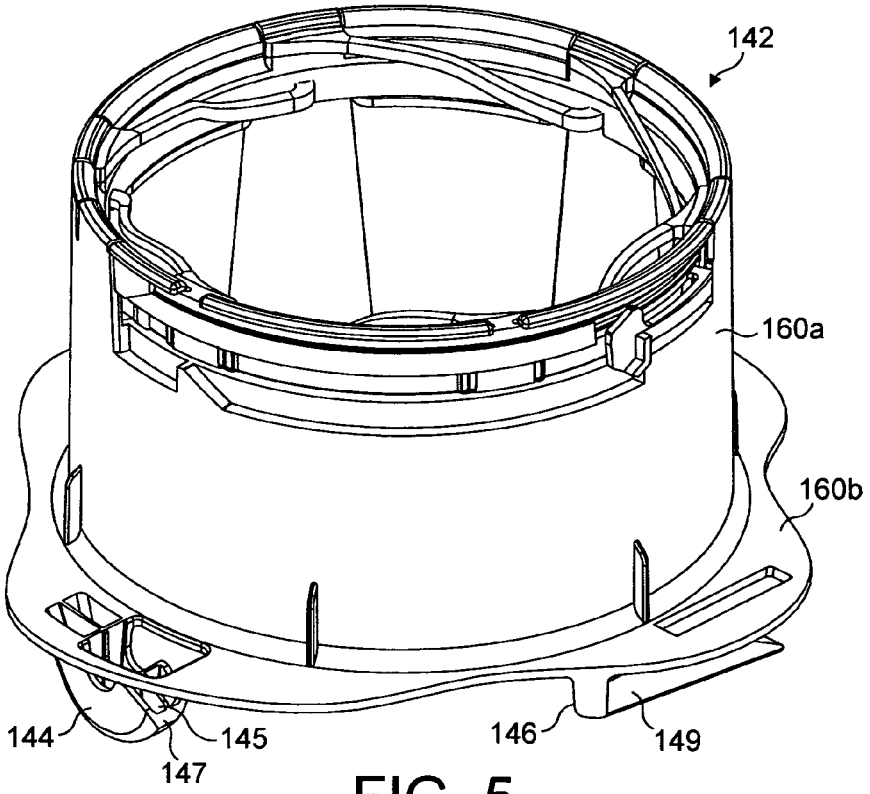
FIG. 5 is a perspective view of an insert for the waste storage device cover of FIGS. 4*a* to 4*c;*

The removable cover 104 can be further understood with respect to FIGS. 4*a* to 5. Within the cover 104 of the waste storage container there is provided a waste cassette receiving chamber 132 configured for receiving a waste storage cassette. The waste cassette receiving chamber 132 comprises an annular space defined between cylindrical inner 134 and outer 138 walls, each of which extends below an under surface of the cover 104. The inner wall 134 of the waste cassette receiving chamber 132 defines internally a passage or throat through which waste can be passed into the waste storage chamber 102 as described in more detail below.

Preferably the cover 104 is domed and has walls of sufficient depth that the waste cassette receiving chamber 132 is located at least partially in the space within the cover 104, and does not extend significantly below the walls of the cover 104. This ensures that when the cover 104 is attached to a waste storage chamber 102, the waste cassette receiving chamber 132 and waste cassette 172 do not unnecessarily occupy space in the waste storage chamber 102. Therefore the maximum possible number of waste packages can be effectively stored in the waste storage chamber 102.

On an upper surface of the cover 104, radially outward of the outer wall 138 of the waste cassette receiving chamber 132, there are provided first and second gripping portions 105. The gripping portions comprise of preferably curved indentations in the upper surface of the cover 104, located one either side of the hinged attachment between the lid 106 and the cover. In use, the user can hold one or other gripping portion 105 with one hand whilst rotating a cassette in the waste cassette receiving chamber 132 as described further below. The gripping portions 105 are preferably designed to provide good ergonomic fit for the user's hand and to enable the user the keep the waste storage device 100 steady and stable during manual operation of the device 100.

According to one embodiment, the inner 134 and outer 138 walls of the waste cassette receiving chamber 132 are moulded as a single piece, giving the chamber a U shaped cross section throughout. Alternatively, and as best shown in FIGS. 4*b* and 5, only the outer wall 138 of the waste cassette chamber 132 is formed integral to and depends downwardly from the underside of the cover 104 and preferably has an annular flange at its base, wherein the flange 140 extends substantially perpendicularly to and inwardly of the outer wall 138. A separate crown 142 is insertable within the outer wall 138, wherein the crown 142 defines the inner wall 134 of the waste cassette receiving chamber 132 and has a circumference substantially equal to the innermost circumference of the flange 140.

As shown in FIG. 5, the crown 142 includes a cylindrical wall 160*a* forming the inner wall 134 and a base annular flange 160*b* extending outwardly therefrom. The crown 142 can be snapped or otherwise fitted to the outer wall 138 or to the annular flange at the base outer wall 138 of the by means of any appropriate cooperating engagement means for example clips or ridges on the outer surface of the cylindrical wall 160*a* which are insertable into corresponding slots in the cover 104. Preferably, the crown also includes a gripping assembly at its upper end, as discussed further below.

Hook and Cutter

As also shown in FIGS. 4*a* to 5, the underside of the waste cassette receiving chamber 132 includes a hook 144 and cutter 146 provided for example on the underside of the flange 160*b* of the crown 142. The hook 144 is preferably substantially C-shaped, extending downwardly from the flange 160*b* and curving upwardly back towards the flange 160*b*, with a small gap 145 defined between the flange 160*b* and the distal end 147 of the hook 144. As will be understood further from the description of operation below, when a waste cassette is placed in the waste cassette receiving chamber 132 the user pulls a substantially cylindrical length of tubing from the top of the cassette and ties the tubing into a knot near its upper edge. This knotted tubing forms the base of a waste package into which a nappy or other waste item(s) can be placed. After a waste item has been placed in the tubing, the top of the waste package will be formed by making a twist in the tubing as described below. This twist will then form the base of a subsequent waste package.

Optionally, before a waste item is placed in the waste package the user pushes the knotted base downwards, through the open gripping assembly, and at least partially into the waste passage below. This ensures that sufficient tubing will be available to cover the waste item and to enable the tubing above the waste item to be effectively sealed.

In order to hold a length of tubing containing one or more individually wrapped waste packages in place, and to prevent unraveling of the twist formed above any individual waste package, particularly the first waste package formed within a length of tubing, the knot in the upper edge of the length of tubing is inserted into the hook 144 on the underside of the waste cassette receiving chamber 132. The hook 144 holds the knot in place so that after several uses of a waste storage cassette in the waste storage device 100 a chain of individually wrapped waste packages will extend from the hook 144, down into the waste storage chamber 102 and back up towards the waste storage cassette from which the tubing extends.

As described below, the cutter 146 can be used to cut flexible tubing from a waste storage cassette. The cutter preferably includes a tapered ramp 149 extending from the underside of the flange 160*b* and a blade or other cutting means provided substantially coplanar with the flange 160*b* and protected from below by the ramp 149. The tapered portion of the ramp 149 acts as a guide to direct flexible tubing or other material towards the protected cutting means for severance of the material.

In use, when a user wishes to remove the stored waste packages from the waste storage chamber 102 of a waste storage device 100, the tubing which envelops the waste packages must be severed from the unused tubing extending from the cassette 172. In order to do this, the cover 104 is removed from the waste storage chamber 102. According to a preferred embodiment, the cover 104 can be turned on its side and can rest in a stable position in the mouth of the waste storage chamber 102, to enable the user to more easily cut the flexible tubing without having to hold the cover 104 at the time. The tubing between the top of the cassette and the tubing enveloping the most recently formed waste package is then sliced or otherwise severed using the cutter 146. The user can then unhook the knotted end of the chain of waste packages from the hook 144 and dispose of the waste packages thereafter.

Waste Cassette Rotator

Figure 6:
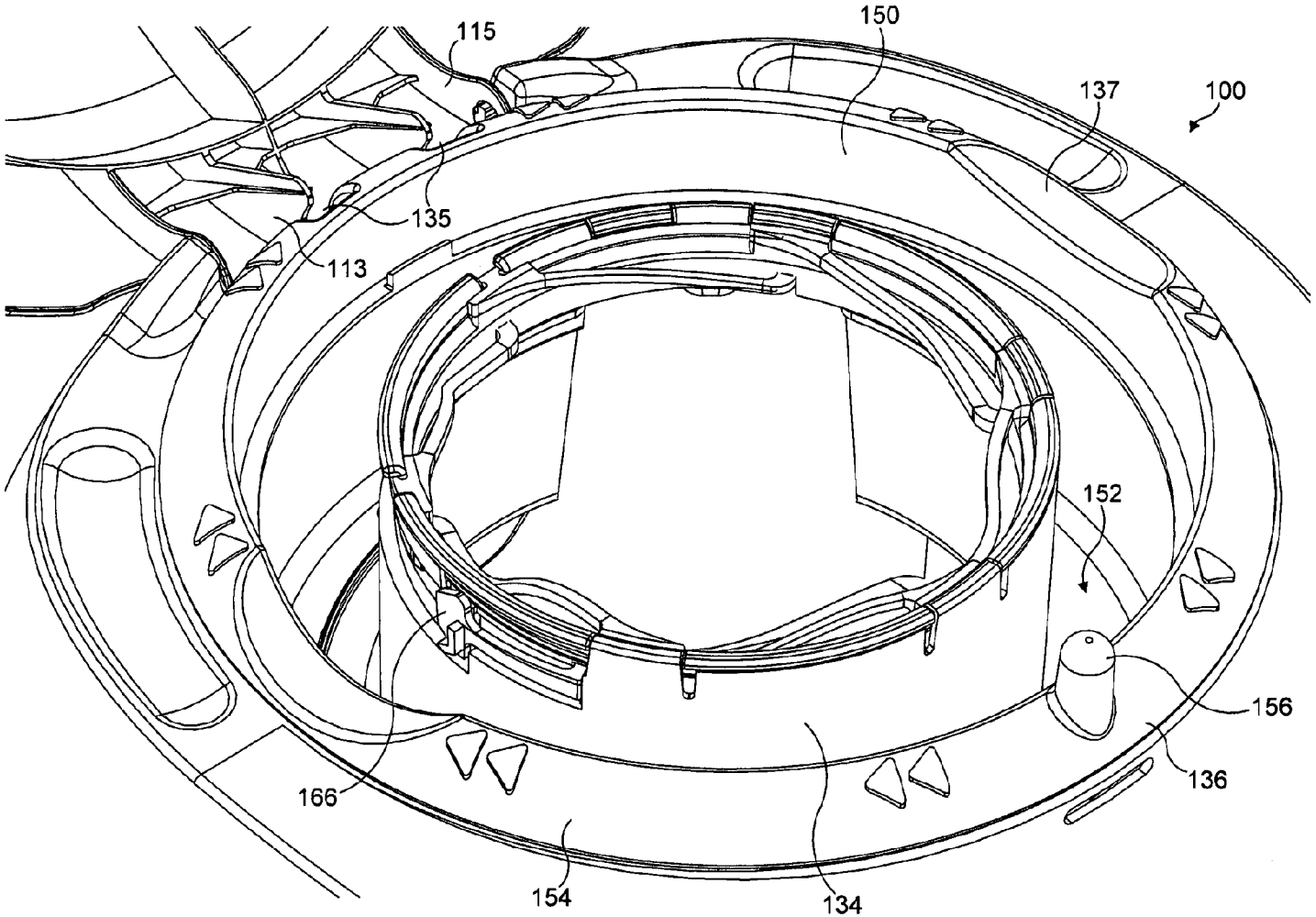
FIG. 6 is a magnified view of the waste cassette receiving chamber of the waste storage device of FIG. 1 with the lid open.

Referring to FIGS. 2 and 6, a waste cassette rotator 136 is provided in the waste cassette receiving chamber 132. Preferably the waste cassette rotator 136 comprises a cylindrical wall 150 which extends substantially concentric with the walls of the cassette receiving chamber 132, a rim or annular base 152 extending substantially perpendicular to the wall 150 and terminating radially outward of the inner wall 134 of the waste cassette receiving chamber 132, and an annular rim 154 which extends radially outwards from the top of the wall 150 so that it rests on an upper surface of the cover 104. As shown, the annular rim 154 includes two recesses 135 in its circumference which cooperate with the engagement ribs 113 on the under surface of the lid 106. In particular the recesses 135 are arranged to house the engagement ribs 113 so that, in use, in order for the lid 106 to fully close and lock to the cover 104, the waste cassette rotator 136 must be aligned for insertion of the engagement ribs 113 into the recesses 135. This alignment provides a starting position for user actuation of the waste cassette rotator 136 when the waste storage device 100 is next used.

Figure 7A:
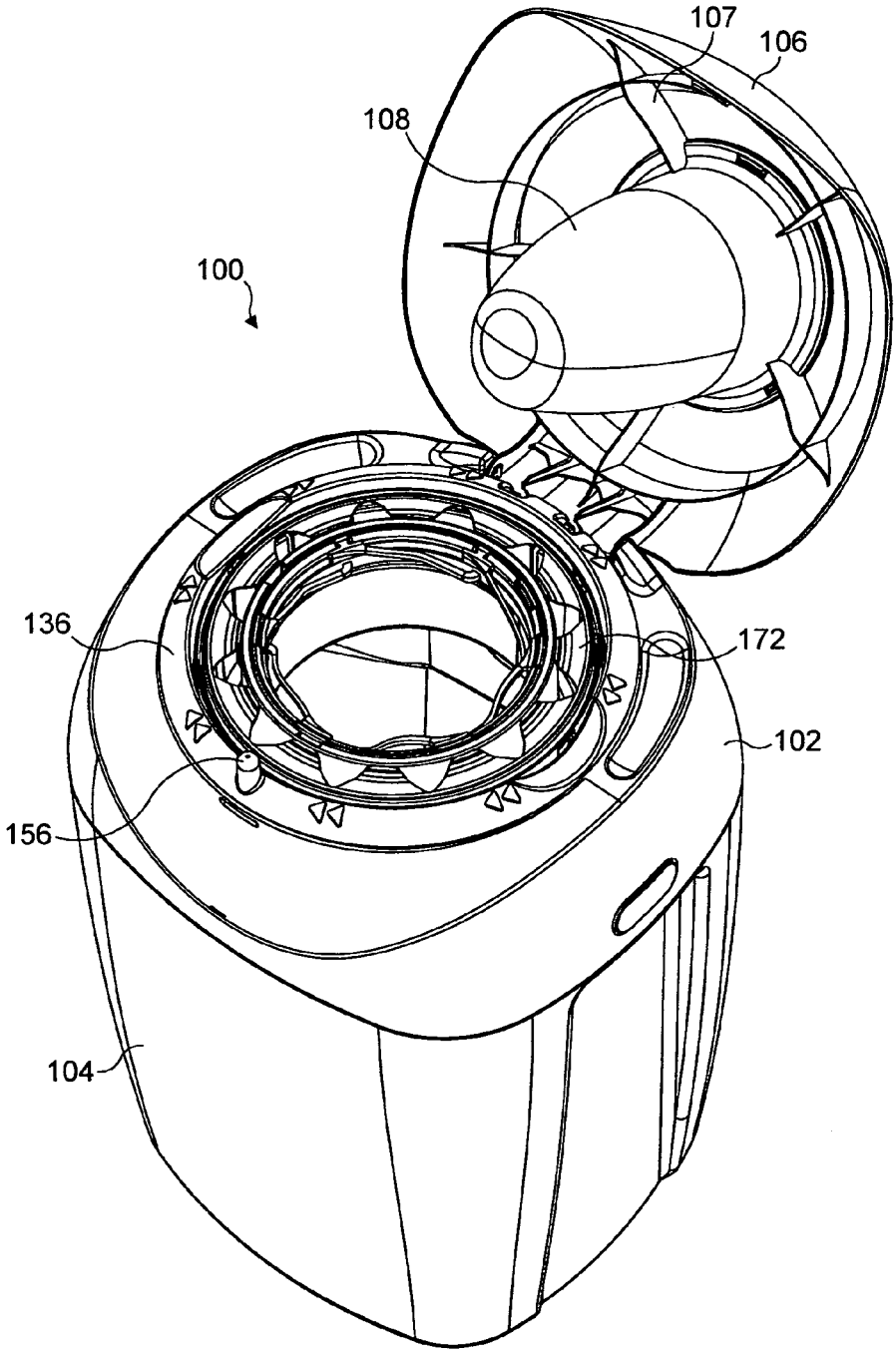
FIG. 7*a* is a perspective view of the waste storage device of FIG. 1, with the lid in an open configuration and with a waste storage cassette housed therein.
Figure 7B:
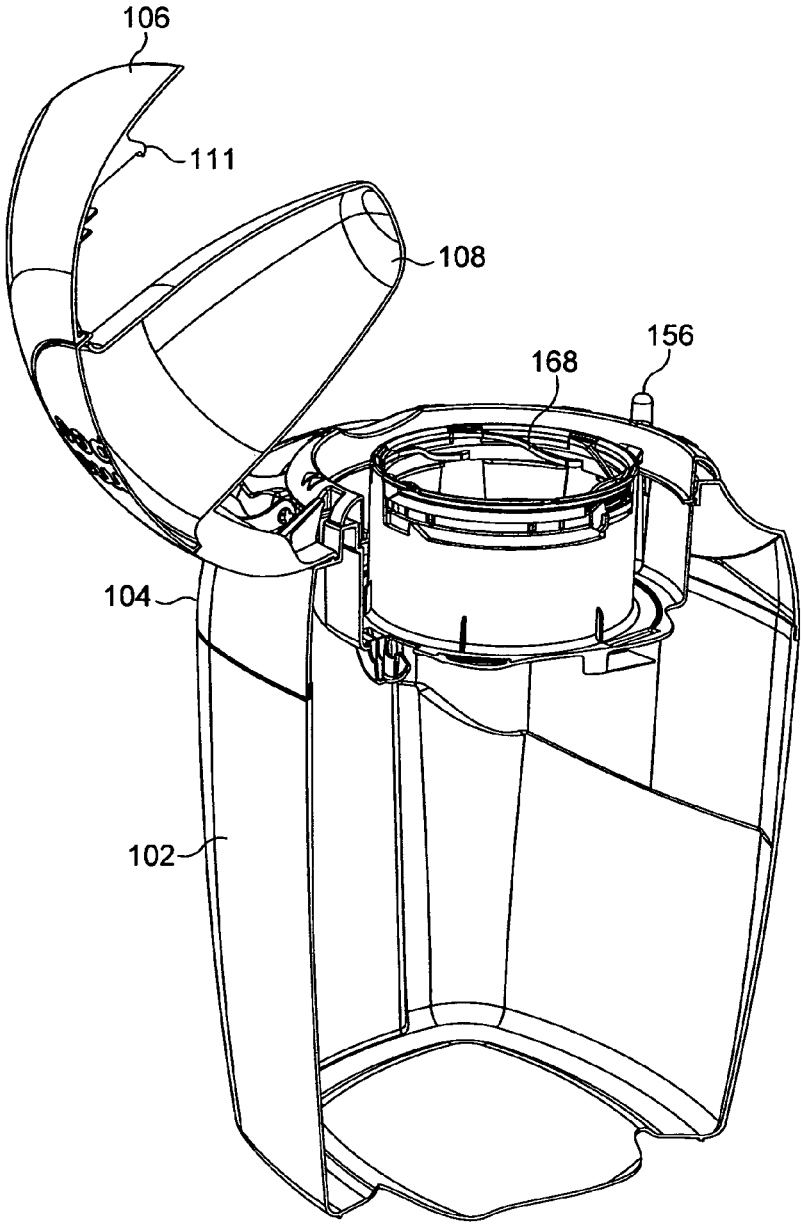
FIG. 7*b* is a cross sectional view of the waste storage device of FIG. 7*a*, without a waste storage cassette housed therein.
Figure 8A:
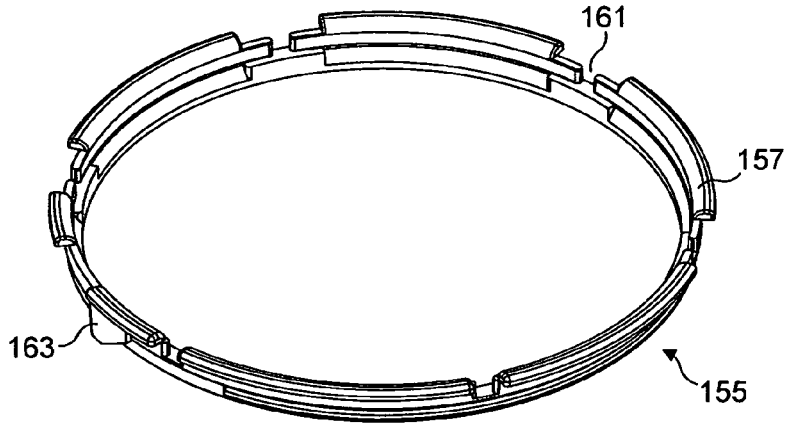
FIG. 8*a* is a perspective view of a crown funnel according to an embodiment of the invention.
Figure 8B:
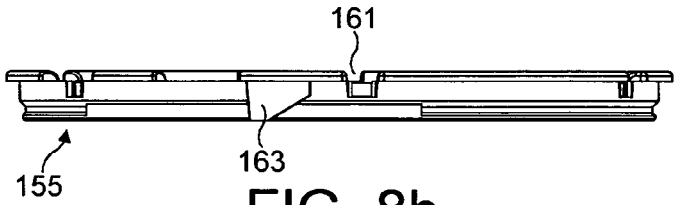
FIG. 8*b* is a side view of the crown funnel of FIG. 8*a;*
Figure 8C:
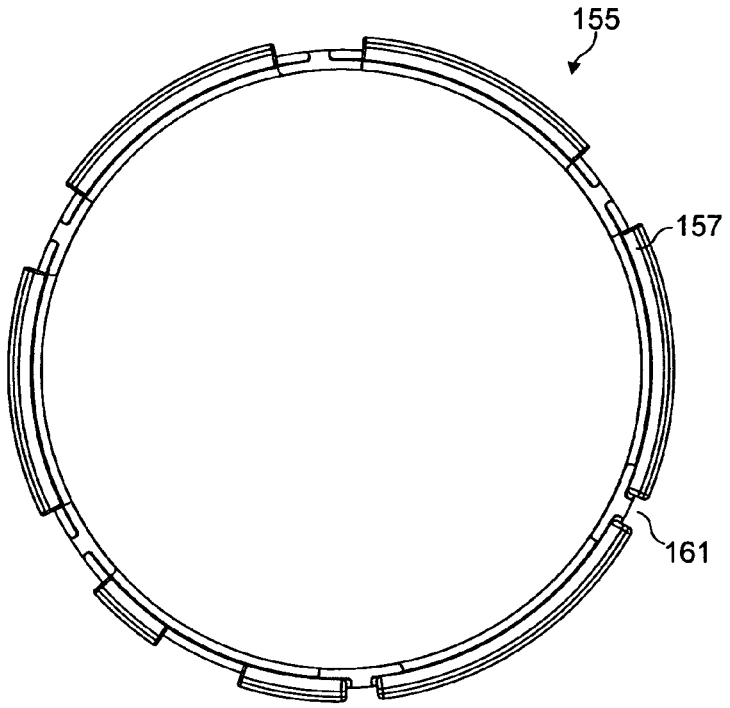
FIG. 8*c* is a top view of the crown funnel of FIGS. 8*a* and 8*b;*
Figure 8D:
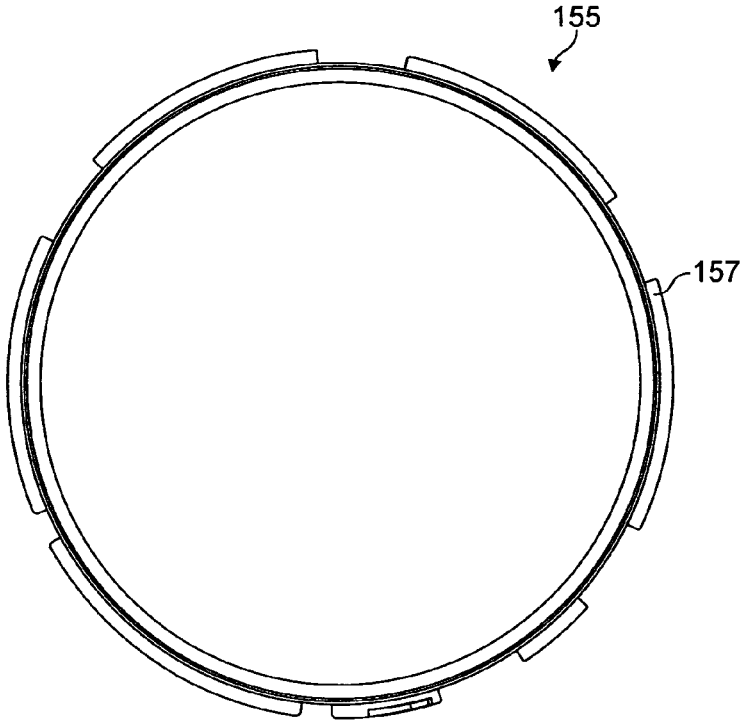
FIG. 8*d* is a bottom view of the crown funnel of FIGS. 8*a* to 8*c;*
Figure 9A:
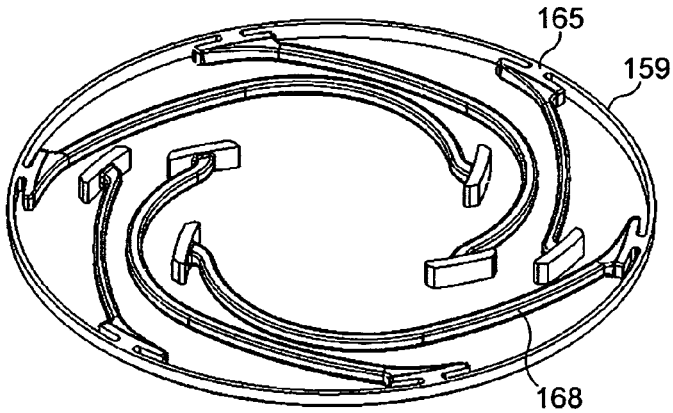
FIG. 9*a* is a perspective view of a gripping ring according to an embodiment of the invention.
Figure 9B:
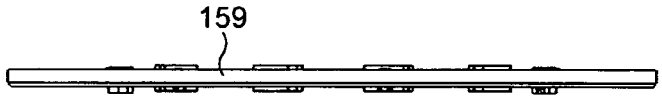
FIG. 9*b* is a side view of the gripping ring of FIG. 9*a;*
Figure 9C:
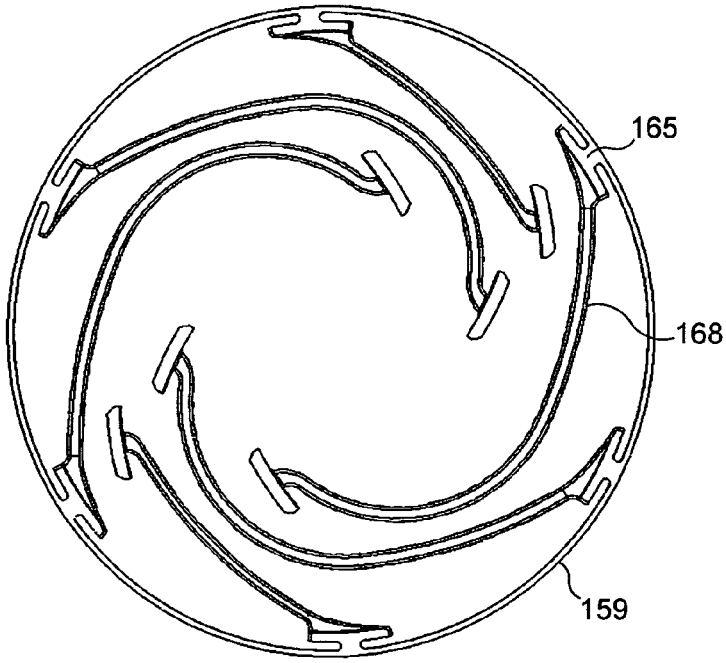
FIG. 9*c* is a top view of the gripping ring of FIGS. 9*a* and 9*b;*
Figure 9D:
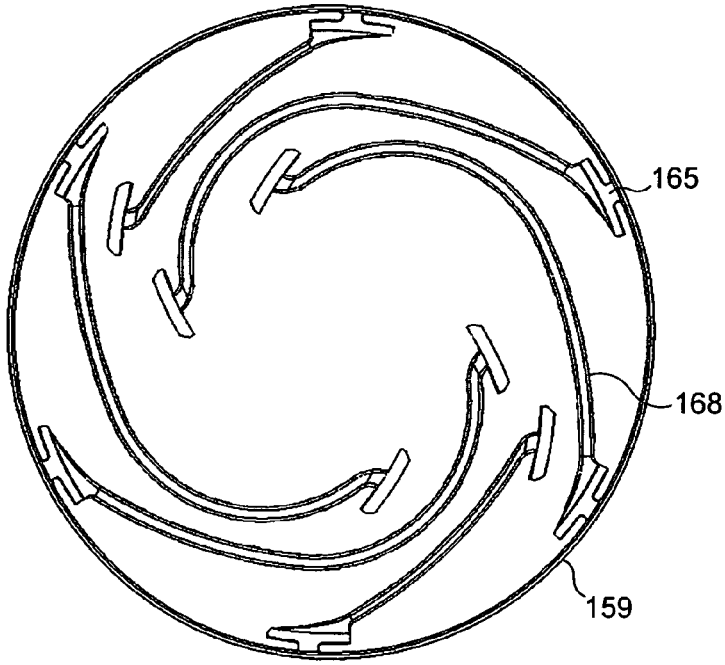
FIG. 9*d* is a bottom view of the gripping ring of FIGS. 9*a* to 9*c;*
Figure 10A:
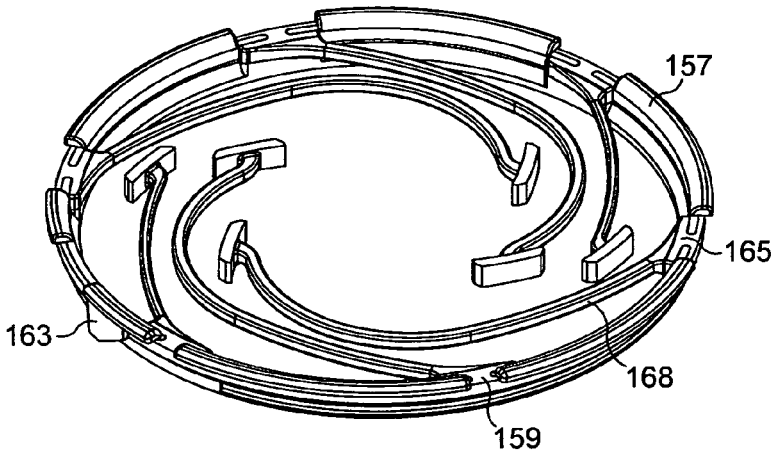
FIG. 10*a* is a perspective view of the crown funnel of FIGS. 8*a* to 8*d* in connection with the gripping ring of FIGS. 9*a* to 9*d;*
Figure 10B:
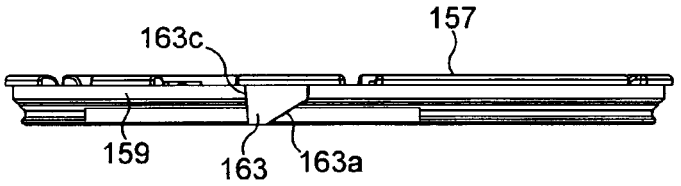
FIG. 10*b* is a side view of the crown funnel of FIGS. 8*a* to 8*d* in connection with the gripping ring of FIGS. 9*a* to 9*d;*
Figure 10C:
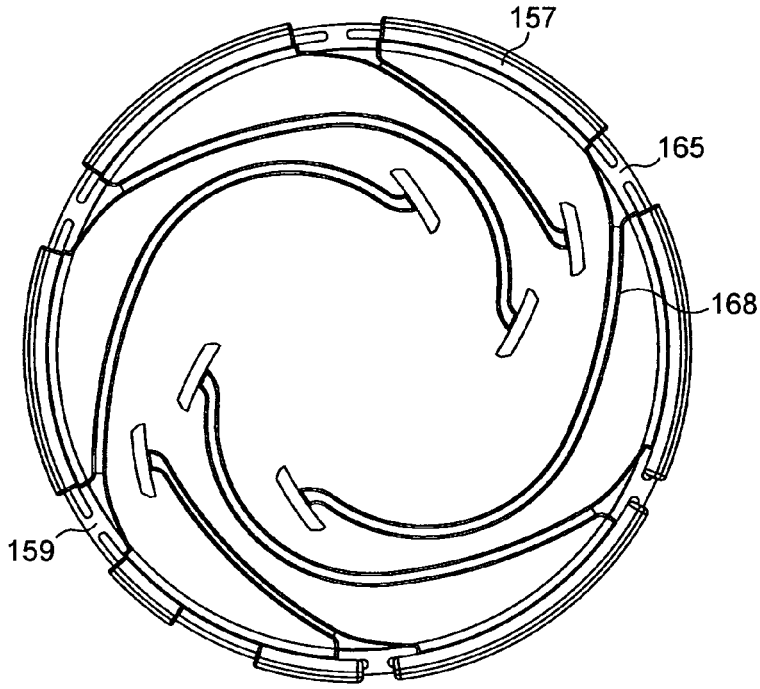
FIG. 10*c* is a top view of the crown funnel of FIGS. 8*a* to 8*d* in connection with the gripping ring of FIGS. 9*a* to 9*d;*
Figure 10D:
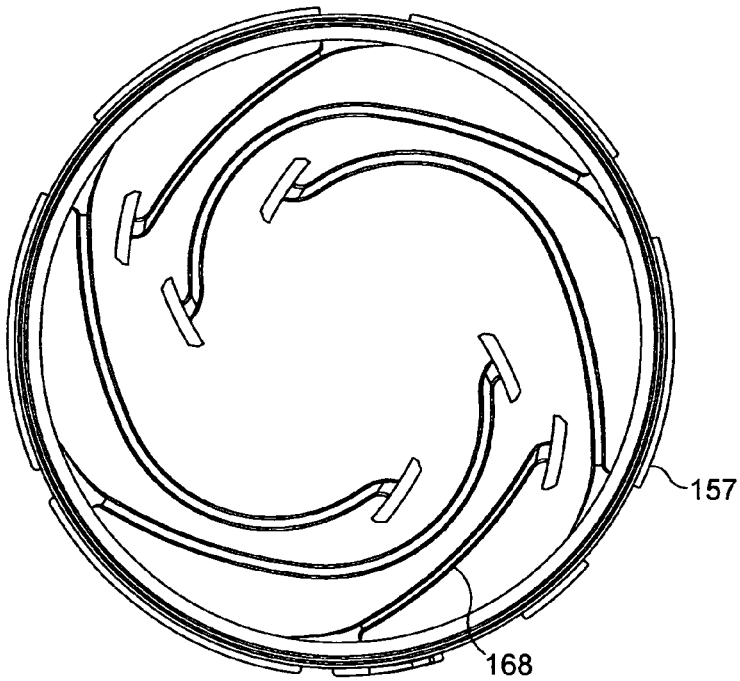
FIG. 10*d* is a bottom view of the crown funnel of FIGS. 8*a* to 8*d* in connection with the gripping ring of FIGS. 9*a* to 9*d;*
Figure 11A:
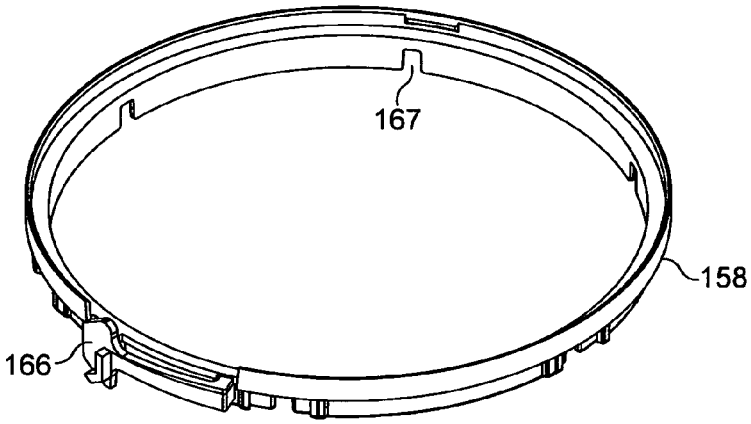
FIG. 11*a* is a perspective view of an iris ring according to an embodiment of the invention.
Figure 11B:
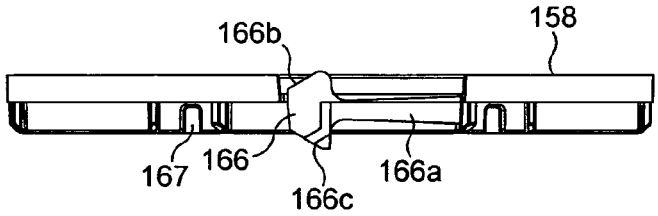
FIG. 11*b* is a side view of the iris ring of FIG. 11*a;*
Figure 11C:
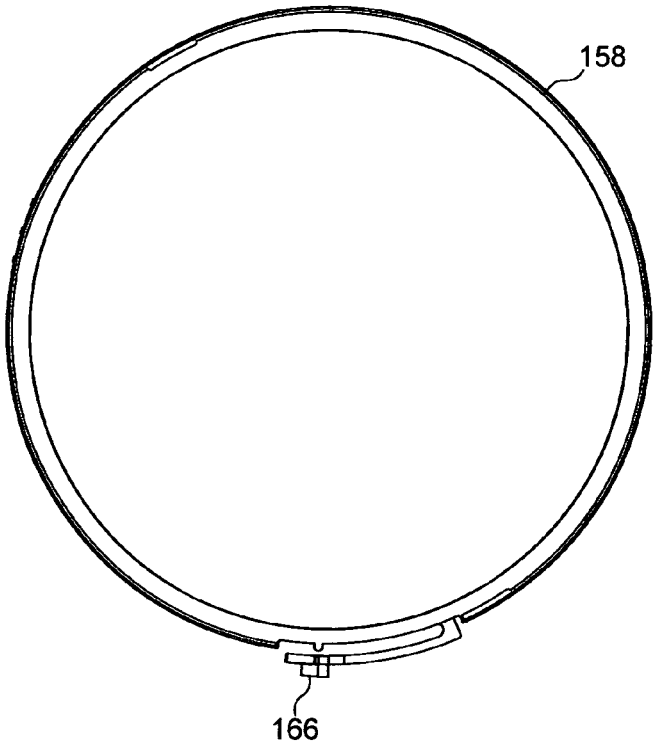
FIG. 11*c* is a top view of the iris ring of FIGS. 11*a* and 11*b;*
Figure 11D:
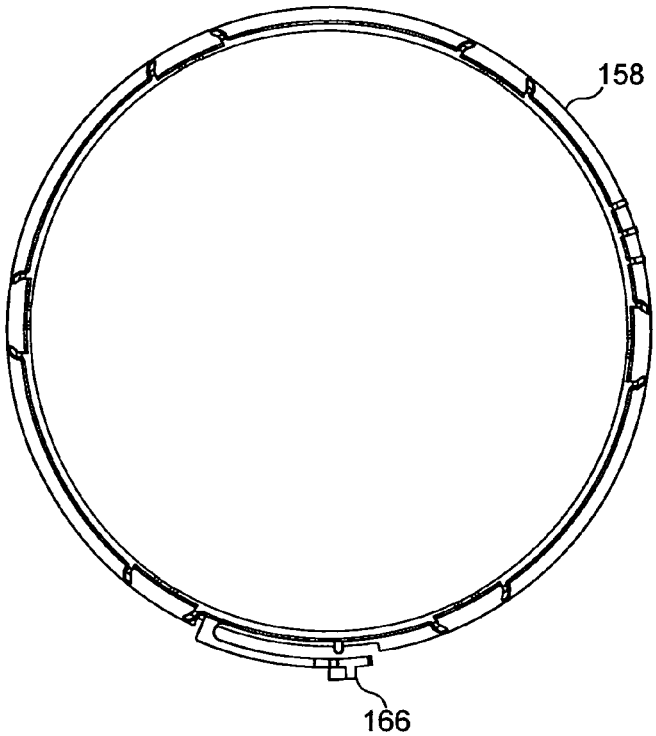
FIG. 11*d* is a bottom view of the iris ring of FIGS. 11*a* to 11*c;*

According to a preferred embodiment the waste cassette rotator 136 further includes a handle 156 on its annular rim 154 which can be actuated by a user in order to rotate the waste cassette rotator 136 about its central axis in the waste cassette receiving chamber 132. The waste cassette rotator 136 is arranged for supporting and housing a waste storage cassette 172 as shown in FIGS. 7*a* and 7*b* and for rotating said cassette 172 with respect to the waste cassette receiving chamber 132 as described in more detail below.

The waste cassette rotator 136 further includes two crescent shaped hollows 137 along the inner circumference of the annular rim 154. The hollows 137 are preferably arranged diametrically opposite one another on the waste cassette rotator 136 and, in use, provide a space for a user to manually grip a cassette 172 housed in the rotator 136 for removal of the cassette 172 therefrom.

Gripping Assembly

Also provided in the waste storage device shown FIGS. 2, 5 and 6 is a gripping assembly. Shown in more detail in FIGS. 8*a* to 11*d*, the gripping assembly comprises a crown funnel 155, an iris ring 158 and gripping ring 159 including a plurality of gripping bands 168. Each of the crown funnel 155, the iris ring 158 and gripping ring 159 is substantially circular in cross-section.

The circumference of the crown funnel 155 is substantially equal to the inner circumference of the inner wall 134 of the waste cassette receiving chamber 132. In use in a waste storage device, the crown funnel 155 is arranged to be supported by, or optionally affixed to, the inner wall 134 of the waste cassette receiving chamber 132. Preferably, the inner wall 134 includes a ledge on which the crown funnel rests or, alternatively, an annular recess on its inner surface into which the crown funnel 155 inserts.

At its upper edge the crown funnel 155 terminates in a plurality of curved lips 157, separated by cut-outs 161. The curved lips 157 provide a smooth, low friction surface for passage of flexible tubing there over. In addition, at a point on its outer surface, towards its lower edge, the crown funnel 155 includes a protrusion having a chamfered edge 163. This chamfered edge 163 interacts with a drive peg 166 on the iris ring 158 as described in more detail below. In addition, the curved lips 157 prevent contact of the flexible tubing with the gripping bands 168 of the gripping ring 159 when the gripping assembly is in its open configuration as described below, in order to minimise risk of the bands 168 snagging the tubing.

The gripping ring 159 and gripping bands 168 can be seen in more detail in FIGS. 9*a* to 9*d*. The gripping ring comprises an unbroken annulus with a plurality of T-shaped projections 165 extending inwardly from its inner surface. The T-shaped projections 165 are preferably equally spaced from one another about the inner circumference of the gripping ring 159. An individual gripping band 168 extends from each of the T-shaped projections 165. Preferably each gripping band 168 terminates at its distal end in a T-shaped portion to enable connection of the band 168 to the iris ring 158 as described in more detail below. Each of the gripping bands is extendable, as described below.

As can be seen from the Figs., preferably the gripping bands are not all the same length as one another when unextended. According to a preferred embodiment, the gripping ring 159 includes two short, equal-sized bands and 4 longer equal-sized bands. In use as part of a gripping assembly in a waste storage device as described below, the short bands will be stretched to a greater extent than the longer bands. As a result, when the iris ring 158 is rotated as described below, it will be the short bands which will provide the majority of the rotational force for returning the drive peg 166 from its rotated position back to its start position.

FIGS. 10*a* to 10*d* show the crown funnel 155 and gripping ring 159 in connection with one another. As shown in the Figs., the annulus of the gripping ring 159 fits to the outer surface of the crown funnel 155, inward of and providing clearance for the chamfered edge 163, and the T-shaped projections 165 from the gripping ring 159 extend through the cut-outs 161 in the crown funnel 155. The curved lips 157 of the crown funnel curve outwardly of the gripping ring 159 and are arranged to prevent the gripping ring 159 from moving about the outer surface of the crown funnel 155 once the two have been connected together. Preferably, the crown funnel 155 and gripping ring 159 are connected during manufacture wherein the gripping ring 159 is inserted over the upper edge of the crown funnel 155 and the curved lips 157 are connected to the upper edge thereafter. Alternatively, the crown funnel 155 and gripping ring 159 can be manufactured as a single piece by known co-moulding or over-moulding techniques.

The iris ring 158 is shown in FIGS. 11*a* to 11*d*. The iris ring 158 defines a circular aperture having a circumference which is substantially equal to the outer circumference of the crown funnel 155, so that the crown funnel 155 (including the gripping ring 159) can, in use, be inserted at least partially into the iris ring 158. When inserted together, the crown funnel 155 and iris ring 158 are coaxial, enabling free rotation of the iris ring 158 with respect to the crown funnel 155 as described below. The iris ring 158 includes a drive peg 166 on its outer edge which interacts both with a drive feature 180 on a waste storage cassette 172 and with the chamfered edge 163 on the crown funnel 155.

In addition, the iris ring 158 includes a plurality of substantially rectangular indentations 167 along its lower edge. For use in a gripping assembly, the plurality of gripping bands 168 extending from the gripping ring 159 insert through these indentations 167. The T-shaped portions at the distal ends of the bands 168 provide a barrier to ensure that the gripping bands cannot be pulled out of the indentations, hence providing a secure connection to the iris ring 158. As will be appreciated from FIG. 6 and further from the description below, when the gripping bands 168 are inserted into the iris ring 158 they are configured so as to substantially occupy the outer region of the circular aperture defined by the iris ring 158, and not to extend across its centre. In this arrangement the iris ring 158, and hence the gripping assembly, is in its open or released configuration.

As is shown for example in FIGS. 2 and 6, when the gripping assembly is fully assembled the crown funnel 155, gripping ring 159 and iris ring 158 are connected to one another and the gripping bands 168 which extend from the gripping ring 159 are secured to the iris ring 158 in an open configuration as described above. The gripping assembly then inserts into the waste cassette receiving chamber 132 of a waste storage device 100, preferably secured by inter-engagement between the inner wall 134 of the waste cassette receiving chamber 132 and the crown funnel 155 as described above. The gripping assembly can then be put to use in the waste storage device 100 as described in more detail below.

Waste Storage Cassette

FIGS. 12*a* to 12*d* show a waste storage cassette 172 for use within the waste storage device. The waste storage cassette 172 has a housing which comprises annular inner 174 and outer 176 walls, connected at their lower end by a base to form a substantially U shaped cross section throughout. In the cassette housing between the inner 174 and outer 176 walls of the cassette 172 flexible tubing can be housed. Preferably the flexible tubing is layered or pleated within the cassette housing in order to optimise use of the space therein and provide as much tubing in the cassette 172 as possible. Extending radially inward from the upper edge of the outer wall 176 is a flange 178. The flange 178 provides at least a partial cover for the cassette housing, preferably exerting downward pressure on the flexible tubing and keeping it as tightly packed in the housing as possible. There is at least one peripheral gap 177 formed between an outer rim of the flange 178 and the inner wall 174, through which a user can access the flexible tubing in order to pull it over the inner wall 174 as described in more detail below. Preferably, the inner wall 174 has a rounded profile at its upper edges in order to provide minimal friction, hence enabling smooth flow of flexible tubing there over.

Figure 12A:
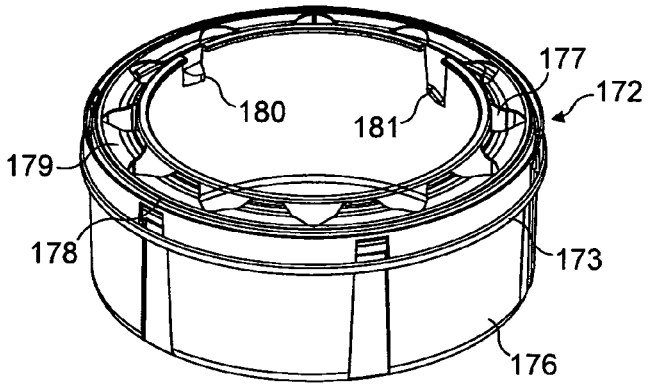
FIG. 12*a* is a perspective view of a waste storage cassette according to an embodiment of the invention.
Figure 12B:
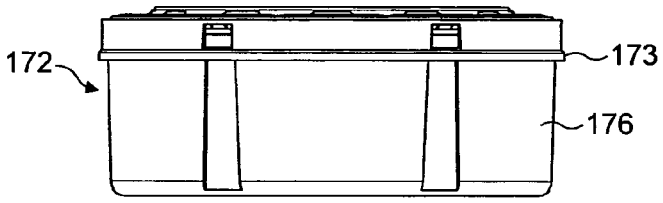
FIG. 12*b* is a side view of the waste storage cassette of FIG. 12*a;*
Figure 12C:
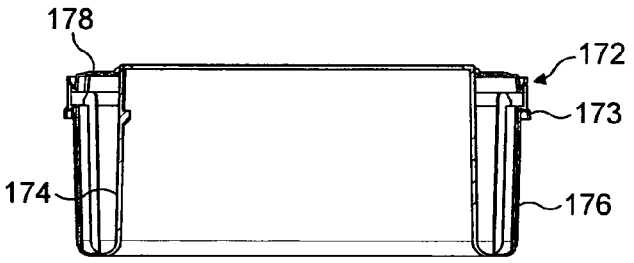
FIG. 12*c* is a cross sectional view of the waste storage cassette of FIGS. 12*a* and 12*b;*
Figure 12D:
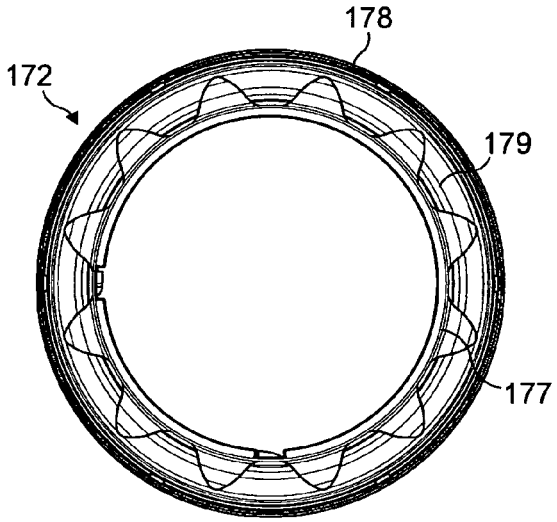
FIG. 12*d* is a top view of the waste storage cassette of FIGS. 12*a* to 12*c;*

As is best seen from FIGS. 12*a* and 12*d*, according to a preferred embodiment the flange 178 comprises a plurality of inward projections or petals 179 extending from the outer wall 176 towards the inner wall 174 of the cassette 172, with a plurality of gaps 177 therebetween which allow flexible tubing to be dispensed from the cassette housing below. The flange 178 can be clipped, snap-fitted or engaged to the outer wall 176 using any suitable means. Preferably the outer edge of the flange 178 is rounded so as to prevent snagging of the tubing when it passes there over.

Figure 12E:
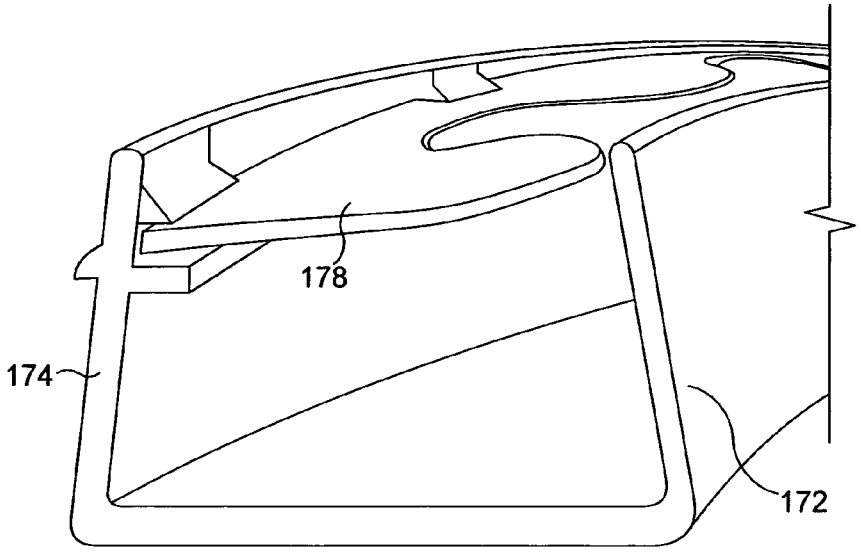
FIG. 12*e* is a cross sectional view of a portion of the waste storage cassette of FIGS. 12*a* to 12*d;*

As shown in FIG. 12*e*, preferably the flange 178 clips or snap fits into the outer wall 176 of the waste storage cassette 172. According to a preferred embodiment, the outer wall 176 includes one or more inwardly extending protrusions on its inner surface with which the flange 178 interengages. Further preferably, the tips of the petals 179, and hence the inner edge of the flange 178, are raised with respect to the outer circumference of the flange.

It will be appreciated from the description below that during use of a waste storage cassette 172 in a waste storage device 100 the petals 179 of the flange 178 improve dosage of the flexible tubing from the cassette housing. In particular, they add tension to the flexible tubing and provide support so that when a relatively heavy waste item is placed in a hollow formed from flexible tubing already dispensed from the cassette 172, the waste item is held in place and its weight does not cause additional tubing to be dispensed from the cassette housing unnecessarily. This is particularly important when there is only a small amount of flexible tubing remaining in the cassette housing, at which time the tubing will not be tightly packed enough to remain trapped in the housing merely due to the covering and downward pressure which the presence of the flange 178 provides.

The petals 179 may each extend to reach the inner wall 174. By extending the petals 179 to reach the inner wall 174 the drag which the flange 178 exerts on the flexible tubing as it is dispensed from the cassette housing is increased. Furthermore, longer petals 179 serve to cover the majority of the flexible tubing in the cassette 172 and prevent it from spilling out before dispensing is required.

According to an alternative embodiment not all of the petals 179 reach the inner wall 174. For example in a cassette 172 having a total of six petals 179 as few as three petals 179, each of a short arc length, should be sufficient to enable adequate user access to the tubing housed therein. The other three petals 179 may therefore be longer, touching or almost touching the inner wall 174 of the cassette 172. In use, when a waste package being formed contains a waste item such as one or two heavy nappies, the longer petals 179 serve to provide sufficient drag on the tubing extending out of the cassette housing so as to prevent the weight of the waste item from urging an excessive amount of tubing therefrom. The selection of petal 179 length and size during manufacture of a waste storage cassette 172 therefore tunes the resistive force that the flange 178 provides.

In a preferred embodiment the waste storage cassette 172 includes an annular ledge 173 projecting radially outwards from an outer surface of the cassette outer wall 176. The ledge 173 is preferably located towards the upper edge of the outer wall 176, but below the flange 178 which extends radially inwards from an inner surface of the outer wall 176.

Drive & Release Tabs

A drive tab 180 is provided on an inner surface of the inner wall 174 of the cassette 172. The drive tab 180 is arranged to inter-engage with the drive peg 166 on the iris ring 158 of a waste storage device 100 so that, in use, rotation of the cassette 172 within the waste storage receiving chamber 132 of the waste storage device 100 drives the drive peg 166, and hence the entire iris ring 158, to rotate and lock in a rotated or partially rotated position. As described in more detail below, this rotation actuates the gripping assembly from an open or released configuration to a closed or gripping configuration.

Figure 13:
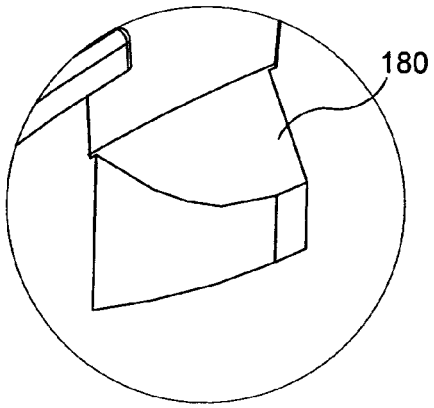
FIG. 13 is a magnified view of a drive tab on the cassette of FIGS. 12*a* to 12*d;*
Figure 14:
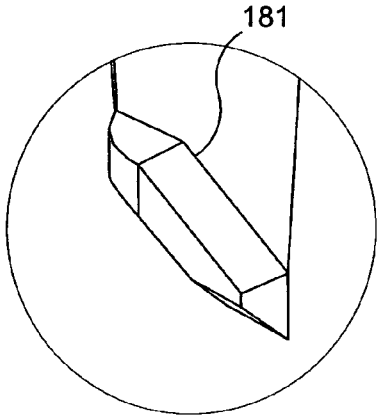
FIG. 14 is a magnified view of a release tab on the cassette of FIGS. 12*a* to 12*d;*

A release tab 181 is also provided on an inner surface of the cassette inner wall 174. for releasing the drive peg 166 from its rotated or partially rotated position. This release of the drive peg 166 actuates the gripping assembly from a closed or gripping configuration to an open or released configuration. Preferably, the release tab 181 is spaced apart from the drive tab 180 along the inner surface of the inner wall 134 and is located vertically downward of at least a portion of the drive tab 180. The drive tab 180 and release tab 181 can be seen in more detail in FIGS. 13 and 14 respectively and their operation is described in more detail below.

Operation of the Waste Storage Device and Waste Storage Cassette

Referring again to FIG. 7, a waste storage cassette 172 is seen in situ in the waste cassette receiving chamber 132 of a waste storage device 100. The cassette 172 is placed in the waste cassette receiving chamber 132, preferably wherein the cassette 172 hangs via the ledge 173 on its outer surface from the rim or annular base 152 of the waste cassette rotator 136.

Alternatively, the cassette 172 can be supported at its base by the rim or annular base 152 of the waste cassette rotator 136. Once the cassette 172 is inserted into the waste cassette receiving chamber 132, the drive peg 166 of the iris band 158 interengages with the corresponding drive tab 180 on the cassette 172 such that subsequent rotation of the cassette 172 will drive rotation of the drive peg 166 and iris ring 158.

In order to begin using a cassette 172 in the waste storage device 100, the user accesses flexible tubing housed within the cassette 172, pulls a length of tubing therefrom and ties a knot in the end of the tubing as described above. The user then inserts the knot into a hook 144 on the under surface of the cover 104 of the device 100 as described above. As a result, a sealed hollow of tubing is formed in the throat of the waste storage device 100, radially inward of the inner wall 174 of the cassette 172. At this point the waste storage device 100 and cassette 172 are ready for insertion of a waste item into the hollow of tubing.

Rotation of the Waste Storage Cassette

Once a user has placed a waste item in the hollow of tubing, he or she then actuates the handle 156 on the waste cassette rotator 136. As described above, the waste cassette rotator 136 has a pre-defined start position for rotation which is determined by the alignment of the waste cassette rotator 136 with the lid 106 of the waste storage device 100. Preferably a one-way tab is provided on an inner surface of the waste storage device 100 wherein said one-way tab interacts with the waste cassette rotator 136 and ensures that it can only rotate in a single direction—either clockwise or anti-clockwise dependent on the structure and/or operation of the tab. Further preferably, and as shown for example in FIG. 6, arrow symbols are provided on an upper surface of the waste cassette rotator 136 in order to indicate to the user the direction of rotation of the waste cassette rotator 136.

Rotation of the waste cassette rotator 136 causes rotation of the cassette 172 located thereon. According to a preferred embodiment, the waste storage cassette 172 and waste cassette rotator 136 include cooperating inter-engagement means, such as a lug and recess arrangement, to ensure that the waste storage cassette 172 rotates synchronously with the waste cassette rotator 136. The inter-engagement means is preferably provided on a bottom outer surface of the cassette 172 such as on an under surface of the ledge 173. Alternatively, the inter-engagement means can be provided on an outer surface of the inner wall 134 of the cassette 172. Further alternatively, the waste storage cassette 172 can rotate with the waste cassette rotator 136 simply because it is supported and/or housed by the waste cassette rotator 136.

As described above, because of inter-engagement between the drive tab 180 on the waste storage cassette and the drive peg 166 on the gripping assembly, the drive peg 166 and iris ring 158 are rotated when the cassette 172 is rotated in the waste cassette receiving chamber 132. Therefore, in use, when the waste cassette rotator 136 is rotated, this causes the iris ring 158 to rotate at least partially around the circumference of the crown funnel 155, which itself remains stationary and fixed to the inner wall 134 of the waste cassette receiving chamber 132.

Figure 15A:
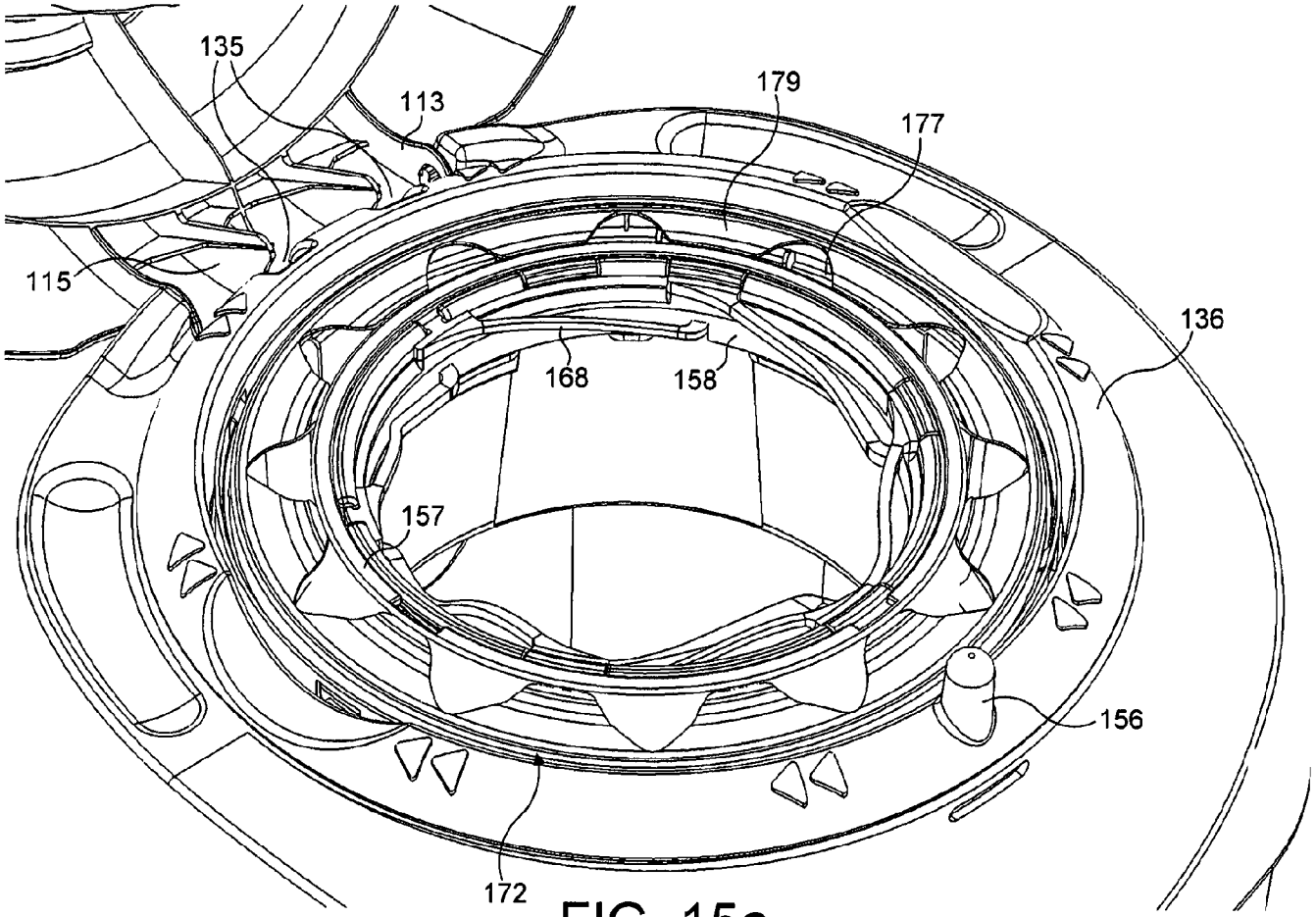
FIG. 15*a* is a view of the waste cassette receiving chamber of FIG. 6 including a waste storage cassette, with a gripping assembly in an open configuration.
Figure 15B:
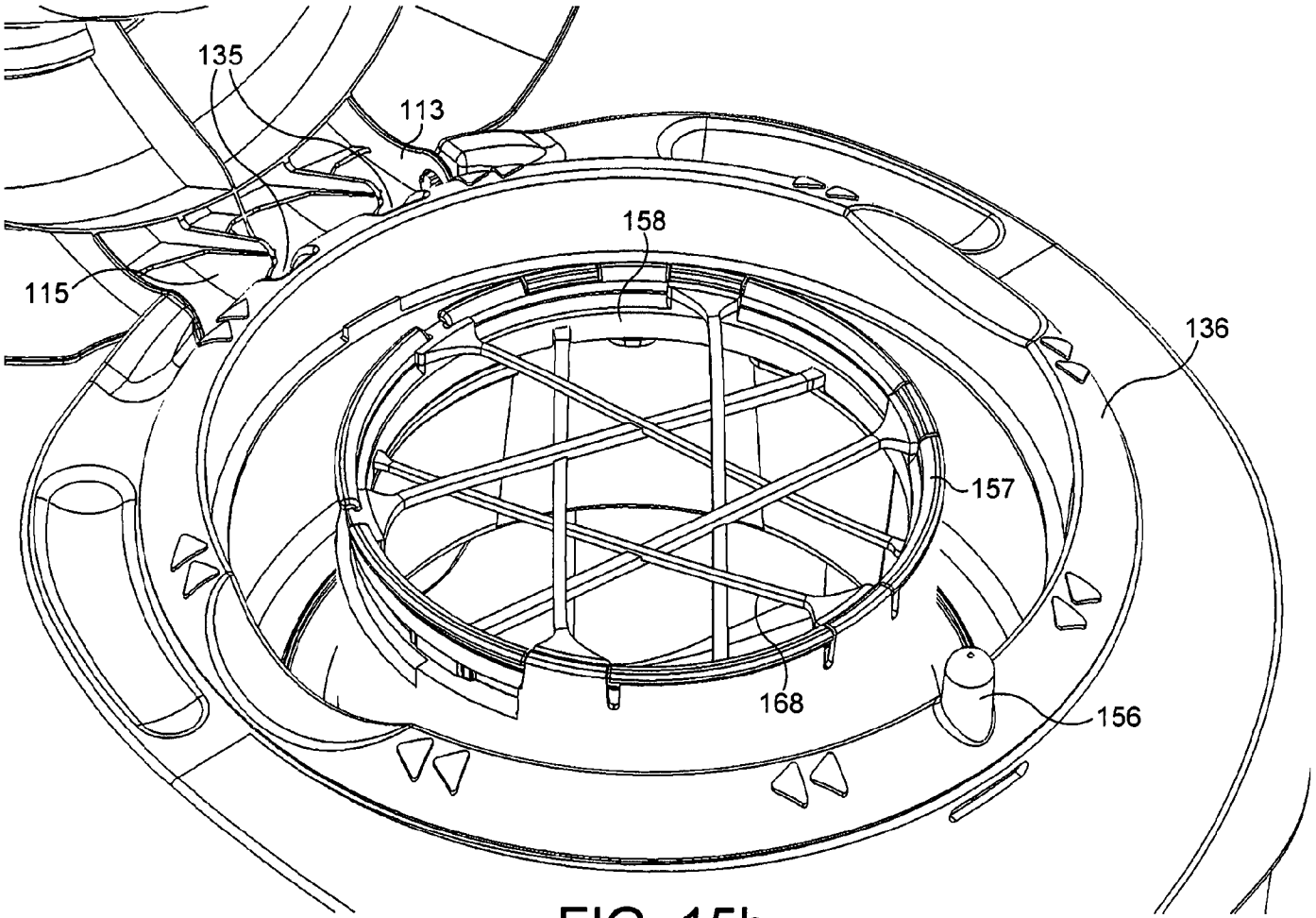
FIG. 15*b* is a view of the waste cassette receiving chamber of FIG. 15*a* with the gripping assembly in a partially closed configuration.

The gripping bands 168 of the gripping assembly each extend at a proximal end from the gripping ring 159 that is fixed within the stationary crown funnel 155 during use, whilst at its distal end each band 168 connects to the rotatable iris ring 158. As a result, when the waste cassette and iris ring 158 are rotated by the waste cassette rotator 136, one end of each of the gripping bands 168 is rotated, whilst the other end does not move. As a result, the bands 168 become stretched and twisted about the centre of the aperture defined by the iris ring 158. According to a preferred embodiment, after a rotation of approximately 60° (or one sixth of a full rotation), the bands 168 twist so as to form a restriction at the centre of the aperture, thereby defining a closed configuration of the gripping assembly. FIGS. 15*a* and 15*b* show the gripping assembly before rotation in an open configuration and after some rotation, close to its fully closed configuration, respectively.

It will be appreciated that when a waste item has been placed in the knotted flexible tubing from the waste cassette 172, the flexible tubing above the waste item will continue to extend upwards, over the crown funnel 155, and back towards the cassette housing. Therefore when the iris ring 158 is rotated to form the closed configuration as described above, the twisted iris of bands 168 at its centre will close in on the flexible tubing located above the waste item. The twisted gripping bands 168 therefore act to grip and close or gather flexible tubing and to hold it in place, creating at least a partial restriction therein. As can be seen from FIG. 15*b*, in its fully closed configuration the bands 168 of the gripping assembly preferably do not actually form a complete unbroken closure. This is because the function of the gripping assembly in its closed configuration is to grip and restrict a portion of flexible tubing in order to prevent it from twisting, rather than to form a complete seal in that portion of flexible tubing. Instead it is the subsequent twisting of the tubing above the restricted portion of tubing which is responsible for creating a sealed twist in the flexible tubing above a waste item, as described further below.

Disengagement of the Drive Peg

At the point in the rotation at which the gripping assembly reaches its closed configuration, the drive tab 180 on the cassette 172 is arranged to disengage from the drive peg 166 on the gripping assembly. The manner of this disengagement can be understood with reference to FIGS. 10*a* to 11*d*. As shown therein, the drive peg 166 includes an arm 166*a* which extends partially along the outer surface of the iris ring 158, and which terminates at its distal end in a substantially trapezium-shaped tab having upper 166*b* and lower 166*c* sloped surfaces. As also shown for example in FIG. 10*b*, the chamfered edge 163 on the outer surface of the crown funnel 155 has a downwardly sloping face 163*a* which leads to a substantially vertical straight face 163*c*. In use, the relative location of the drive peg 166 and the chamfered edge 163 is such that the two are not in contact at the starting position of the iris ring 158, when the iris assembly is in an open configuration, but come into contact after a partial rotation of the iris ring 158.

According to a preferred embodiment, when the iris ring has been rotated by approximately 60° from its starting position (by which time the gripping assembly has reached its closed configuration) the upper sloped surface 166*b* on the drive peg 166 comes into contact with the downwardly sloping face 163*a* of the chamfered edge 163 on the crown funnel 155. The drive peg continues to rotate with the cassette 172 just until its upper sloped surface 166*b* has passed over the downwardly sloping face 163*a* of the chamfered edge 163. However, as a result of its contact with the chamfered edge 163 the drive peg 166, and hence the iris ring 158, is forced downwards, causing disengagement of the drive peg 166 from the drive tab 180 on the inner surface of the waste storage cassette 172. This disengagement of the drive peg 166 from the drive tab 180 is synchronous with the drive peg 166 passing over the downwardly sloping face 163*b* of the chamfered edge 163, and being allowed to move upwards again to its original plane of rotation. At this point, because the drive peg 166 is no longer engaged with the drive tab 180 on the cassette 172, the elastic potential stored in the stretched gripping bands 168 tends to urge the drive peg 166 to reverse its rotation, back to its starting position. However the drive peg 166 is prevented from doing so because its path of rotation is blocked by the substantially vertical straight face 163*c* of the chamfered edge 163. Hence the drive peg 166 is now locked in place with the gripping assembly in its closed configuration and the iris ring 158 out of rotational engagement with the waste storage cassette 172.

Further Rotation of the Waste Storage Cassette

After disengagement of the drive tab 180 and drive peg 166, the cassette 172 can continue its rotation whilst the entire gripping assembly, including the iris ring 158 and the twisted gripping bands 168, remain stationary. As a result, the flexible tubing which extends out of the cassette, down to the restriction point caused by the gripping assembly, is rotated with respect to the restricted tubing and the tubing therebelow (which envelops the waste item placed therein.) This results in a twist being formed in the flexible tubing above the waste item, hence forming a sealed waste package.

According to a preferred embodiment, the waste cassette and waste storage device 100 are arranged so that one single rotation of the waste cassette 172 from its starting position by the waste cassette rotator 136 is sufficient both to grip the tubing above the waste item and form a twist in the tubing in order to complete a sealed waste package. Further preferably, means are provided for giving the user tactile feedback when a single rotation has been completed, and/or for physically preventing the cassette 172 from twisting beyond one full rotation with respect to the waste receiving chamber 132. For example, as described above, a one-way tab is preferably provided on an inner surface of the waste storage device 100 wherein said one-way tab will make a click or other sound when the waste cassette rotator passes the one-way tab, indicating that a complete rotation has occurred.

Preparation of the Waste Storage Device and Cassette for Subsequent Use

Once a sealed waste package has been formed as described above, the user can replace the lid 106 of the waste storage device 100 until he or she next wishes to use the device 100. However it will be appreciated that the lid 106 cannot close successfully whilst the gripping assembly is in a closed configuration because it is necessary for the plunger 108 which extends from a lower surface of the lid 106 to protrude through the gripping assembly and at least partially into the throat formed by the inner wall 134 of the waste cassette receiving chamber 132. This being the case, means is provided for releasing the gripping assembly after a sealed waste package has been formed.

According to a preferred embodiment, the waste cassette 172 and waste storage device 100 are arranged so that when one complete rotation of the cassette 172 in the waste cassette receiving chamber 132 has been completed, or just before said completion, the release tab 181 on the outer surface of the cassette comes into contact with the drive peg 166 on the iris ring 158, which at that time is locked in placed by the chamfered edge 163 on the crown funnel 155. The release tab 181 acts to unhook the drive peg 166 from the chamfered edge 163 of the crown funnel 155, hence releasing it back to its previous rotation track. Because the drive peg 166 is connected to the gripping bands 168 which are in a twisted configuration, when the drive peg 166 is released the elastic potential of the elastic bands 168 provide a rotational force and cause the drive peg to rotate back to its start position. This restores both the iris ring 158 and the gripping bands 168 back to their initial positions, with the gripping assembly in an open configuration.

Once the gripping assembly has reopened as described above, this allows protrusion of the plunger 108 though the aperture and throat defined by the gripping assembly and inner wall 134 of the waste cassette receiving chamber 132. Furthermore this ensures that when the lid 106 is re-opened for subsequent use, the gripping assembly will be in the correct configuration in order to allow a waste item to be inserted therethrough.

Operation of the Plunger

When the lid 106 is closed, the plunger 108 is arranged to prepare the waste storage device 100 and cassette 172 for their next use. Specifically, because the plunger 108 plunges through the aperture in the throat area defined by the open gripping assembly and inner wall 134 of the waste cassette receiving chamber 132, it pushes the previously-formed waste package(s) through the throat, down towards the waste storage chamber 102 below. At the same time, this causes additional flexible tubing to be dispensed from the waste cassette 172 in a metered manner. As a result, the plunger 108 creates a hollow of flexible tubing above the previously-formed waste packages(s), wherein the base of the hollow is formed by the twisted tubing above the previously-sealed waste item. When the user next opens the lid 106 of the waste storage device 100, a waste item can be placed directly in the hollow which the plunger 108 has created. Therefore the user does not have to take any additional steps to prepare the cassette 172 for storage of subsequent waste items, once the lid 106 has been re-opened, nor does the user need to push the previously-formed package(s) down into the waste storage chamber 102 manually.

The plunger 108 is arranged to present a fresh area of tubing which is just big enough to receive a waste item comprising a waste nappy and allow a twist seal to be formed above the nappy, without using any additional flexible tubing unnecessarily. This ensures that the maximum possible number of waste packages can be formed from the flexible tubing stored within a single waste cassette 172, making the cassette more cost-effective and environmentally friendly.

Emptying the Waste Storage Device

A waste storage cassette 172 can be employed in the waste storage device 100 to form a plurality of consecutive waste packages which are stored in the waste storage chamber 102 connected below the cover 104. In order to empty the waste packages from the waste storage chamber 102, the inter-engagement means between the cover 104 and waste storage chamber 102 are released and the cover 104 is lifted from above the waste storage chamber 102. If a cassette 172 in the cover 104 still houses some flexible tubing, the unused flexible tubing extending from the cassette 172 will be continuous with the flexible tubing from which the waste packages have been formed. As described above, in order to release the unused flexible tubing from connection with the previously formed waste packages, the user rips the flexible tubing above the most recently formed waste packaging using the hook 144 and cutter 146 means provided on the underside of the cover 104. Preferably, the components in the cover are made from lightweight materials, so that the user can easily lift the cover and, if desired, hold it in one hand while using the other hand to hold and cut the tubing above the waste packages.

Waste Storage Chamber

Figure 16:
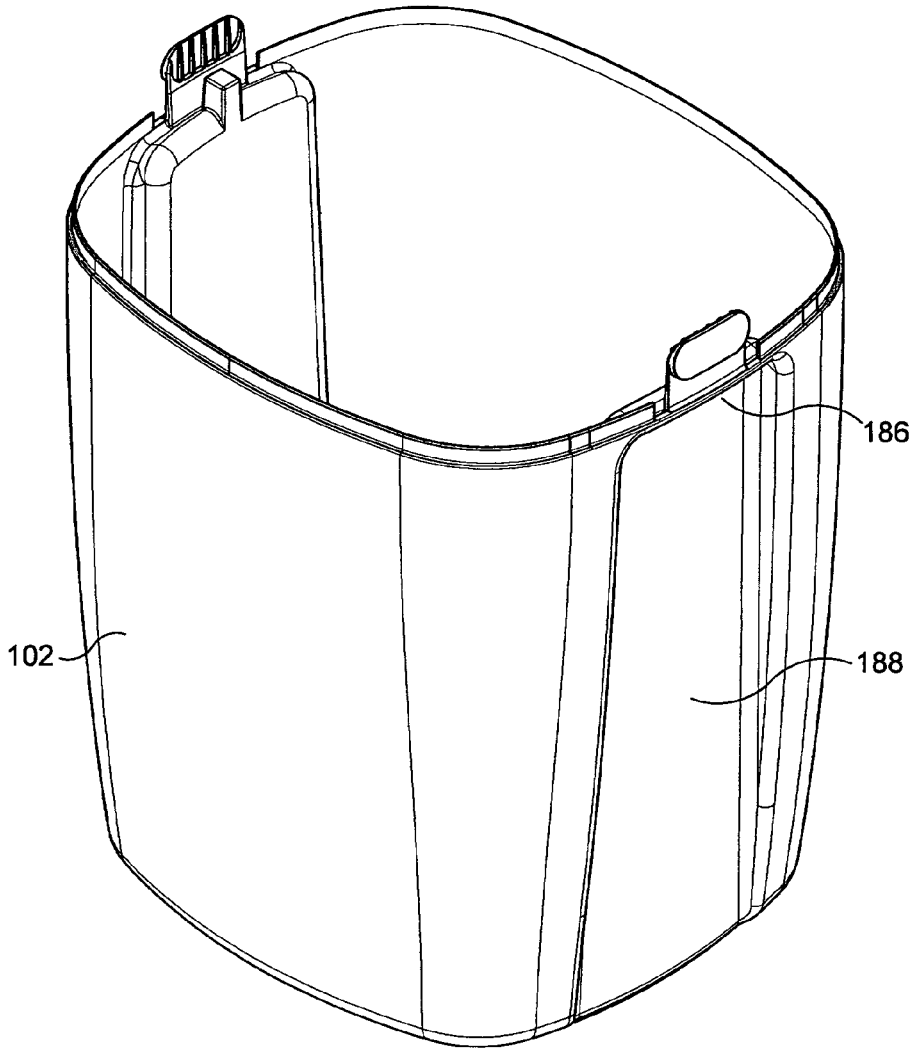
FIG. 16 is a perspective view of a waste storage chamber according to an embodiment of the invention.

As shown in FIG. 16, the waste storage chamber 102 is an open-ended disposal device. The shape and dimensions of the waste storage chamber 102 are designed for a watertight fit with the cover 104 of the waste storage device 100. Optionally, the waste storage chamber 102 is further designed so that the cover 104 can be turned on its side and held steadfastly in the mouth 103 of the chamber 102 whilst tubing is being cut therefrom.

The waste storage chamber 102 preferably has two handles 186, one on either side near the top edge of the waste storage chamber 102. Preferably the handles 186 are recesses formed at the top of respective channels 188 in the outer surface of the waste storage chamber 102 and running at least partially down the length of each side of the chamber 102. Optionally, the cover 104 will extend downwards over an upper part of the surface of the waste storage chamber 102. In such an embodiment, holes are provided in the sides of the cover to enable user access to the handles 186. The handles 186 are arranged for easy user grip for transportation of the waste storage chamber 102. It will be appreciated that handles consisting of recesses are preferable to handles consisting of holes in the surface of the chamber 102, because the recesses ensure that the user's hands do not come into contact with the waste packages within the waste storage chamber 102 during transportation.

Fabrication

The various components of the waste storage device 100 are preferably formed from lightweight plastic or any other suitable material and can be moulded or otherwise formed in any appropriate manner. Preferably the surfaces of the device are wipe-clean. Preferably the gripping bands in the gripping assembly are formed from elastic or any other suitable material which exhibits the appropriate deformation characteristics.

Advantages

The embodiments of the waste storage device described provide a hygienic, easy-to-use and cost-effective means for disposing of used nappies and other waste items.

The plunger provides means for preparing the waste storage device and cassette for repeated use by creating hollows of flexible tubing for waste items to be placed into. This saves time and effort for the user and also ensures that the user does not use additional flexible tubing unnecessarily.

Operation of the device is hygienic because the user does not have to come into contact with a waste item once it has been placed into the hollow of flexible tubing formed above the waste passage. Specifically, the user does not have to push the waste item or waste package into the waste passage in order to direct it into the waste storage chamber. Instead each waste package is directed into the waste passage by the plunger, which presses on the newly-made twist above a waste package when the lid of the device is replaced after use. Nor does the user have to manually twist or seal the waste package. Instead, a simple actuation of the handle of the waste cassette rotator ensures that a waste package is formed, sealed, and gripped in place. The hook provided on the underside of the cover of the waste storage device further ensures that the waste packages are held in place, and that they do not untwist once a twist has been formed therein by the waste storage device.

The gripping assembly provides an easily actuatable and reliable means for holding tubing in place to enable a sealed waste package to be formed about a waste item. Furthermore, by including ribs or other suitable projections on the waste storage device cover, reliable means for returning the gripping assembly to its open configuration in preparation for subsequent use are provided. Because the projections act to align the waste cassette rotator with the lid it is ensured that the rotator and hence the waste storage cassette is in the correct starting position for each use. Additionally, provision of a one-way tab ensures that the cassette is only rotated once during each operation, hence minimising the amount of time and user effort required for operation of the device.

Because the waste storage cassette embodiments include, a flange having at least one projection, pressure is applied to the flexible tubing stored in the cassette thereby helping to prevent too much tubing coming out of the cassette when a heavy nappy or other waste item is placed in a waste storage device. This is particularly important if the waste device is empty or near-empty and the cassette only has a small amount of film in it, both of which conditions could otherwise urge dispensing of an excess amount of flexible tubing.

By snap fitting the flange to a wall of the cassette, improvements are provided are known over known devices in which a flange is welded on to the cassette. In particular, snap fitting eliminates the rejects which previously may have been caused by poor quality welding and prevent trapping of the flexible tubing.

Because the flange attaches to and/or extends from the outer wall of the waste storage cassette, further advantages are provided. In particular, experimental test have shown that pleated flexible tubing stored in a waste storage cassette naturally tends to layer and dose from the centre of the cassette. Therefore because the gap between the flange and the cassette occurs towards the cassette centre, flow of tubing out of the cassette is smoother and easier. In addition, there is a reduced chance of the flange petals damaging the tubing as it is dispensed because pressure causes the petals to move away from the tubing during dispensing. This also reduces the likelihood of rejects which previously could have been caused by tubing becoming trapped by a flange. Furthermore, because the tubing does not flow over the petals of the flange but instead moves over the rounded inner wall of the waste cassette, the risk of snagging the tubing is reduced.

Alternative Embodiments

Depressible Plunger in Lid

Figure 17:
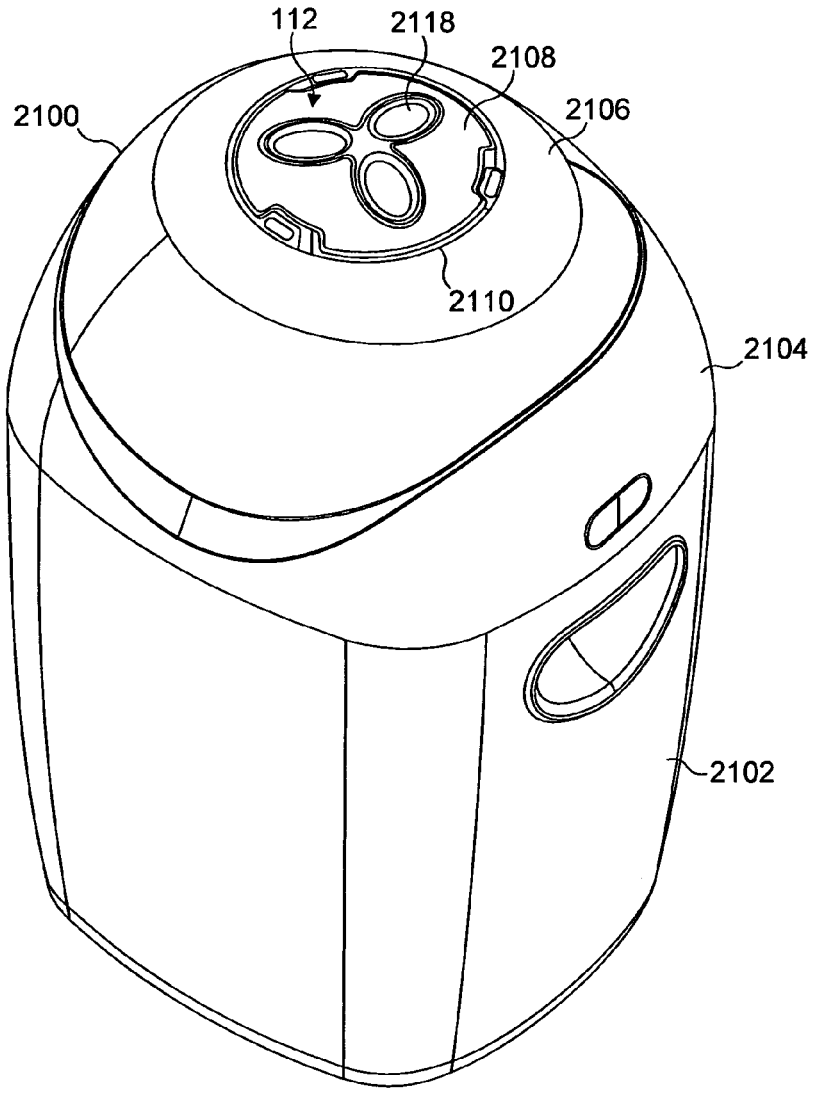
FIG. 17 is a perspective view of a waste storage device according to an alternative embodiment of the invention.

An alternative waste storage device 2100 is depicted in FIGS. 17 to 23. As can be seen from the Figs., the lid 2106 includes a plunger 2108 which extends through an opening 2110 in the upper surface of the lid 2106 and having an outer wall 2121. As shown in FIG. 17, when the plunger 2108 is locked in a depressed position its upper surface 2112 lies flush with the upper surface of the lid 2106. In a released or raised position, the plunger 2108 extends upwardly such that its upper surface 2112 is located vertically upwards of the lid 2106. Preferably the upper surfaces of the lid 2106 and plunger 2108 are domed and continuous in the depressed position; however it is possible for the upper surface of the plunger 2108 to be substantially flat and the remainder of the lid extending downwards therefrom to be curved.

The plunger 2108 and lid 2106 include cooperating formations for locking the plunger in a depressed position. In the embodiment shown in FIGS. 17 and 20 three ridges or projections 2114 extend inwardly from the upper edge of the opening 2110 in the lid 2106 through which the plunger 2108 extends. The ridges 2114 are preferably spaced equidistant from one another about the circumference of the opening 2110. The outer wall 2121 of the plunger 2108 includes three grooves 2116 extending in an axial direction at least partway from the upper surface 2112 to the base of the plunger 2108, wherein each groove 2116 cooperates with a corresponding ridge 2114 in the lid opening 110 forming a bayonet fitting. The plunger 2108 is rotatable from a first locked configuration as shown in FIG. 17 in which the ridges 2114 prevent upward motion of the plunger 2108 to a second unlocked configuration wherein the grooves 2116 allow upward motion of the plunger 2108, so that it can rise above the upper surface of the lid 2106.

Figure 18:
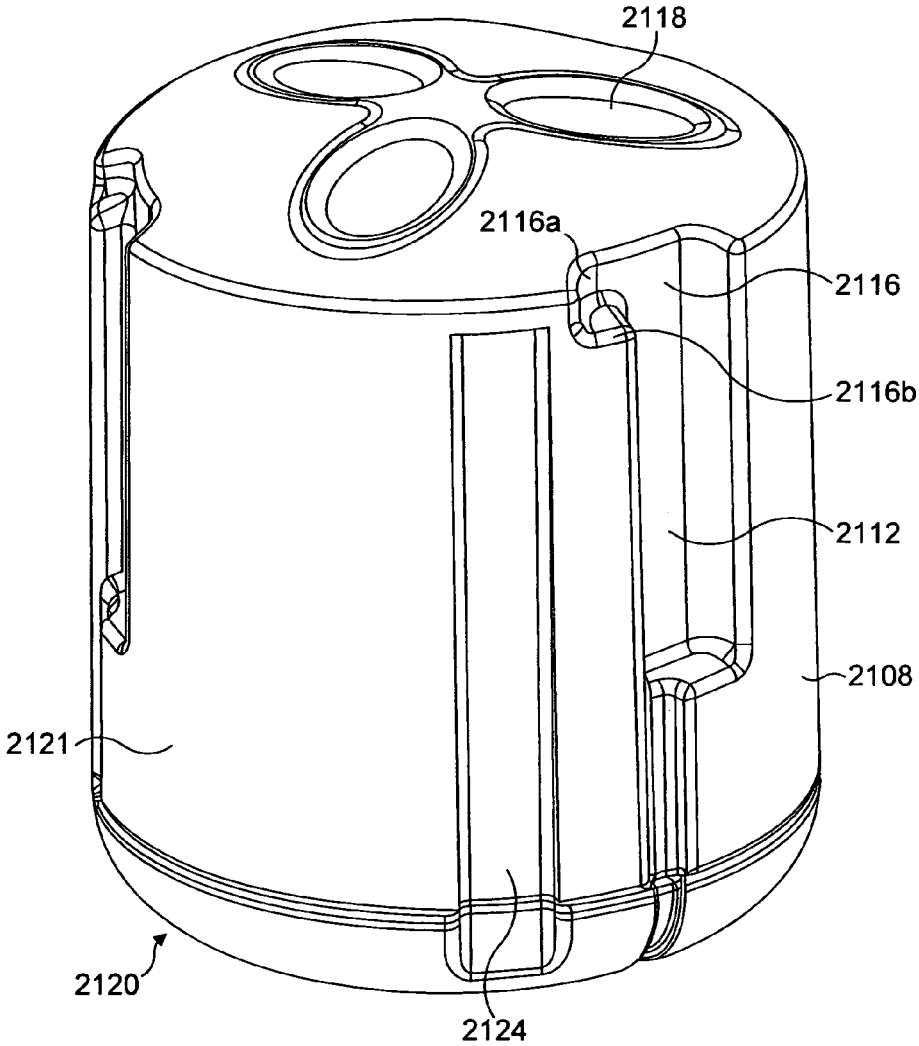
FIG. 18 is a perspective view of a plunger according to an alternative embodiment of the invention.

The interaction between the plunger 2108 and lid 2106 can be seen in more detail in FIGS. 18 to 23. As shown in FIG. 18, the plunger 2108 is substantially cylindrical, the outer wall 2121 adjoining upper 2112 and lower 2120 surfaces. The diameter of the plunger 2108 is designed so that the plunger 2108 fits snugly within the opening 2110 in the lid 2106 of the waste storage device 2100. The three grooves 2116 have a top section 2116*a* each extending partway around the outer circumference of the upper surface 2112 of the plunger 2108, having sufficient depth to just accommodate a cooperating ridge 2114 from the lid 2106. The grooves further include a vertical section or channel 2122 of less width than the top portion 2116*a* and extending axially down the outer wall 2121 partway to the lower surface 2120 such that the groove 2116 defines generally an inverted L-shape with a shoulder 2116*b* where the vertical channel 2122 and top section 2116*a* meet. The plunger 2108 is prevented from moving vertically upwards when the ridges 2114 of the lid 106 are accommodated within the top portion 2116*a* of the respective grooves 2116 in the plunger by the shoulder 2116*b*. However each channel 2122 is of sufficient width to accommodate a respective ridge 2114 from the lid 2106 and is vertically deeper than the ridge 2114. As a result, when a user rotates the plunger 2108 so that the ridges 2114 of the lid 2106 escape the shoulder 2116*b* and are accommodated in the second portions of the respective grooves 2116, the plunger 2108 can move vertically upwards. It will be appreciated that the extent to which the plunger 2108 can move vertically upwards above the opening 2110 in the lid 2106 will depend on the vertical depth of the channels 2112 in the outer wall 2121 of the plunger 2108.

Figure 19:
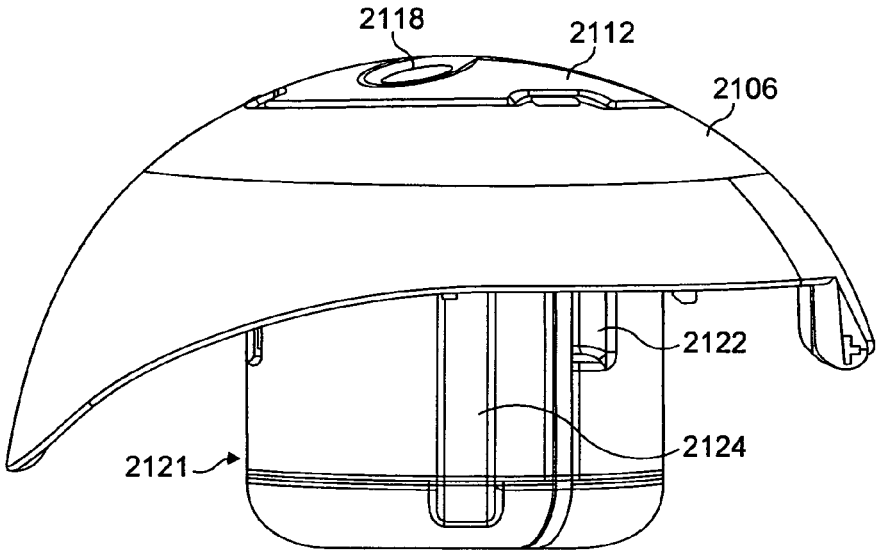
FIG. 19 is a side view of the plunger of FIG. 18 accommodated in a lid according to an alternative embodiment of the invention.

As shown in FIGS. 18 and 19, in addition to the channels 2112 which accommodate the ridges 2114 of the lid 2106, the outer wall 2121 of the plunger 108 includes additional guide grooves 2124 which serve to support and guide vertical movement of the plunger 2108 about the opening 2110 in the lid 2106 in conjunction with cooperating guide projections (not shown) in the lid 2106.

In order to allow manual rotation of the plunger 2108 from a locked to an unlocked position, a plurality of indentations 2118 are provided on the upper surface 2112 of the plunger 2108. Preferably, these indentations 2118 comprise three substantially elliptical indentations arranged about the centremost point of the upper surface 2112 of the plunger 2108 and separated from one another by an angle of approximately 120 degrees. The indentations 2118 are preferably arranged to accommodate the thumb, index finger and middle finger of a user's hand so that a user can easily rotate the plunger 2108.

Figure 20:
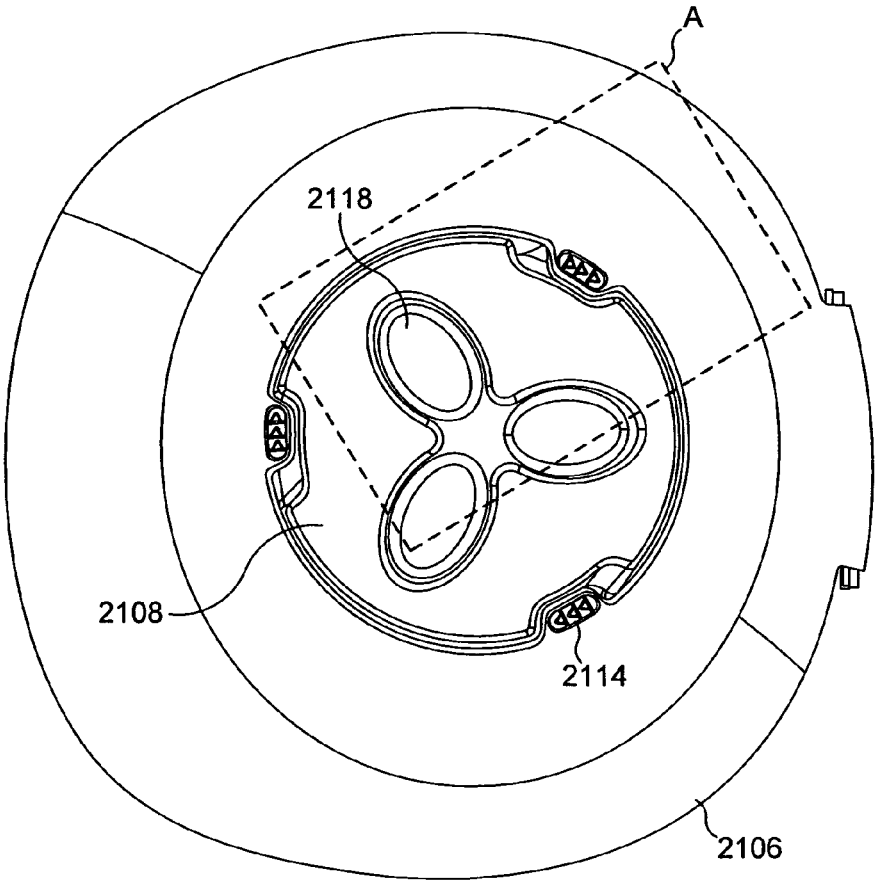
FIG. 20 is a top view of the plunger and lid of FIG. 19.
Figure 21:
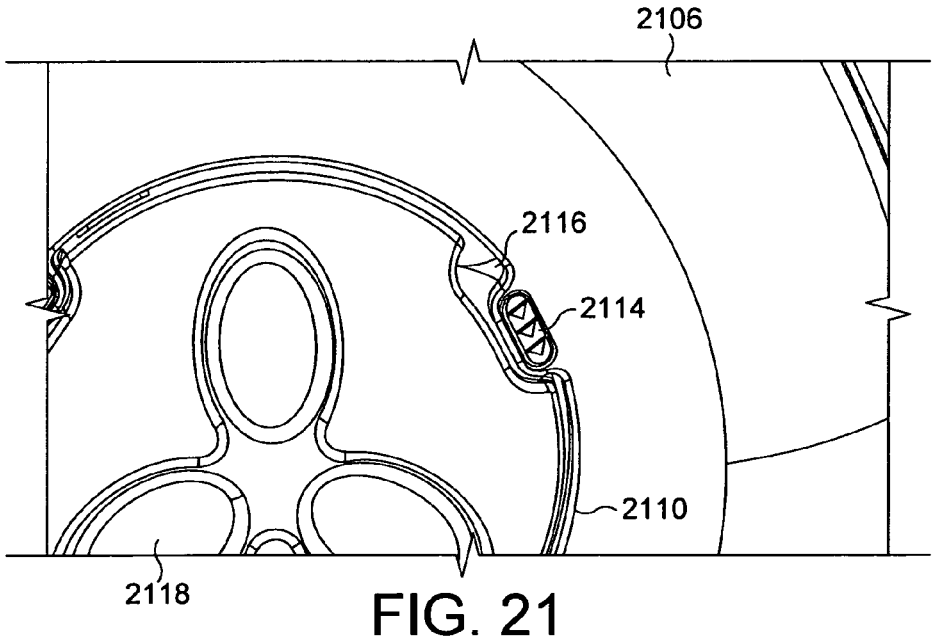
FIG. 21 is a magnified view of section "A" in FIG. 20.

FIGS. 20 and 21 show the plunger 2108 in a locked position in the lid 2106 as viewed from above. As can be seen most clearly in FIG. 21, the ridges 2114 projecting from the lid 2106 optionally include arrow heads to direct the user to rotate the plunger 2108 in a particular direction in order to unlock it from the lid 2106.

Figure 22:
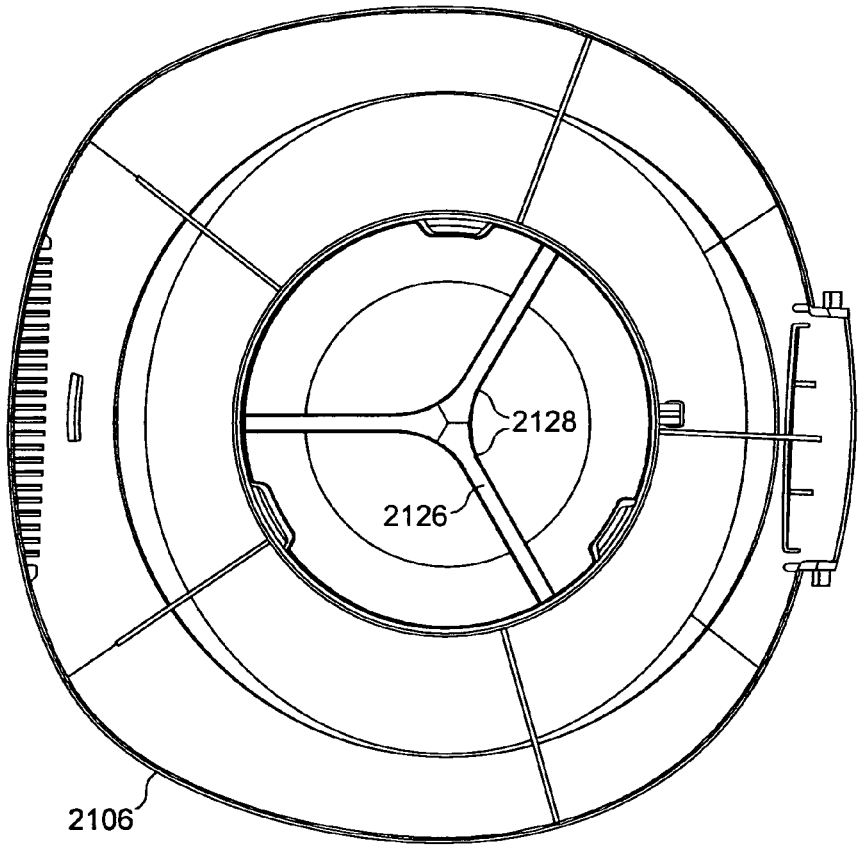
FIG. 22 is a view of the plunger and lid of FIG. 19 from below.

The underside of the plunger 2108 and lid 2106 is shown in FIG. 22. In order to assist vertical movement of the plunger 2108 an elasticated support web 2126 is affixed to the underside of the lid 2106. Preferably, the elasticated support web 2126 comprises three elasticated arms 2128 each of which is affixed at its distal end to a point on the cover 2104 in the vicinity of the lid opening 2110, and which join together at their proximal ends at a point which is substantially coaxial with the centre point of the lid opening 2110. The elasticated arms 2128 are preferably separated from one another by approximately 120 degrees so that in cross-section they form a "Y" shape. The elasticated support web 2126 is designed to extend underneath the plunger 2108 so that when the plunger 2108 is depressed and locked to the lid 2106, the plunger 2108 stretches the elasticated support web 2126 downwards. When the plunger 2108 is unlocked and able to move in a vertical direction, the stretched elasticated support web 2126 exerts a force on the lower surface 2120 of the plunger 2108, encouraging it to move vertically upwards. Of course any other resiliently biasing or urging means can be provided.

Figure 23:
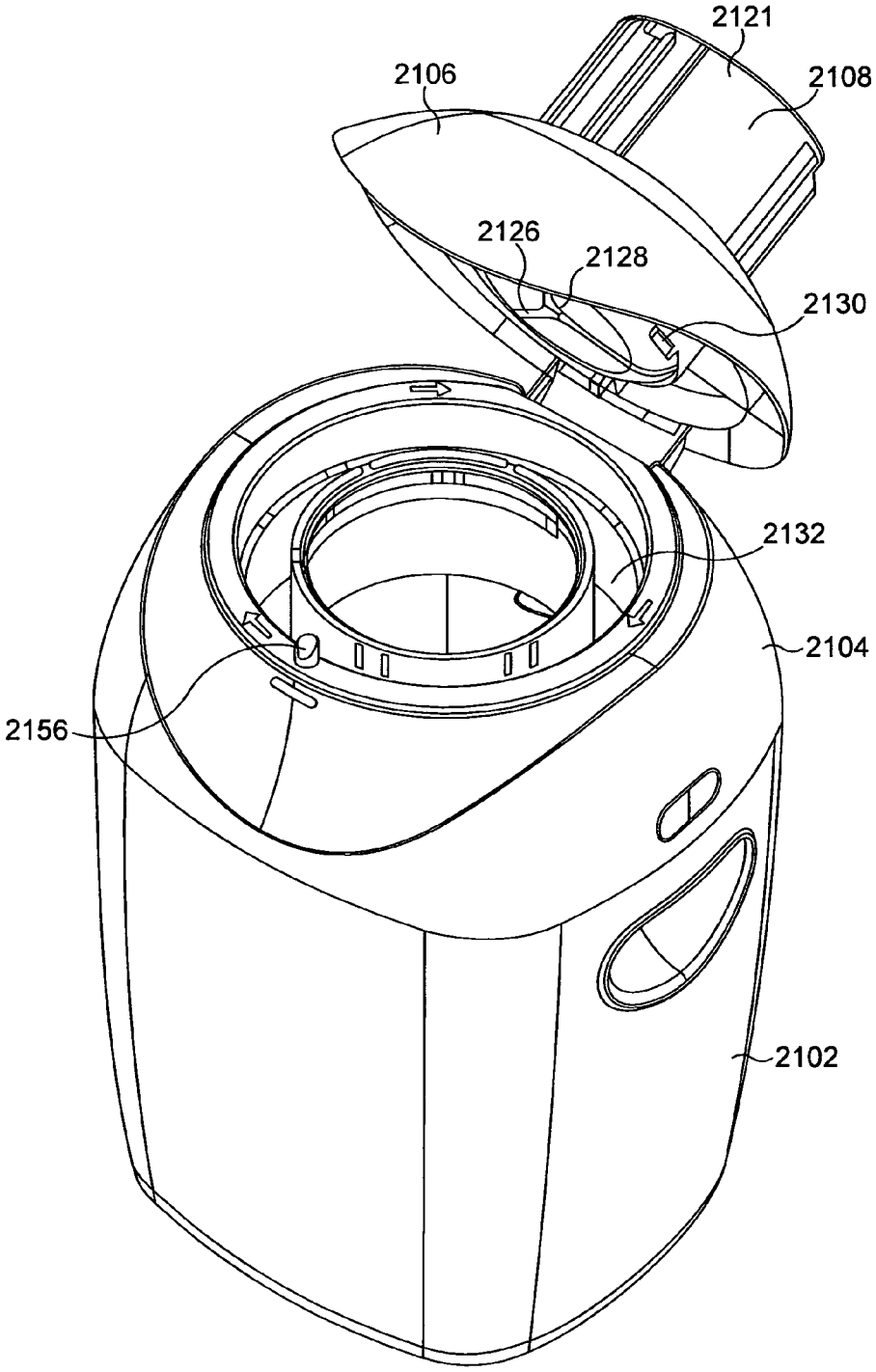
FIG. 23 is a perspective view of the waste storage device of FIG. 17, with the lid in an open configuration and the plunger raised.

According to a possible embodiment as shown in FIG. 23 the lid 2106 includes a cylindrical flange 2130 extending downwardly from the underside of the lid opening 2110. Optionally the elasticated support web 2126 extends from a lower edge of the cylindrical flange 2130. The cylindrical flange 2130 includes detents which cooperate with corresponding recesses on the outer wall 2121 of the plunger 2108 in order to guide and support vertical movement of the plunger 2108. Optionally, in addition to moving vertically upwards of the upper surface of the lid 2106, the upper surface 2112 of the plunger 2108 can move vertically downwards in order to extend the plunger 2108 further into a waste cassette receiving chamber 2132 defined in the cover 2104 of the waste storage device 2100.

Closing and Locking the Lid

Preferably according to the above-described alternative embodiment, the lid 2106 and plunger 2108 are arranged so that the lid 2106 must be fully closed before the plunger 2108 can be depressed and rotated in its bayonet fit to lock it in position with its upper surface 2112 flush with the upper surface of the lid 2106. However it may be possible for a user to close the lid 2106 with the plunger 2108 already locked into position. In such an arrangement, the lid 2106 must be arranged so that the protrusion 2184 on its under surface will interact with the cassette 2172 in order to open the gripping assembly before the plunger 2108 begins to extend into the waste cassette receiving chamber 2132 of the waste storage device 2100. In either case, when the plunger 2108 is locked into the lid 2106 and the lid 2106 is closed, the plunger 2108 extends downwardly into the waste cassette receiving chamber 2132.

Preferably the plunger 2108 is arranged to help secure the lid 2106 in place when the waste storage device 2100 is not in use. It will be appreciated that when the plunger 2108 extends into the waste passage in the waste cassette receiving chamber 2132, it is not possible for the lid 2106 through which the plunger 2108 extends to open fully, because the walls of the waste cassette receiving chamber 2132 restrict the retraction of the plunger 2108. This therefore ensures that the waste storage device 2100 is only opened when the user wishes to store an item therein. As a result the smell-proofing capabilities of the device 2100 are enhanced. In addition, the device 2100 takes up minimal space because the lid 2106 will be closed and the plunger depressed most of the time.

According to a preferred variant of the above described alternative waste storage device embodiment 2100, actuation of the plunger 2108 controls the locking and unlocking of the lid 2106 to and from the cover 2104. In such an embodiment a latch member is attached to the underside of the lid 2106. The latch member has a first arm which interacts with the plunger 2108 and a second arm which engages with a formation on an inner surface of the cover 2104. As described above, when a user twists the plunger 2108 to release it from the upper surface of the lid 2106, the plunger 2108 is urged upwards. A channel or groove can be provided on an outer surface of the plunger 2108 in order to provide a raceway for maintaining engagement with the latch member as the plunger 2108 releases upwards. When the plunger 2108 arrives at its uppermost position, the second arm of the latch member is arranged to disengage from the formation on the cover 2104. The lid 2106 will therefore be released. The lid 2106 may be biased so as to fully open once the latch member disengages from the cover 2104 or, alternatively, disengagement may cause the lid 2104 to open partially, at which point the user can manually rotate the lid to its fully open position.

According to a yet further preferred variant of the above described alternative embodiment, when the lid 2106 of the waste storage device 2100 is closed and the user is depressing the plunger 2108, the latch member provides the user with tactile feedback when a full plunge has been achieved. This enables the user to know when to rotate the plunger 2108 in order to lock it in position in the upper surface of the lid 2106, without having to watch the plunger 2108 as he or she actuates it.

Crown

Figure 24:
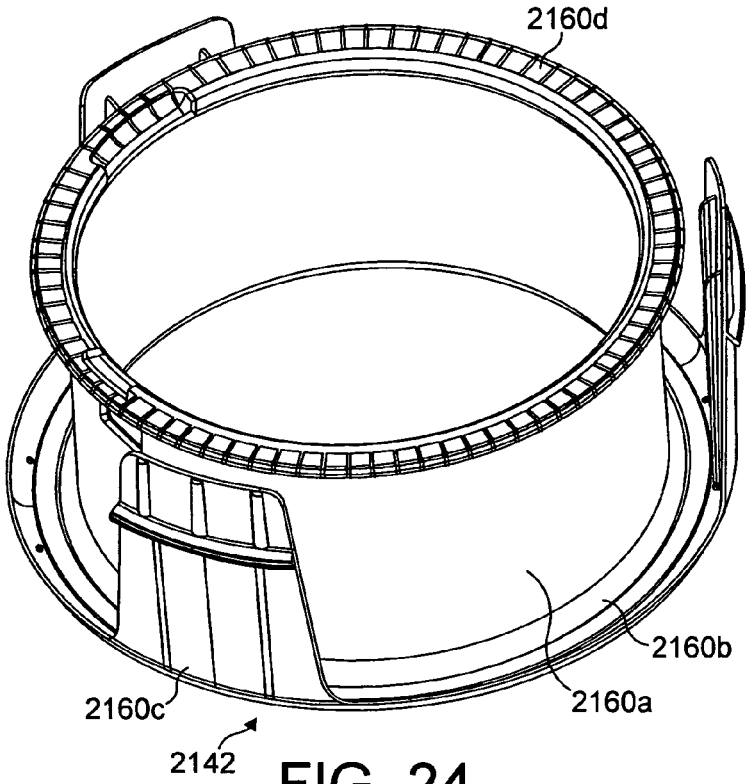
FIG. 24 is a perspective view of an insert for a waste storage device cover according to an alternative embodiment of the invention.

FIG. 24 shows an alternative crown embodiment for insertion into an outer wall of a cassette receiving chamber in a waste storage device. According to this alternative embodiment, the crown 2142 includes a cylindrical wall 2160*a* which will be adjacent to the inner wall of the waste cassette receiving chamber, a base annular flange 2160*b* extending outwardly therefrom, and three clips 2160*c* of generally rectangular shape extending upwardly from the flange 2160*b* parallel to the cylindrical wall 2160*a* at 120 degree intervals and an upper rim 2160*d*. The crown 2142 can be snapped or otherwise fitted to the outer wall of the waste cassette receiving chamber by means of any appropriate cooperating engagement means for example clips 2160*c*.

Figure 25:
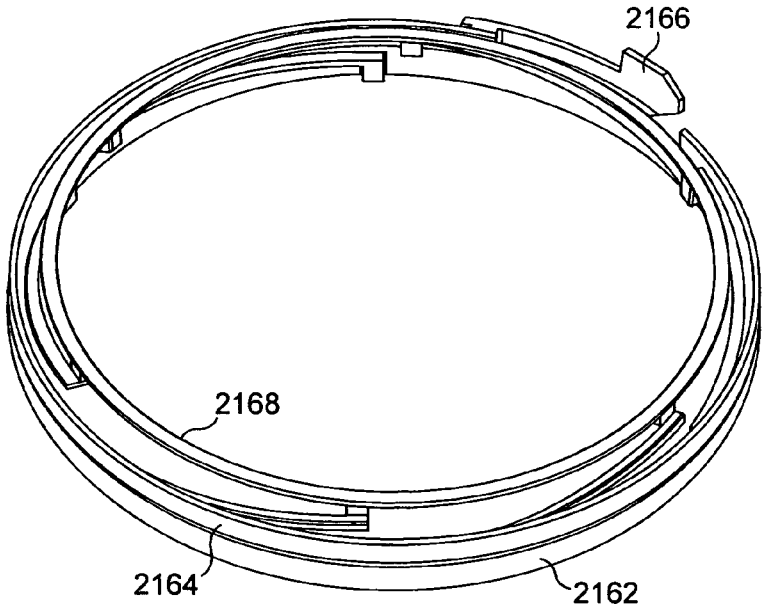
FIG. 25 is a perspective view of a gripping ring and iris ring according to an alternative embodiment of the invention.
Figure 26:
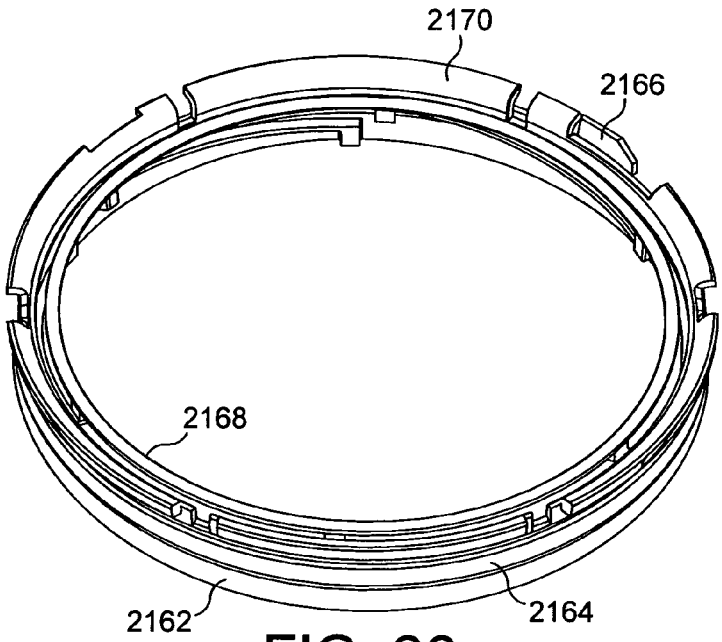
FIG. 26 is a perspective view of a gripping assembly according to an alternative embodiment of the invention, including an iris ring and the crown funnel of FIG. 25.

Gripping Assembly:

FIGS. 25 and 26 show an alternative embodiment of a gripping assembly. The alternative embodiment includes an iris ring 2158 having a plurality of bands 2168 extending therefrom and a crown funnel 2155. The circumference of the crown funnel 2155 is substantially equal to the inner circumference of the inner wall 2174 of a waste cassette receiving chamber of a waste storage device. The crown funnel 2155 is arranged to be supported by, or optionally affixed to, the upper rim of the inner wall of the waste case receiving chamber of the waste storage device. The crown funnel 2155 comprises an annular wall which terminates at its upper edge in an outwardly curved lip 2170. The curved lip 2170 has several gaps therein to assist in operation of the gripping assembly in conjunction with a waste storage cassette as described in more detail below. In use, the crown funnel 2155 push or snap fits together with the below-described iris ring 2158.

The iris ring 2158 includes an outer wall comprising a lower ring 2162 and an upper ring 2164. The lower ring 2162 is an unbroken annulus. The upper ring 2164, which has the same maximum diameter as the lower ring 2162, comprises an annulus having a gap along a small portion of its circumference. The iris ring 2158 further comprises a drive peg 2166 which is arranged to be rotated, hence allowing rotation of the lower ring 2162 of the iris ring 2158. In use, following a either a partial or complete rotation of the lower ring 2162, the drive peg 2166 is driven upwards, out of its rotation track, so that it cannot rotate any further.

Housed within the iris ring 2158 are a series of interconnected elastic bands 2168. According to the preferred embodiment shown in FIG. 25, when the gripping assembly is in an open configuration there is a central elastic band arranged in a circular formation. A plurality of additional elastic bands are provided, each of which extends at an oblique angle between a point on the lower ring 2162 of the iris ring 2158 and a point on the circumference of the central elastic band. The drive peg 2166 is arranged to control the configuration of the elastic bands 2168 wherein when the drive peg 2166 and lower ring 2162 rotate, the ends of the elastic bands which connect thereto are moved with respect to the central elastic band which remains stationary. Similarly to the preferred embodiment described above, after a predetermined partial rotation of the drive peg 2166 the elastic bands 2168 are twisted into a partially closed gripping formation at the centre of the iris ring 2158.

The above-described alternative gripping assembly can be used in a waste storage device in conjunction with a waste storage cassette for formation of sealed waste packages in a similar manner to that described above in relation to the preferred gripping assembly embodiment as shown in FIGS. 8*a* to 11*d*. In particular, due to the inter-engagement between a drive tab on a waste storage cassette and the drive peg 2166 on the alternative gripping assembly, the drive peg 2166 is rotated when the cassette is rotated in the waste receiving chamber of a waste storage device. This rotation causes the elastic bands 2168 of the iris ring 2158 to stretch into a closed or gripping configuration, gripping to close or gather a restriction in the flexible tubing extending from the waste cassette above a waste item. The drive peg 2166 is arranged to disengage from the drive tab on the cassette at this point, so that further rotation of the cassette will cause a twist to be formed in the flexible tubing above the restriction as described in detail above with respect to the preferred embodiment.

Waste Storage Cassette

Figure 27:
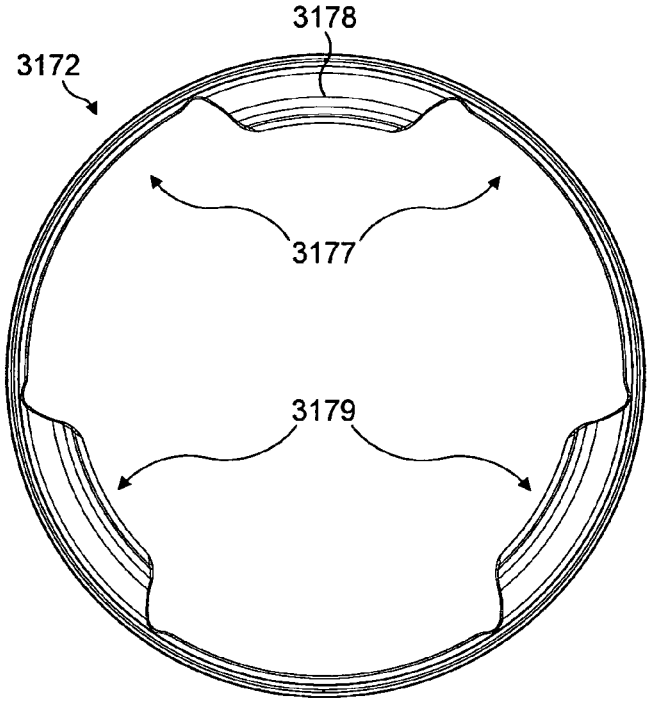
FIG. 27 is a top view of a waste storage cassette according to an alternative embodiment of the invention.

An alternative waste storage cassette 3172 embodiment is shown in FIG. 27. According to this further alternative embodiment, the flange 3178 is intermittent, so that there are few inward projections 3179 and large gaps 3177 therebetween, from which the user can access the end of the flexible tubing stored in the cassette 3172.

Figure 28:
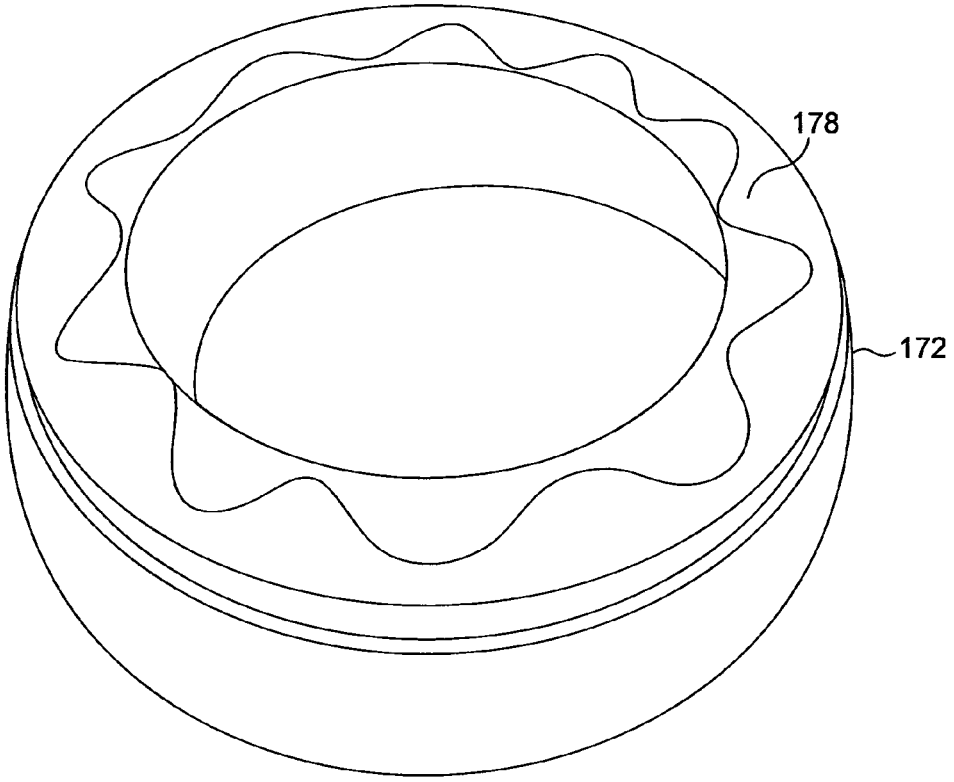
FIG. 28 is a top view of a waste storage cassette according to a further alternative embodiment of the invention.

A further alternative embodiment is shown in FIG. 28 wherein the cassette 10 includes a recess for interengaging with a cooperating lug or protrusion on a waste cassette rotator.

In a yet further alternative embodiment, a waste storage cassette includes a release tab which is arranged to interengage with inter-engagement ribs on an inner surface of the lid of a waste storage device in order to release a gripping assembly therein from its closed, gripping configuration. According to this alternative embodiment, all of: the release tab on the cassette; the recesses on an upper surface of the waste cassette rotator; and the inter-engagement ribs on an under surface of the lid must be in alignment with one another at the end of user operation of a waste storage device, once a waste item has been placed therein and a twist waste package has been formed about the waste item. As a result of the alignment of these features, when the user actuates the lid 106 to close it, the inter-engagement ribs will extend through the recesses in the rotator and will contact the release tab. This contact causes the release tab to release the gripping assembly from its rotated position, for example by unlocking a drive peg as described above with reference to the preferred embodiments.

Optionally, any of the above-described alternative waste storage cassette embodiments may include a drive tab for interaction of the waste storage cassette with a gripping assembly as herein described and/or a groove, lug or recess for interaction with a corresponding lug, recess or groove on a waste storage device and/or a waste cassette rotator.

Waste Chamber

Figure 29:
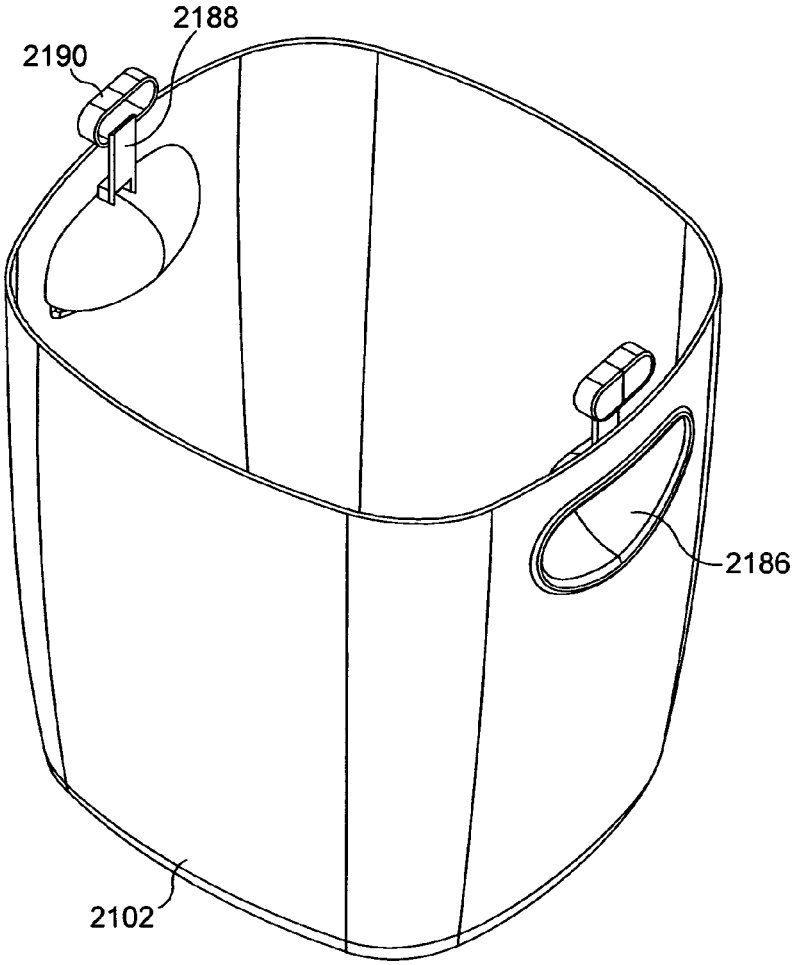
FIG. 29 is a perspective view of a waste storage chamber according to an alternative embodiment of the invention.
Figure 30:
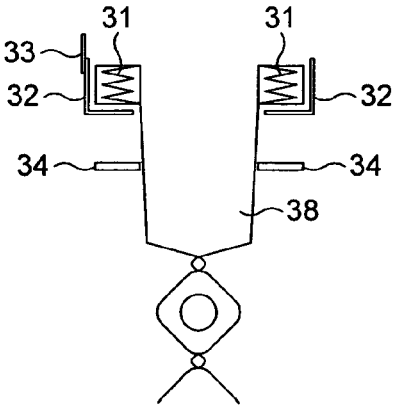
FIG. 30 is a view of an alternative implementation of the invention in a first stage of operation as described in Annex 1.
Figure 31:
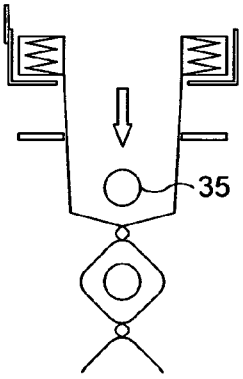
FIG. 31 is a view of the alternative implementation of FIG. 30 in a second stage of operation.
Figure 32:
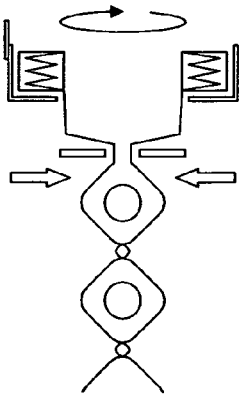
FIG. 32 is a view of the alternative implementation of FIG. 30 in a third stage of operation.
Figure 33:
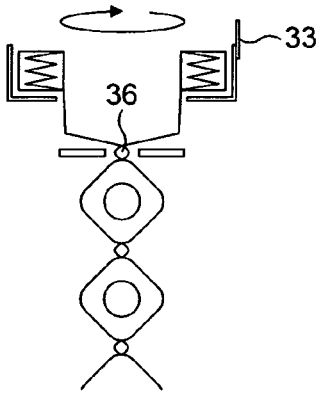
FIG. 33 is a view of the alternative implementation of FIG. 30 in a fourth stage of operation.
Figure 34:
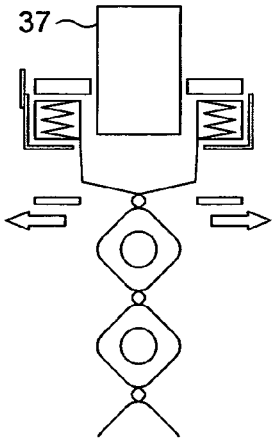
FIG. 34 is a view of the alternative implementation of FIG. 30 in a fifth stage of operation.
Figure 35:
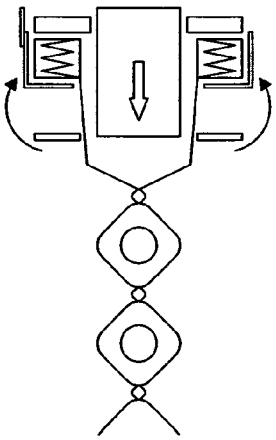
FIG. 35 is a view of the alternative implementation of FIG. 30 in a sixth stage of operation.

An alternative waste storage chamber 2102 embodiment is shown in FIG. 29. According to this alternative embodiment, preferably the handles 2186 consist of domed recesses in the outer surface of the waste storage chamber 2102, arranged for easy user grip for transportation of the waste storage chamber 2102. Preferably a substantially vertical arm extends upwardly from an upper surface of each domed recess, wherein each of said arms terminates in a tab 2190 or other appropriate means for snap fitting or otherwise engaging the waste storage chamber 2102 to a cover of a waste storage device. Preferably each domed recess is moulded as a single piece with a respective arm 2188 and tab 2190 so that the single piece can be inserted into holes of appropriate dimensions in a conventional bin or bucket.

Further Alternatives

Whilst the gripping assembly embodiments are described as comprising bands, for example elastic bands, for twisting and gripping flexible tubing, it will be appreciated that alternative iris formations are possible. For example, the bands could be replaced by strings or movable shutters. Alternatively or additionally, the bands could be continually joined to one another. Optionally, the bands could be replaced by an alternative assembly including moveable rods.

The plunger according to the preferred embodiment has been described as being hollow; however the plunger may be at least partially filled. Optionally, deodorising means could be stored in the hollow of the plunger in order to enhance the smell-proofing qualities of the waste storage device.

In the alternative embodiment the plunger is described as having indentations on its upper surface for actuation of the plunger, however it will be appreciated that any suitable means such as a handle or knob could be provided for twisting the plunger to unlock it from the surface of the lid. Similarly, the plunger may not be locked in position by groove and ridge means as described but may instead be held in position by any other suitable means. It may further be possible to release the plunger by depressing it downwards by a prescribed depth, and thereby releasing it for upward motion, rather than by rotating it.

Any appropriate cutter means may be provided for cutting the flexible tubing from the waste storage cassette. Similarly, the lid may not be hingedly attached to the cover but instead fit thereto by means of a snap fit or any appropriate inter-engagement means.

Although discussion has been directed to provision of the waste storage device for storage of nappies, it will be appreciated that any appropriate waste such as hygienic waste, medical waste or household waste can be stored and packaged as described above. Similarly the device can be used in any appropriate environment for example domestic, workplace, retail, public, hospital or care environments.

Annex 1

The invention relates to a waste package storage device. Known waste package storage devices are described in, for example, published patents/applications GB2206094, GB2221445, WO02/100723, WO2005/042381 and include a bin on which is supported a waste storage tubing cassette from which tubing can be pulled. Packages are inserted into the tubing which is then twisted above each individual package, sealing the package and odour.

The invention is set out in the numbered clauses in Annex 2. According to aspects of the invention, hands-free operation is provided where manual pushing of a package is not required, nor manual dexterity. A simplified, intuitive operation is also provided allowing one-handed operation or hands-free operation. The risk of odour escaping while a package is being inserted is removed according to some embodiments.

Embodiments of the invention will now be described with reference to FIGS. 30 to 61 which show various aspects of the invention.

In overview, a storage tub is lined by film dispensed from a cassette that sits at the top of the tub. The cassette is cylindrical with a hollow core into which waste, such as used disposable nappies are deposited. The nappy is then sealed within the tube of film-preventing odour from escaping, and stored in the base of the unit. Once the base has stored a number of nappies, the user can easily permanently dispose of them by detaching and emptying the base.

The invention provides a method of sealing the film around the nappies, so that each one is either sealed into its own discrete package, or so that a number of nappies are sealed into a single, larger receptacle. The sealing mechanism keeps an air-tight seal between the compartment storing the nappies and the outside, but operates to seal a sequence of nappies without odour escaping from compartment or compartments storing older waste.

The approach is described herein and can be implemented to include any appropriate waste package storage device, for example one of the kind described in WO2005/024381 which is commonly assigned herein and incorporated herein by reference. Such devices in general comprise a base portion providing a bin and an upper portion including a rotatable support on which a generally annular waste storage tubing cassette is mounted. Tubing is drawn from the top of the cassette down through the centre of the cassette and knotted at the base. Packages are then pushed down through the centre of the cassette to a region where they are gripped against rotation by spring loaded paddles, an elastic membrane or the like. The support is then rotated to create a twist above the stationary package. When the next waste package is inserted it pushes the preceding package past the gripping member into the bin below and is itself gripped to allow a further twist to be created. In various, of the embodiments below a storage space or ante chamber are created above the base of the bin which acts as a further storage space. As will be explained in more detail, the newly created storage space can be used as an airlock or odour retention space to ensure that escape of odour is minimised when additional packages are inserted into the device.

Figure 36:
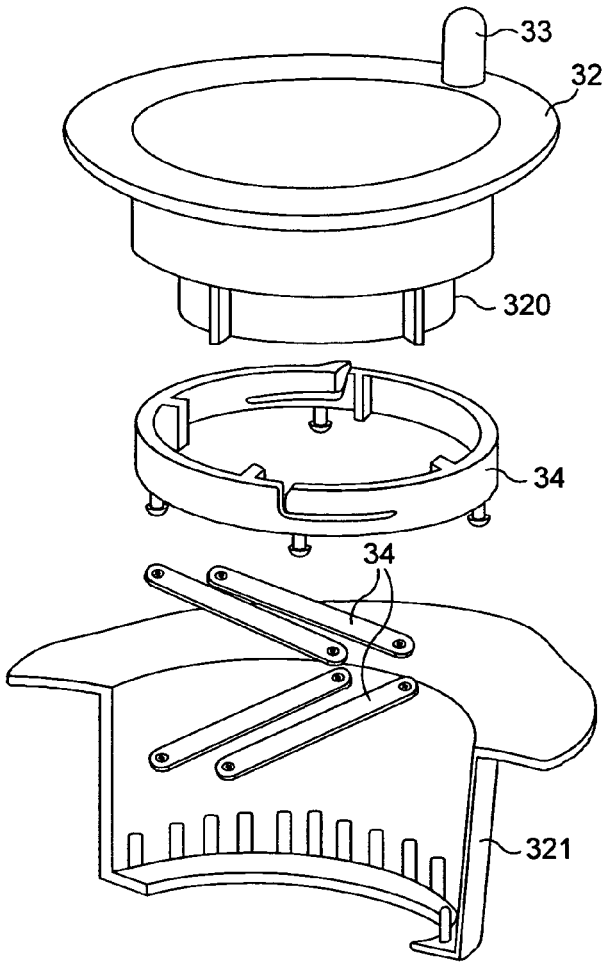
FIG. 36 is a perspective view of the first stage of operation shown in FIG. 30.

Turning to a first implementation which can be understood with reference to FIGS. 30 to 35 which show a schematic cross sectional view of the various steps involved and FIG. 36 which is a perspective view of the first implementation, in summary an approach is provided in which a cassette dispenses film down the central core, which can be deepened relative to existing designs. Upon opening of the lid, the nappy is dropped into a deep chamber and the bag is closed above the nappy by creation of a constriction by a constrictor as the cassette is rotated. Further rotation of the cassette releases the constrictor and a plunger can then be used to push the package down and create an empty chamber for the next nappy.

Referring to FIGS. 30-35, as with WO2005042381, the cassette (31) sits on a rotating insert (32) which has a handle (33) for the user to operate. The cassette sits on a shelf inside the insert and hangs part way down.

The lower half of the insert (320, FIG. 36) is attached to a closing mechanism (34) that is also secured to an immobile part of the tub body (321, FIG. 36). The mechanism works such that turning the insert closes the closing mechanism within a fraction of a turn (FIG. 32), thereby gripping the film above the nappy (35). The mechanism remains closed while the insert continues to rotate (FIGS. 33 & 34) until, just before the insert has completed one rotation, it opens within the remaining fraction of a turn.

Figure 37:
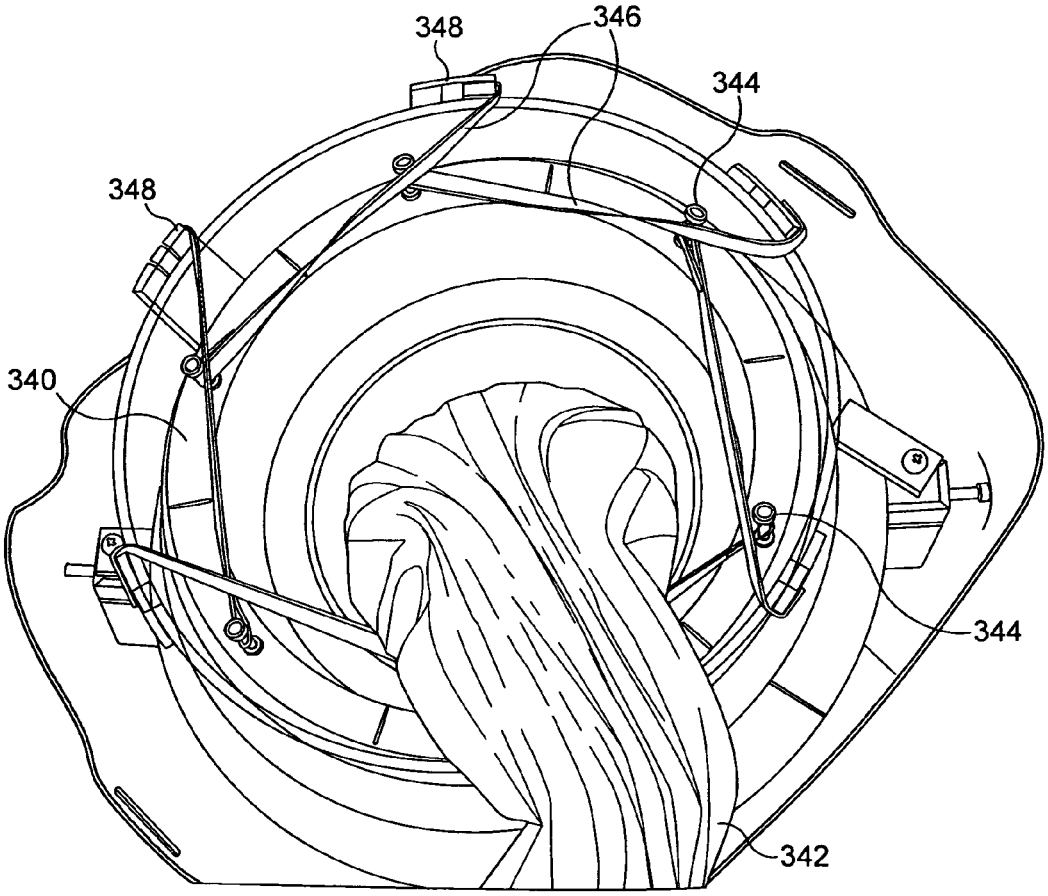
FIG. 37 is a perspective view of a possible implementation of the invention in an open configuration as described in Annex 1.
Figure 38:
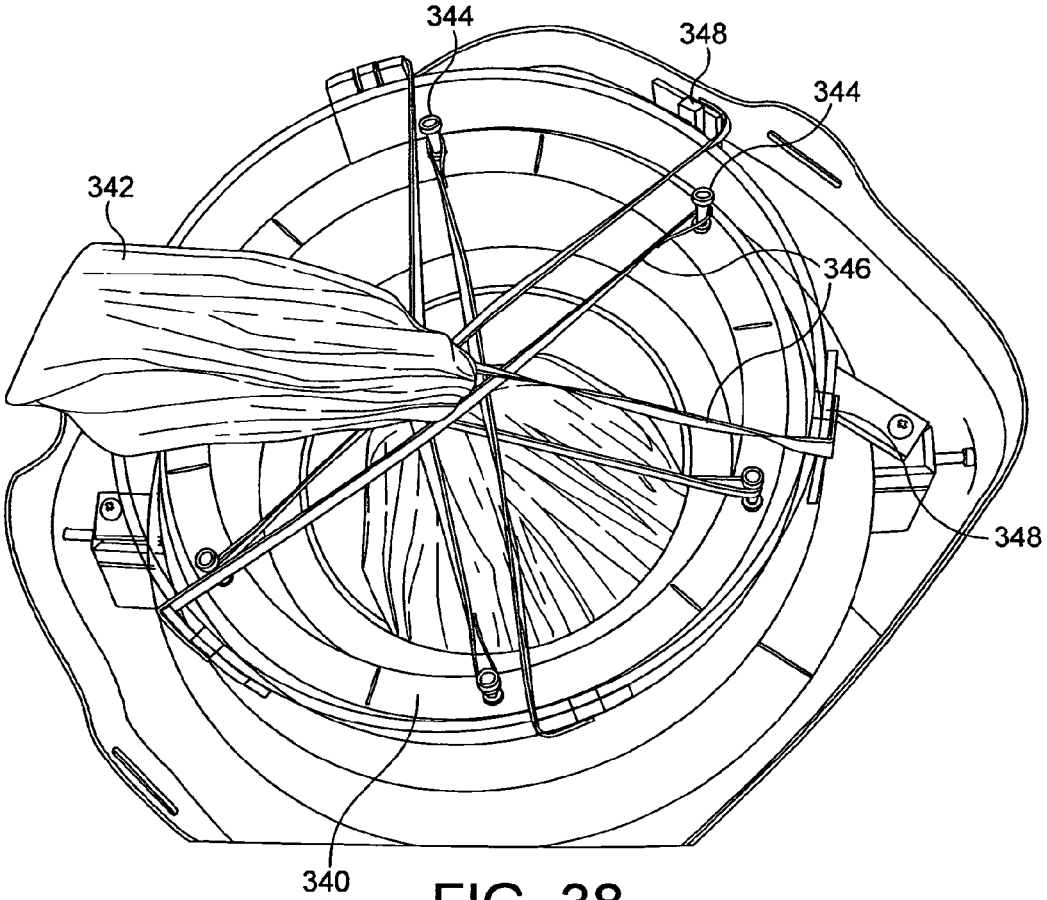
FIG. 38 is a perspective view of the implementation of the invention of FIG. 37 in a closed configuration.
Figure 39:
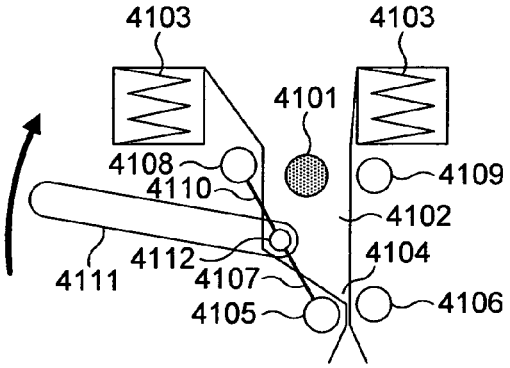
FIG. 39 is a view of a further alternative implementation of the invention in a first stage of operation as described in Annex 1.
Figure 40:
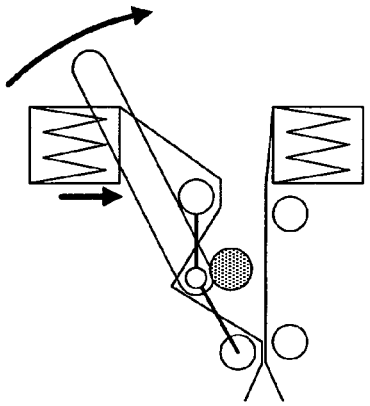
FIG. 40 is a view of the further alternative implementation of FIG. 39 in a second stage of operation.
Figure 41:
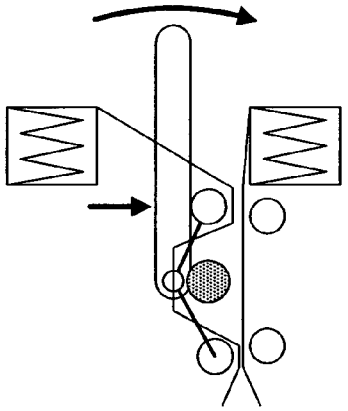
FIG. 41 is a view of the further alternative implementation of FIG. 39 in a third stage of operation.
Figure 42:
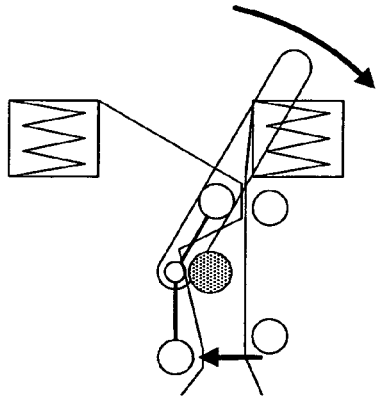
FIG. 42 is a view of the further alternative implementation of FIG. 39 in a fourth stage of operation.
Figure 43:
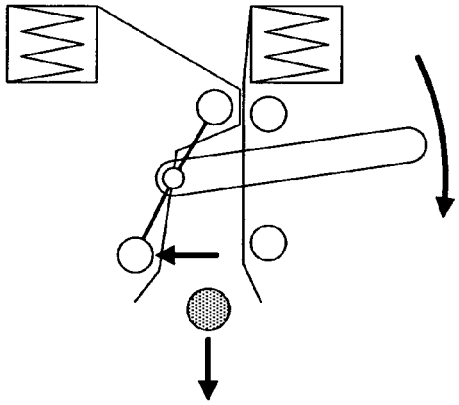
FIG. 43 is a view of the further alternative implementation of FIG. 39 in a fifth stage of operation.

The approach can be further understood with reference to FIGS. 37 and 38 which are perspective representations of the device in each of an unconstricted and a constricted configuration, viewed from the underside. The underside of a support 340 for the waste storage cassette through which waste storage tubing 342 protrudes includes a plurality of projections 344. In the embodiment shown six projections are incorporated although of course any appropriate number of projections can be provided. Each of the projections 344 has an elastic tensioning device such as an elastic band 346 attached thereto. The other end of each elastic band is attached to a formation 348 on the inside of the device housing or lid, or otherwise fixed relative to rotation of the cassette and cassette support. The projections 344 and formations 348 are disposed symmetrically in the shape of two hexagons.

In an unconstricted configuration where there is no tension on the elastic bands 346, opposed ends of the elastic bands are spaced approximately sixty degrees apart about a vertical axis through the centre of the support 340. The elastic bands 46 thus define generally a hexagonal shape in the unconstricted, relaxed configuration as shown in FIG. 37.

Referring now to FIG. 38 it will be seen that when the cassette support 340 is twisted about its vertical axis the projections 344 on the underside of the support 340 rotate away from the corresponding fixed ends 348 stretching the elastic bands 346 until they extend generally across a diameter of the cassette support 340. As a result the tubing 342 is gathered and constricted between the bands, pinching off the tubing and hence sealing against escape of odour. In addition the package is twisted by the rotating action. When the cassette support is released the tension in the elastic bands 346 will urge the support to rotate back to its relaxed, non-constricted position allowing insertion of a further waste package.

It will be appreciated that any appropriate constrictor mechanism can be adopted using any suitable elastic member such as a spring, or any other constriction mechanism which acts as a closing diaphragm or iris upon twisting of the cassette or support.

During the rotation of the insert, the cassette rotates with the insert, thereby completing a single rotation together with the insert and putting a twist in the film (36) above the point where it has been held by the closing mechanism.

Once the rotation has been completed, the newly-wrapped nappy is pushed into the storage bin below. This can be by hand, or by a plunger (37) which slides down and presses against the newly-formed twist (36). The plunger is at least as long as the central core cavity (38) so that the cavity (38) is empty in readiness for the next nappy.

Rotating the insert may be manual or motorised. The plunger may be manual or motorised and optionally linked to the same motor action that rotates the insert and cassette.

The cassette housing optionally has a ratchet device or other detent to indicate to the user when a full rotation has been completed indicating that the device is ready for insertion of a further package and/or ensuring that rotation is only permitted in one direction.

The grip device or constrictor can be of any appropriate type. For example rather than comprising a mechanical linkage it can comprise elastomeric or spring lengths which tighten and then release the film above a newly introduced waste package. The cassette may deliver film from the top or the bottom, depending on the depth of the cavity and the central core. To ensure that the cassette or housing are compatible with the plunger the cassette can have grooves on its inner wall in an axial direction, which engage with protrusions on the plunger to engage with it and guide it downwards.

According to a second implementation a storage space or ante chamber acts as an odour prevention mechanism. The device has a lid which can be closed once the package has been inserted and which acts as an upper airtight seal once the waste package is dropped into the device. In summary, once the lid is closed, rotating a rotary actuator releases a further closure below the waste package temporarily so that it drops from the storage space into a further storage space below. Completing the rotation, for example by a single turn of the lid rotating device, shuts the lower closure, sealing the waste package in the storage bin. In this implementation an airtight seal on the lid can optionally be provided to ensure that odour does not escape. It will be seen that this approach can be based very closely on the implementation shown in FIGS. 30 to 36 but in which the gripping or closing mechanism 34 is actuated by an external rotatable or otherwise operable actuator which can be operated after the device lid has been closed. It will be seen that whilst in a typical approach a cassette and waste storage tubing will be incorporated as discussed in relation to the first implementation, alternatively a package can be dropped straight into the airlock space. The airtight seal can be implemented in any appropriate manner for example incorporating the rotation drive whilst still sealing or while temporarily by-passing the seal.

According to a third implementation the storage space has pairs of closure members at top and bottom for creating a pinch in the waste storage tubing upon operation of an actuator. A single motion for example pushing or pulling an actuator in the form of a lever from one side to another causes two actions on the film tubing around the nappy, firstly sealing the top closure members and locking the nappy away from the user, then opening the bottom closure members allowing the nappy to drop into a further storage space such as a storage bin.

The mechanism can employ lost motion in the form of three sequential states. In the first sequential state the top seal is open and the bottom closed, in the second or intermediate state both are closed and in a third state the top is closed and the bottom is open, the transition between states being via a single continuous operation. As a result odours are contained when new packages are introduced into the device by virtue of the airlock mechanism.

The third implementation can be further understood with reference to FIGS. 39 to 43 which show in schematic cross section, relevant aspects of the device during the various steps.

Referring to FIGS. 39-43, a used nappy (4101) is inserted into a cavity (4102) below the film cassette (4103). The base of the cavity (4104) is closed by two rollers or bars (4105, 4106) which are pressed together by a spring or springs (4107). The top of the cavity is open because a pair of equivalent spring-loaded rollers or bars (4108, 4109) are being held open or fall open because the spring device (4110) is not pushing them together.

Once the nappy is in the cavity, a handle (4111) located outside the tub is pulled. The handle is linked to an axle (4112) that goes into the tub to engage with the spring devices (4107, 4110) that are keeping the upper pair of rollers (4108, 4109) apart and the lower pair of rollers (4105, 4106) together.

Operating the handle (4111) increases the tension in the upper spring device (4110) such that it begins to press the upper rollers (4108, 4109) together. As the handle (4111) is moved further, the pressing force increases until the upper rollers (4108, 4109) are pressing against each other thereby closing the top of the cavity which contains the nappy (4101).

Moving the handle further in the same direction consequently begins to decrease the tension on the spring device (4107) pressing the lower pair of rollers (4105, 4106) together. As the handle continues to move the spring stops pressing the rollers together and then begins to pull the rollers apart. When the handle has come to rest at the far end of its travel, the bottom pair of rollers are far enough apart that the nappy can fall out of the cavity and into a permanent storage bin below.

Preferably, the spring devices of the top and bottom pairs of rollers are linked together and may even be the two ends of the same spring i.e. a single spring device is linked between an upper and lower roller.

Preferably, one each of the top and bottom pairs of rollers (e.g. 4106, 4109) is fixed while the opposing partners (4105, 4108) move towards or away from the fixed roller, thereby closing or opening the both openings. Optionally, the fixed roller of each pair is not a roller at all but a linear ridge on the inside wall of the tub.

Optionally, when the handle is in the position where the top rollers are closed together and the bottom rollers are fully apart, there remains enough tension in the system for the handle to return to its original position without the user doing anything. In other words, the handle returns of its own accord closing the lower pair of rollers and then fully opening the upper pair of rollers, due to the potential energy in the spring mechanism.

The system can otherwise be arranged so that it is reset by the user moving the handle to its original position.

The system can optionally incorporate a dosing wheel, such that in the starting position the user can manually rotate one of the lower pair of rollers (4105 or 4106). As the rollers are pressed together, they grip the film so that turning the roller will pull film downwards, off the cassette, presenting the user with fresh film in the cavity (4104).

Figure 44:
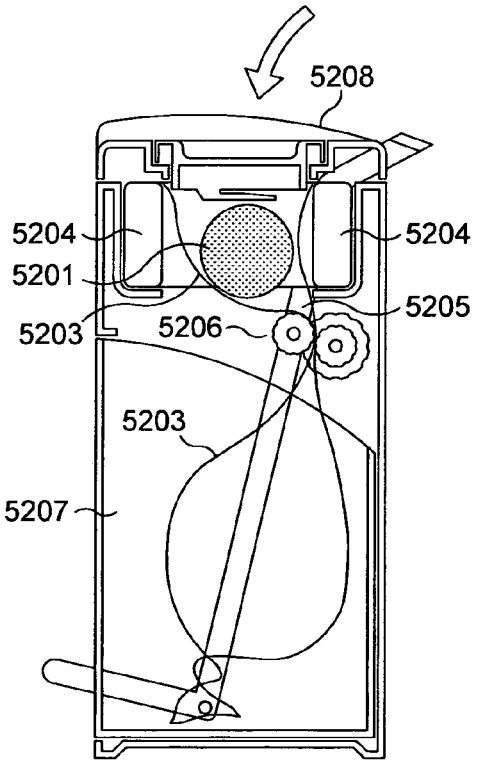
FIG. 44 is a view of a yet further alternative implementation of the invention in a first stage of operation as described in Annex 1.
Figure 45:
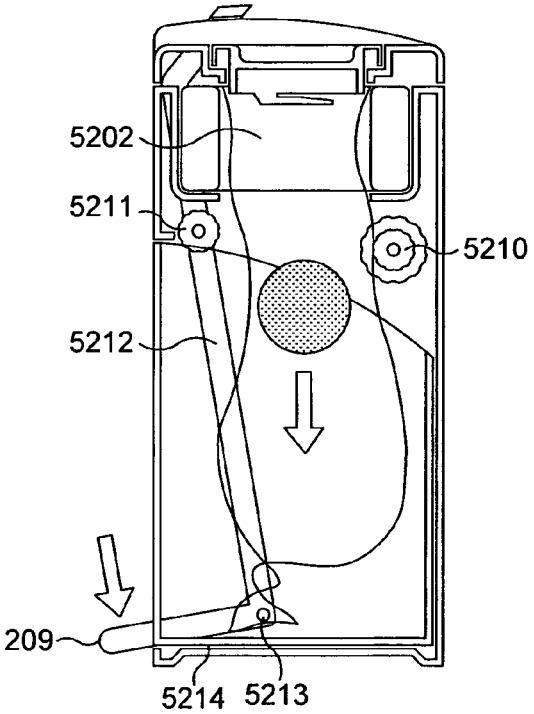
FIG. 45 is a view of the yet further alternative implementation of FIG. 44 in a second stage of operation.
Figure 46:
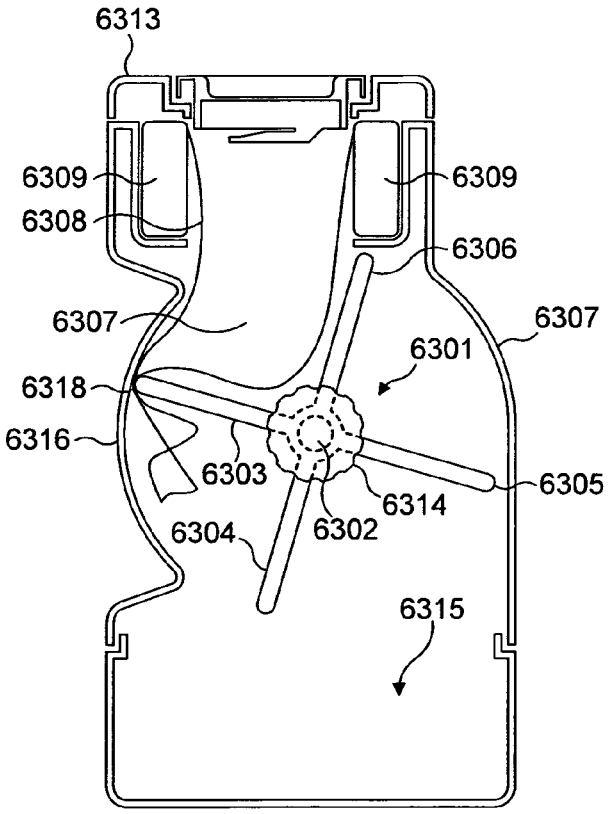
FIG. 46 is a view of another alternative implementation of the invention as described in Annex 1.
Figure 47:
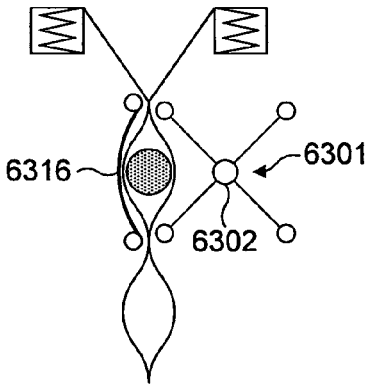
FIG. 47 is a schematic view of the another alternative implementation of FIG. 46 in a first stage of operation.
Figure 48:
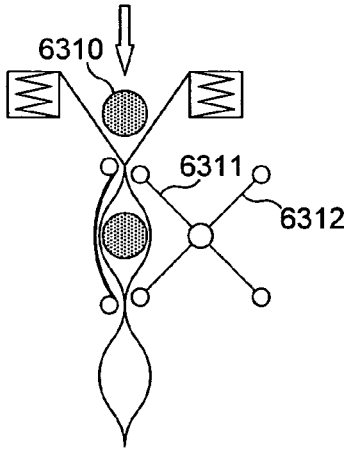
FIG. 48 is a schematic view of the another alternative implementation of FIG. 46 in a second stage of operation.
Figure 49:
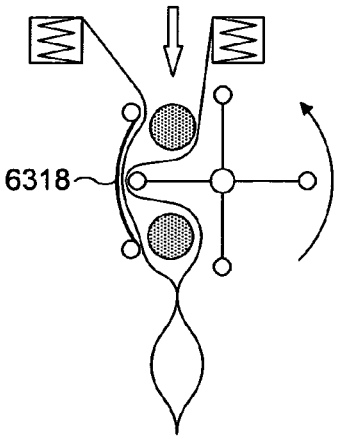
FIG. 49 is a schematic view of the another alternative implementation of FIG. 46 in a third stage of operation.
Figure 50:
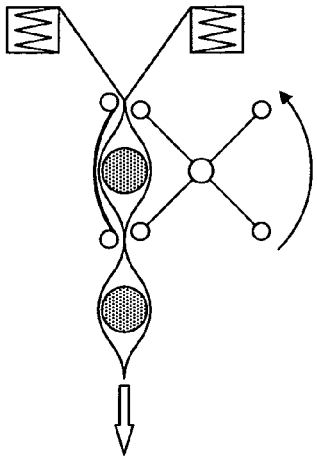
FIG. 50 is a schematic view of the another alternative implementation of FIG. 46 in a fourth stage of operation.
Figure 51:
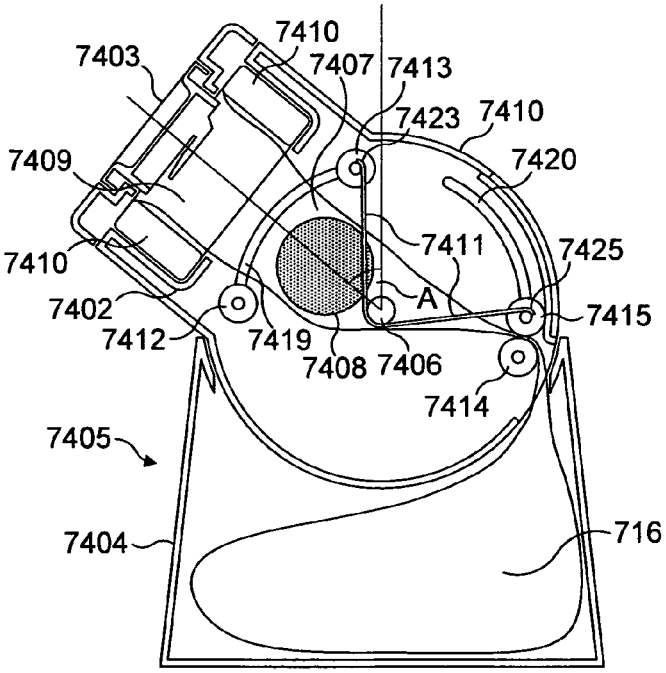
FIG. 51 is a view of a yet another implementation of the invention in a first stage of operation as described in Annex 1.

According to a fourth implementation a waste storage space or ante chamber can be opened at an outlet end by operation of a lever actuator as shown in FIGS. 44 and 45 which are cross-sectional side views of an embodiment of the fourth implementation in its closed and open states respectively. The lever can be for example a foot pedal which opens the closing device below the film cassette allowing the waste package to drop to the storage bin below. Release of the pedal closes the closure mechanism and seals all the waste in an airtight sack in the base. It will be noted that in this implementation drawing out of the tubing is optional and there is no requirement to create twists above each package as the odours are retained by the closure at the base of the storage space below the cassette and above the further storage space.

Referring to FIGS. 44 and 45, as per known designs (WO2005042381) the nappy (5201) is dropped into a cavity (5202) lined with film (5203) from a cassette (5204). The base (5205) of the cavity is closed by a mechanism (5206) that gives an air-tight seal between the cavity and the storage bin (5207) below.

After depositing the nappy, the lid (5208) is closed in an airtight manner and the user presses a foot pedal (5209). The foot pedal is linked to the closing mechanism at the base of the cavity, so that pressing it temporarily releases the mechanism, allowing the waste to fall through and into the storage bin.

In one embodiment the closure mechanism is a pair of jaws (5210, 211). One jaw (5210) is fixed, or may optionally be a feature on the inside wall of the tub. The second jaw (5211) is movable to press or release against the first jaw. The second jaw is fixed by a rigid bar (5212) to a hinge (5213) at the base (5214) of the storage bin. The foot pedal is fixed to the same rigid bar at approximately 90° to the rigid bar, so that when downward force is applied to the foot pedal it rotates about the hinge, simultaneously causing the rigid bar to rotate with it in the same direction. As the rigid bar rotates, the second jaw moves away from the first jaw allowing the waste nappy to fall into the storage bin below.

Any other appropriate mechanism that operates to releasably seal the entrance to the storage bin may be implemented.

Optionally, the jaws (5210, 5211) can be rotating wheels, at least one of which can be turned by the user from outside the storage bin. When the user turns the wheel and the jaws are together (5206) the jaws grip the film and move it. Preferably the wheel only moves in a single rotational direction that pulls the film downward, thereby pulling extra film off the cassette.

According to a fifth implementation a storage space or ante chamber is created using a rotatable partition element comprising a plurality of rotors or paddles projecting from a central axis for example at 90° degree intervals, a partition being created between adjacent paddles the tips of which engage an inner surface of the storage space to shield it from adjacent partitions. In summary, waste packages are dropped through the central core of the cassette into a cavity or storage space created by the paddles. Turning the rotor draws the waste package downwards into the further storage space below, pulling the film through the cassette at the same time as can be understood with respect to FIG. 46 which is a cross-sectional view of a device according to the fifth implementation and FIGS. 47 to 50 which show schematically in cross section the various steps of operation according to the fifth implementation.

Referring to FIGS. 46-50, a rotor (6301) with a horizontal axis (6302) and several paddles (6303, 6304, 6305, 6306) sits below a film-lined cavity (6307), where the film (6308) is provided from a cassette (6309) in the same way as present products.

When the nappy (6310) is dropped in the cavity, it falls in between two rotors (6311, 6312). With the nappy in the cavity, the lid (6313) closes and the user operates a handle (6314) which causes the rotor to rotate. The waste nappy is thereby caught by the rotor paddles and pulled around with them.

Depending on the number of paddles and the amount of rotation, the nappy will fall into the storage bin (6315) either immediately after the first rotation action, or after another nappy has been dropped in the bin and the rotor given a further turn.

The system can be set up with a ratchet device so that rotation by the user is limited to a desired angular movement of the paddles per operation, thereby giving optimum film use.

Preferably, there is a shaped feature (6316) on the inner wall of the tub (6317) that complements the shape of the outer arc traced by the rotor paddles, so that once the rotor has been turned a short distance about its axis a paddle is in close enough contact with the shaped feature that it forms an air-tight seal (6318).

Optionally, the rotor blades can be collapsible (with hinges at the point they connect to the axle) so that after the paddle reaches the bottom of its arc, depositing the nappy in the storage bin, and begins to travel back towards the cassette, the paddle hangs vertical so that it passes through a much smaller space on the upward part of the arc. Hence, the complete rotor occupies a smaller volume than would otherwise be possible.

According to a sixth implementation the waste storage space is closable at an inlet and outlet end by pairs of closure members which can pinch the waste storage tubing. Operation of the closure members is achieved by rotation of the inlet around the storage space as can be understood with reference to FIGS. 51 to 53 which show in cross-section operation of the device and FIGS. 54 to 56 which show in schematic cross-section the various operational state according to the fifth implementation. In summary the nappies are dropped through the central core which can be angled off vertical and the whole head or inlet can then be tilted around a horizontal axis through the vertical so that the opening for waste packages faces the other side of the bin. The tilting mechanism is linked to springs or other linkage mechanisms so that the storage space first closes above the waste package, then opens below it, thereby passing the waste package into the storage bin below. A similar approach can be implemented to that described above with respect to the third implementation in which there are two pairs of closing rollers having the sequential states of top open, bottom closed, then top closed and bottom closed, then top closed and bottom open and the transition between states is also via a single operation, namely rotation of the whole inlet of the top section about a horizontal axis rather than providing a handle. In addition, as discussed above with respect to the third implementation a dosing wheel can be provided allowing manual rotation of one or more of the rollers or closure members to pull the film downwards, presenting the user with fresh film in the cavity.

Referring to FIGS. 51 to 56, this implementation is similar to the third implementation. However, instead of the user pulling a handle, the top section (7401), including the cassette holder (7402) and the lid (7403), is separate from the bottom section (7404) of the tub (7405) and is pivotable around an axis (7406) or pivot that passes through the centre of the receiving cavity (7407). (As a result there is no axle passing through the cavity and impeding the nappy).

The description below of the sixth implementation refers to one side of the tub and while not mentioned, there will be a second, opposing side to the tub with all features arranged as a mirror image.

In the start position, the nappy (7408) is dropped through the core (7409) of the cassette (7410) and through the open upper closing mechanism (7412, 7413), into the cavity (7407). The opening is not vertical but at tilted at an angle (A) below vertical. To complete the nappy disposal, the user pushes the lid and hence pivots the whole top section, thereby pushing the lid back through the vertical until it faces a similar angle in the opposite direction to the start. In doing so, the user causes an internal spring system (7411) to first close the top pair of rollers (7412, 7413) before opening the lower pair of rollers (7414, 7415), allowing the nappy to drop into the storage bin (7416).

As with the third implementation, the opening and closing mechanism operates in a single, continuous user operation, going from a position where the top pair of rollers are open and the bottom pair closed, through an intermediary position where both pairs of rollers are closed, to a finish position where the top pair of rollers, are closed and the bottom pair are open. However, this concept differs in that none of four rollers are fixed in space—one roller (7412, 7414) of each pair is fixed to the pivoting top section and hence moves continuously through the same angle (A) about the axis (7406) as the top section when the user pushes the lid. The axes (7423, 7425) of the other rollers (7413, 7415) in each pair are fixed to the top section, but both axes are free to travel within the confines of arc-shaped channels (7419, 7420) in the wall of the top section.

To control the movement of this second set of rollers within their respective channels, in the start position (FIG. 51) the spring mechanism (7411) operates to have axes (7423, 7425) at one end of their channels (7419, 420).

Figure 52:
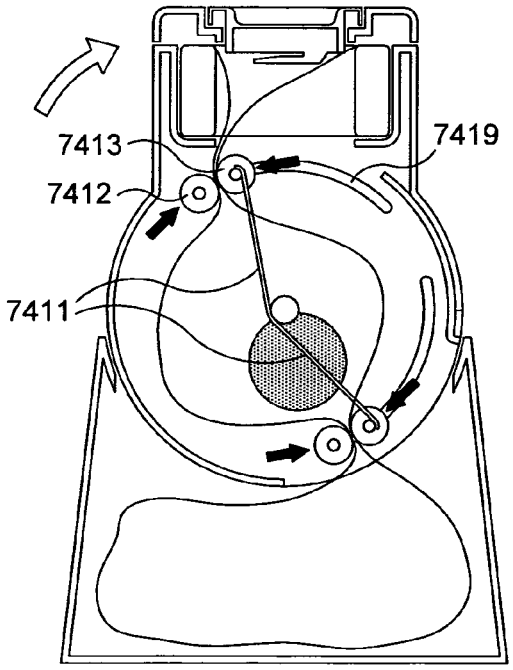
FIG. 52 is a view of the yet another implementation of FIG. 51 in a second stage of operation.
Figure 53:
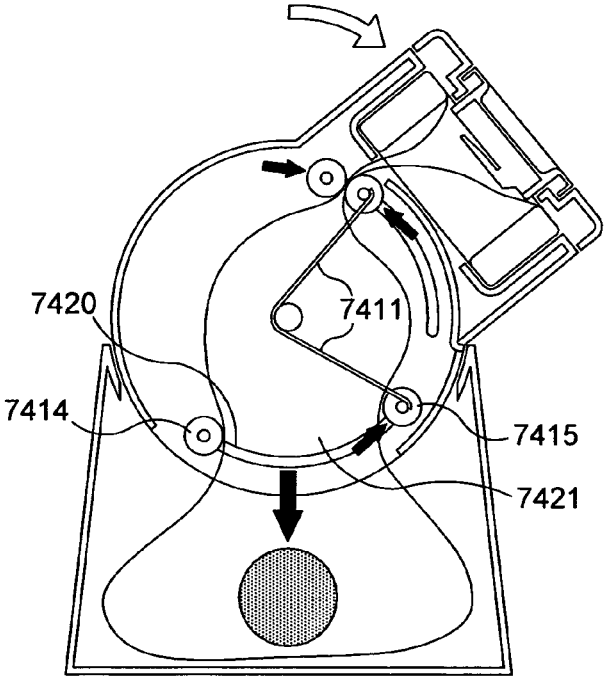
FIG. 53 is a view of the yet another implementation of FIG. 51 in a third stage of operation.
Figure 54:
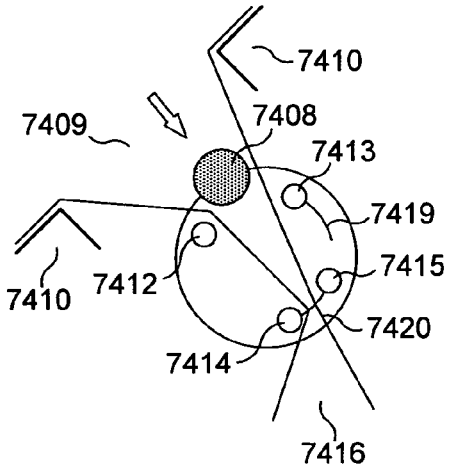
FIG. 54 is a schematic view of the first stage of operation shown in FIG. 51.
Figure 55:
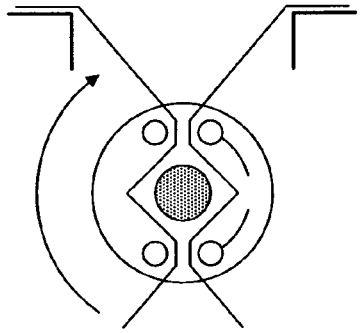
FIG. 55 is a schematic view of the second stage of operation shown in FIG. 52.
Figure 56:
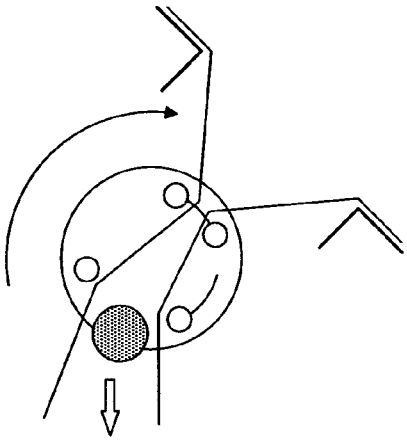
FIG. 56 is a schematic view of the third stage of operation shown in FIG. 53.
Figure 57:
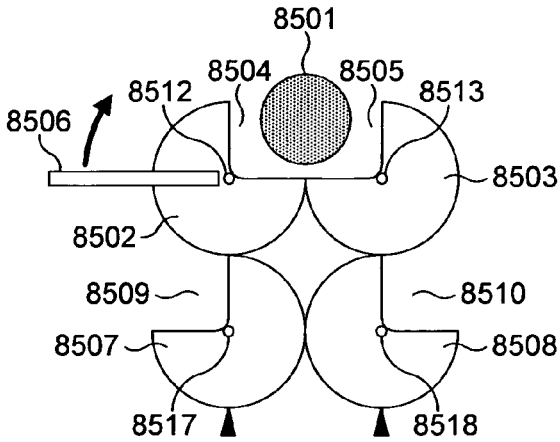
FIG. 57 is a view of a yet further other implementation of the invention in a first stage of operation as described in Annex 1.

Referring to FIG. 52, tilting the top section up towards the vertical causes the spring mechanism (7411) to urge the roller (7413) to travel along its channel (7419) until it comes to rest against the other roller (7412) of the top pair, thereby pressing closed the film at the top of the cavity.

As the top section is tilted further, beyond the vertical (FIG. 53), the spring mechanism (7411) urges the lower movable roller (7415) along its respective channel (7420), moving relative to the other roller (7414) in the lower pair, creating an opening (7421) between them that the nappy can fall through into the storage bin below.

Optionally, it can also be set up to have enough potential energy to return to its initial state without user action.

According to a seventh implementation the device comprises one or pairs of waste package receiving and depositing elements in the form of a series of rollers which grip the waste and pull it downwards inside a layer of film as can be understood from the schematic cross-sectional views shown in FIGS. 57 to 61 illustrating steps in the approach.

In summary a four roller mechanism is provided for moving a nappy into a sealed further storage chamber including a mechanism or gearing necessary to operate the four rollers by pulling a single lever. In addition a dosing wheel may be implemented as discussed above with reference to other embodiments to load the film at the start of a new cassette for example by manual rotation of one of the rollers gripping the film to pull the film downwards presenting the user with fresh film in the cavity.

Figure 58:
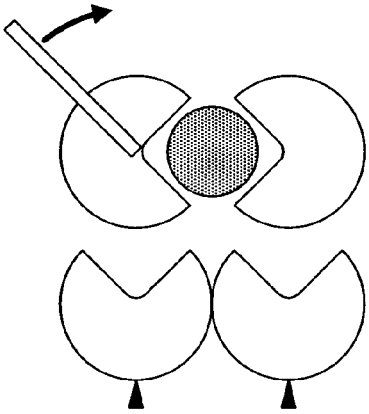
FIG. 58 is a view of the yet further other implementation of FIG. 57 in a second stage of operation.
Figure 59:
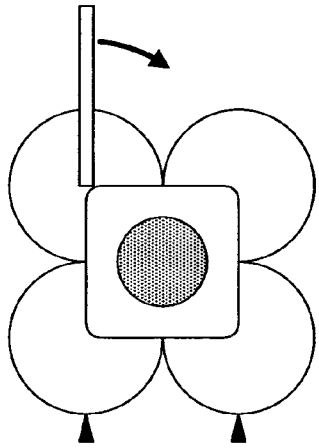
FIG. 59 is a view of the yet further other implementation of FIG. 57 in a third stage of operation.
Figure 60:
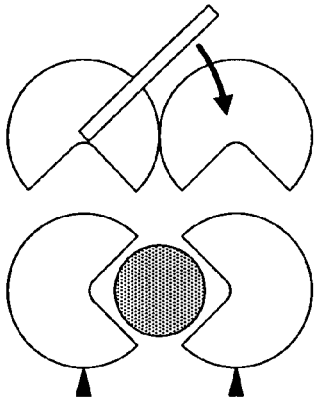
FIG. 60 is a view of the yet further other implementation of FIG. 57 in a fourth stage of operation.

Referring to FIGS. 57-61, nappy (8501) is dropped on top of a pair of parallel rollers (8502, 8503) arranged with horizontal axes (8512, 8513). The rollers each have a large channel (8504, 8505) in them and in the start position both are facing upwards and towards each other to receive the nappy. After depositing the nappy, the user then operates a handle (8506) which rotates the rollers in opposite angular directions so that the channels cooperatively capture the nappy and pull it downwards (FIGS. 58-60).

Figure 61:
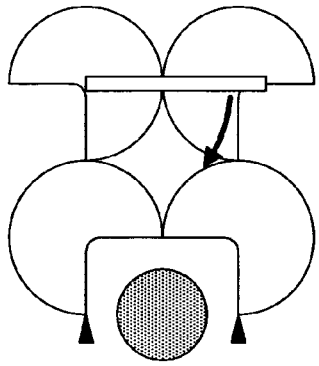
FIG. 61 is a view of the yet further other implementation of FIG. 57 in a fifth stage of operation.

The handle simultaneously rotates a second pair of parallel rollers (8507, 8508) positioned directly below the top two, also with horizontal axes (8517, 8518). The bottom rollers also have channels (8509, 8510) in them configured to meet the channels in the upper rollers as they rotate thereby pulling the nappy further down and into the storage bin below (FIG. 61).

The axes of all the rollers may move slightly to allow the rollers to move apart when the nappy is pulled through. The rollers may be made from a rigid material, or may be elastic to better grip the nappy.

The rollers are set up so that a single handle operation will be enough to turn all four rollers through a single revolution, so that after completing each operation they are ready to receive the next nappy.

As a result of various implementations as described above, odour is prevented from escaping either by providing airlock systems so that odour from large storage sacks cannot escape when the next nappy is deposited, or by wrapping each nappy in individual film packages, where the operation is by a single user action making operation more simple and straight forward. Of course the steps and approaches in any individual embodiment may be incorporated or juxtaposed, where appropriate, with those from other embodiments as appropriate.

Although discussion above is provided in relation to a full waste storage device including a base or bin, it will be recognised that an upper portion of the waste storage device can be modified to incorporate the features of any of the implementations described above and retrofitted to an existing base or bin as appropriate.

We claim:

1. A waste package storage device comprising a lid hingedly connected to the waste storage device, the lid moveable from an open position to a closed position, an inlet closure mechanism positioned below the lid and an outlet closure mechanism at respective inlet and outlet ends of a storage space, each closure mechanism comprising first and second closure members relatively moveable between an open, spaced position and a closed, abutting position and an actuator comprising a lever operable to simultaneously rotatably move the first and second closure members at the inlet end to an open position and the first and second closure members of the outlet end to a closed position, and vice versa;

wherein the first and second outlet closure members at the outlet end define a channel for receiving a waste package, and wherein the first and second outlet closure members at the outlet end are rotatable in order to release a received waste package from the outlet end of the waste package storage device, and wherein the inlet and outlet closure mechanisms are biased to a closed position and operation of the actuator overcomes the bias in relation to one of the inlet and outlet closure mechanisms and allows the other of the inlet and outlet closure mechanisms to be biased closed.

2. A device as claimed in claim 1 in which the closure mechanisms are arranged to close waste storage tubing.

3. A device as claimed in claim 1 comprising a further storage space for receiving waste packages from the outlet end.

4. A device as claimed in claim 1 in which at least one of the closure members is moveable relative to the other.

5. A device as claimed in claim 1 in which, in an intermediate position, both of the inlet and outlet closure mechanisms are in an open or partially open configuration.

6. A device as claimed in claim 1 in which the first and second closure members are biased towards the closed position.

7. A device as claimed in claim 1 further comprising a dosing formation for drawing waste package storage tubing from a waste package storage tubing cassette.

8. A waste package storage device comprising a lid hingedly connected to the waste storage device, the lid moveable from an open position to a closed position, an inlet closure mechanism positioned below the lid and an outlet closure mechanism at respective inlet and outlet ends of a storage space, each closure mechanism comprising first and second closure members relatively moveable between an open, spaced position and a closed, abutting position and an actuator comprising a lever operable to simultaneously rotatably move the first and second closure members at the inlet end to an open position and the first and second closure members of the outlet end to a closed position;

wherein the first and second outlet closure members at the outlet end define a channel for receiving a waste package, and wherein the first and second outlet closure members at the outlet end are rotatable in order to release a received waste package from the outlet end of the waste package storage device, and wherein the inlet and outlet closure mechanisms are biased to a closed position and operation of the actuator overcomes the bias in relation to one of the inlet and outlet closure mechanisms and allows the other of the inlet and outlet closure mechanisms to be biased closed.

9. A device as claimed in claim 8 wherein the first and second closure members in the inlet closure mechanism are movable between an open spaced position and a closed abutting position by operation of the actuator.

10. A device as claimed in claim 8 wherein the first and second closure members of the outlet closure mechanism are relatively movable between an open spaced position and a closed abutting position by operation of the actuator.

11. A device as claimed in claim 8 wherein the first and second closure members of the outlet closure mechanism each define a channel for receiving a waste package when in an open position.

12. A device as claimed in claim 8 wherein each of said first and second closure members of the outlet mechanism is rotatable in order to move a received waste package towards a storage space below the outlet closure mechanism.

13. A device as claimed in claim 8 further comprising a waste storage cassette housed therein.

14. A waste package storage device comprising a lid hingedly connected to the waste storage device, the lid moveable from an open position to a closed position, an inlet closure mechanism positioned below the lid and an outlet closure mechanism at respective inlet and outlet ends of a storage space, each closure mechanism comprising first and second closure members relatively moveable between an open, spaced position and a closed, abutting position and an actuator comprising a lever operable to simultaneously rotatably move the first and second closure members at the outlet end to an open position and the first and second closure members of the inlet end to a closed position;

wherein the first and second outlet closure members at the outlet end define a channel for receiving a waste package, and wherein the first and second outlet closure members at the outlet end are rotatable in order to release a received waste package from the outlet end of the waste package storage device, and wherein the inlet and outlet closure mechanisms are biased to a closed position and operation of the actuator overcomes the bias in relation to one of the inlet and outlet closure mechanisms and allows the other of the inlet and outlet closure mechanisms to be biased closed.

15. A device as claimed in claim 14 wherein the first and second closure members in the inlet closure mechanism are movable between an open spaced position and a closed abutting position by operation of the actuator.

16. A device as claimed in claim 14 wherein the first and second closure members of the outlet closure mechanism are relatively movable between an open spaced position and a closed abutting position by operation of the actuator.

17. A device as claimed in claim 14 wherein the first and second closure members of the outlet closure mechanism each define a channel for receiving a waste package when in an open position.

18. A device as claimed in claim 14 wherein each of said first and second closure members of the outlet mechanism is rotatable in order to move a received waste package towards a storage space below the outlet closure mechanism.

19. A device as claimed in claim 14 further comprising a waste storage cassette housed therein.

* * * * *